US010648169B2

(12) United States Patent
Lucho Do Valle

(10) Patent No.: US 10,648,169 B2
(45) Date of Patent: May 12, 2020

(54) PACKAGED CONTAINER HOUSING STRUCTURE AND CONSTRUCTION METHOD

(71) Applicant: NEW HOUSE INTERNATIONAL CORP, Deerfield Beach, FL (US)

(72) Inventor: Luiz Fernando Lucho Do Valle, Sao Paulo (BR)

(73) Assignee: NEW HOUSE INTERNATIONAL CORP., Deerfield Beach, FL (US)

( * ) Notice: Subject to any disclaimer, the term of this patent is extended or adjusted under 35 U.S.C. 154(b) by 0 days.

(21) Appl. No.: 16/545,358

(22) Filed: Aug. 20, 2019

(65) Prior Publication Data

US 2019/0376276 A1 Dec. 12, 2019

Related U.S. Application Data

(63) Continuation-in-part of application No. 15/497,342, filed on Apr. 26, 2017, now Pat. No. 10,415,263.

(51) Int. Cl.

| | |
|---|---|
| ***E04B 1/343*** | (2006.01) |
| ***E04H 1/02*** | (2006.01) |
| ***E04B 1/344*** | (2006.01) |

(52) U.S. Cl.

CPC ..... *E04B 1/34357* (2013.01); *E04B 1/3442* (2013.01); *E04B 1/34336* (2013.01); *E04B 1/34384* (2013.01); *E04H 1/02* (2013.01)

(58) Field of Classification Search

CPC ..... E04B 1/34336; E04B 1/34384; E04B 1/34363; E04B 1/34357; E04B 1/344;

(Continued)

(56) References Cited

U.S. PATENT DOCUMENTS 3,100,624 A ‡ 8/1963 Spiselman ..... E04F 15/0247 254/101
3,222,030 A ‡ 12/1965 Thorpe ..... E04F 15/02452 248/354.3

(Continued)

FOREIGN PATENT DOCUMENTS

GB 2472465 A * 2/2011 ..... E04H 1/1205

OTHER PUBLICATIONS

Blu Homes, retrieved at: https://www.bluhomes.com/breezehouse, Jun. 22, 2015, pp. 1-3.‡

(Continued)

*Primary Examiner* — Joshua J Michener
*Assistant Examiner* — Matthew J Gitlin
(74) *Attorney, Agent, or Firm* — David Colls

(57) ABSTRACT

A packaged container housing structure includes a container box frame of rectangular configuration defining an interior space and an open top, closed bottom, opposite right and left open sides and opposite open ends, a top roof mounted on the container box frame and movable toward and away from the open top to close and open access of air flow into the interior space, coupling fittings integrated at top cover corners to enable lifting the packaged container housing structure, a plurality of deployable panels including wall panels, ceiling panels and floor panels stored in the interior space of the container box frame, and support feet attachable to the floor panels and container box frame being adjustable in length independent of one another so as to position the container box frame in a level orientation relative upon a mounting site.

19 Claims, 58 Drawing Sheets

(58) Field of Classification Search
CPC ..... E04B 2001/34394; E04B 1/34305; E04B 1/3431; E04B 1/3442; E04B 7/166; E04H 1/1205; E04H 1/005; E04H 2001/1283; B65D 88/005; B65D 88/121; B65D 90/0033
USPC ..... 52/79.5
See application file for complete search history.

(56) References Cited

U.S. PATENT DOCUMENTS 3,591,033 A ‡ 7/1971 Partridge ..... B66C 1/16 220/1.5
3,605,350 A ‡ 9/1971 Bowers ..... E04B 1/24 52/16
3,792,558 A ‡ 2/1974 Berce ..... E04B 1/348 52/79.7
3,835,600 A ‡ 9/1974 Padula ..... E04B 1/3442 52/67
3,924,370 A ‡ 12/1975 Cauceglia ..... E04F 15/0247 52/126.6
3,941,414 A ‡ 3/1976 Platt ..... B60P 3/34 296/170
3,983,665 A ‡ 10/1976 Burton ..... E04B 1/3442 52/71
4,151,925 A ‡ 5/1979 Glassmeyer ..... B65D 88/005 206/386
4,462,631 A ‡ 7/1984 Lange ..... E60P 3/38 135/88.16
4,635,412 A ‡ 1/1987 Le Poittevin ..... E04B 1/3442 280/76
4,689,924 A ‡ 9/1987 Jurgensen ..... E04B 1/3444 52/67
4,729,292 A * 3/1988 Marton ..... F24F 13/075 454/284
4,989,379 A ‡ 2/1991 Suzuki ..... E04B 1/3442 52/66
5,109,999 A ‡ 5/1992 Instone ..... A01K 1/0035 220/1.5
5,143,417 A ‡ 9/1992 Philley ..... B60P 3/341 108/145
5,154,469 A ‡ 10/1992 Morrow ..... B60P 3/34 296/171
5,170,901 A ‡ 12/1992 Bersani ..... E04B 1/3431 220/1.5
5,237,784 A ‡ 8/1993 Ros ..... B60P 1/6427 52/67
5,317,857 A ‡ 6/1994 Allison ..... E04H 1/1205 52/125.6
5,596,844 A ‡ 1/1997 Kalinowski ..... E04B 1/3442 52/122.1
6,112,929 A ‡ 9/2000 Ota ..... B65D 88/005 220/1.5
6,223,479 B1 ‡ 5/2001 Stockli ..... E04B 1/3442 52/126.1
6,227,397 B1 ‡ 5/2001 Kim ..... B65D 88/005 220/1.5
6,336,299 B1 ‡ 1/2002 Wixom ..... E04H 5/08 34/210
7,631,460 B2 ‡ 12/2009 Napier ..... E04B 1/3442 16/368
7,793,467 B1 * 9/2010 Melton ..... E04H 5/04 52/79.1
7,971,713 B2 ‡ 7/2011 Kim ..... B60P 3/08 206/335
8,166,715 B2 ‡ 5/2012 De Azambuja ..... B60P 3/34 52/79
8,484,908 B2 * 7/2013 Hache ..... B60P 3/14 137/234.6
8,650,806 B1 * 2/2014 Condie ..... E04H 1/1205 52/79.5
8,739,475 B2 ‡ 6/2014 Michaud ..... E04B 1/344 52/166
8,898,999 B1 ‡ 12/2014 Kugler ..... E04F 15/02464 52/126.6
9,016,001 B2 ‡ 4/2015 Heger ..... E04B 1/34357 52/79.5
9,080,326 B2 * 7/2015 Johnson ..... B65D 90/143
9,556,621 B2 ‡ 1/2017 Pelc ..... E04F 15/02452
9,580,236 B1 ‡ 2/2017 Skeid ..... B65D 19/08
9,617,748 B2 * 4/2017 Wilson ..... E04H 1/005
9,803,377 B2 ‡ 10/2017 Pelc, Jr. ..... E04B 1/003
2003/0070372 A1 ‡ 4/2003 Favero ..... E04D 11/007 52/220.1
2003/0115808 A1 ‡ 6/2003 Morrow ..... B60P 3/34 52/64
2004/0035064 A1 ‡ 2/2004 Kugler ..... E04F 15/02183 52/126.6
2004/0055232 A1 ‡ 3/2004 Jette ..... H02G 3/285 52/220.1
2004/0067118 A1 ‡ 4/2004 Kim ..... B65D 88/005 410/46
2004/0261329 A1 * 12/2004 Kugler ..... E04F 15/02183 52/126.6
2005/0284035 A1 ‡ 12/2005 DeOvando ..... E04B 1/3431 52/79.1
2006/0191211 A1 ‡ 8/2006 Colquhoun ..... E04B 1/3442 52/64
2007/0079573 A1 ‡ 4/2007 Sarine ..... E04B 1/34305 52/592.1
2008/0184632 A1 ‡ 8/2008 Hartzell ..... E04B 7/22 52/66
2008/0236055 A1 ‡ 10/2008 Laprise ..... E04B 1/3444 52/64
2009/0183442 A1 ‡ 7/2009 Repasky ..... E04D 11/007 52/126.6
2009/0217600 A1 * 9/2009 De Azambuja ..... B60P 3/34 52/79.5
2009/0266006 A1 ‡ 10/2009 Gyory ..... E04B 1/3444 52/79.5
2010/0024317 A1 ‡ 2/2010 Pope ..... E04B 1/3431 52/79.5
2010/0218436 A1 ‡ 9/2010 Colquhoun ..... E04B 1/3442 52/79.5
2010/0269419 A1 * 10/2010 Gyory ..... E04B 1/3444 52/79.5
2011/0146751 A1 ‡ 6/2011 McGuire ..... F03D 9/007 136/245
2011/0289860 A1 ‡ 12/2011 Wilson ..... E04B 1/34315 52/79.5
2012/0006369 A1 ‡ 1/2012 Cantin ..... E04B 1/34305 135/96
2012/0096775 A1 ‡ 4/2012 Allison ..... B60P 3/0252 52/7
2012/0110925 A1 ‡ 5/2012 Weber ..... E03C 1/01 52/79.1
2012/0151851 A1 ‡ 6/2012 Cantin ..... E04B 1/34305 52/79.5
2012/0255240 A1 ‡ 10/2012 Shen ..... E04B 1/34305 52/79.5
2012/0255957 A1 ‡ 10/2012 McGowen ..... B60P 3/24 220/564
2013/0036702 A1 ‡ 2/2013 Pacetti ..... E04H 1/1205 52/653.2
2013/0067846 A1 * 3/2013 Kvols ..... E04H 1/1205 52/586.1
2013/0133273 A1 * 5/2013 Michaud ..... E04B 1/3442 52/79.5
2013/0186010 A1 ‡ 7/2013 Condie ..... F24F 1/02 52/79.5
2013/0291449 A1 ‡ 11/2013 Strickland ..... E04B 1/3442 52/79.5
2013/0305626 A1 ‡ 11/2013 Strickland ..... E04B 1/34384 52/79.5
2013/0334222 A1 ‡ 12/2013 Elliot ..... B65D 21/086 220/4.12
2014/0001786 A1 ‡ 1/2014 Cantin ..... E04B 1/34357 296/26.14

(56) References Cited

U.S. PATENT DOCUMENTS

2014/0117010 A1‡ 5/2014 Chuang ..... B65D 21/08 220/4.03
2014/0144088 A1‡ 5/2014 Heger ..... E04B 1/34357 52/79.5
2014/0150352 A1‡ 6/2014 Lee ..... E04B 1/3444 52/2.2
2014/0202089 A1‡ 7/2014 Nakajima ..... E04B 1/3444 52/79.5
2014/0246425 A1‡ 9/2014 Janin ..... B65D 88/005 220/1.5
2015/0014886 A1‡ 1/2015 Mullaney ..... E04B 1/3431 264/299
2015/0028025 A1‡ 1/2015 Mullaney ..... E04B 1/3431 220/1.5
2015/0033639 A1‡ 2/2015 Wilson ..... E04H 9/04 52/79.5
2015/0034634 A1* 2/2015 Mullaney ..... E04B 1/3431 220/1.5
2015/0218794 A1‡ 8/2015 Martyn ..... E04B 1/3441 52/79.5
2016/0040443 A1* 2/2016 Stephenson ..... E04H 1/005 52/79.5
2016/0069062 A1* 3/2016 Dynon ..... E04B 1/3442 52/79.5
2016/0114968 A1‡ 4/2016 Miled ..... B65D 88/005 220/1.5
2016/0153183 A1‡ 6/2016 Richter ..... E04B 1/3431 52/79.5
2016/0340920 A1‡ 11/2016 Allison ..... E04H 3/28
2017/0030071 A1‡ 2/2017 Sorensen ..... E04B 1/3444
2017/0037612 A1‡ 2/2017 Duncan ..... E04H 1/1205
2017/0247184 A1‡ 8/2017 Heskamp ..... B65D 88/522

OTHER PUBLICATIONS

Lushome, retrieved at: http://www.lushome.com/modern-mobile-home-design-featuring-folding-structure/88245, Apr. 12, 2017, pp. 1-5.‡

Rhcem H2AC System, 2013 Product of the Year, retrieved at: http://www.rheem.com/h2ac/, pp. 1-4.‡

* cited by examiner
‡ imported from a related application

192

112
112

192

192

192

PACKAGED CONTAINER HOUSING STRUCTURE AND CONSTRUCTION METHOD

CROSS-REFERENCE TO RELATED APPLICATIONS

This U.S. nonprovisional patent application is a continuation-in-part application and is claiming the benefit of U.S. nonprovisional patent application Ser. No. 15/497,342, having a filing date of Apr. 26, 2017, which is incorporated herein in its entirety.

FIELD OF THE INVENTION

The present invention relates to approaches to housing construction, and, more particularly, is concerned with a packaged container housing structure and construction method.

BACKGROUND OF THE INVENTION

The numbers of families living in high-poverty areas are increasing daily as more and more families are living on income levels below the federal poverty threshold. These high-poverty areas are riddled with poor constructed homes as their inhabitants are unable to afford to relocate to nicer areas or renovate their present homes. People living in those areas are further discouraged of the idea that things will turned around knowing that the possibilities of their neighborhoods being developing by wealthy investors are slim since they predominately chose to develop other geographical areas, better suited, for their businesses. As a result, many have tried to create sustainable living quarters at an affordable price for those living with financial restrictions in an effort to improve their living areas and quality of life.

One example of an approach to a portable housing construction others have done in the past is shown on U.S. Pat. No. 8,720,126 drawn to a transportable housing container. However, much like what is shown there, and many other examples like it, the principle purpose of the transportable housing structure is to provide living quarters for those in emergency situations by deploying temporary housing. This type of approach only provides a short-term solution to those who are in dire necessity of a shelter to protect themselves from the elements. It does not however provide a long-term solution to those who seek a permanent home, such as, those living with financial restrictions yearning for a home structure that is affordable and easy to assembly, yet durable, throughout the many seasons and climate changes it has to endure.

Therefore, there is a long felt, but as of yet unmet, need for a packaged housing structure and construction method that enables an inhabitant to easily install a durable and aesthetically pleasing home that is affordable and provides the same benefits as a newly constructed home.

SUMMARY OF THE INVENTION

The present invention is directed to an innovation that overcomes the deficiencies of the known art and the problems that remain unsolved by providing a packaged container housing structure and construction method. The packaged container housing structure is transportable on a truck bed to a foundation site. A crane, preferably mounted on the truck bed, is employed at the site to assist in unloading and setting up the packaged container housing structure at the foundation site and also to assist in deploying and erecting components of the packaged container housing structure to construct a house at the site, all in a minimal amount of time.

In one aspect of the present invention, a packaged container housing structure includes:

- a container box frame of a rectangular configuration and a single unit format defining an interior space and having an open top, a closed bottom that includes at least one air vent, a pair of opposite right and left open sides and a pair of opposite open ends;
- a plurality of deployable panels disposed in the interior space of the container box frame adjacent the opposite right and left open sides and the opposite open ends thereof;
- a top roof mounted on the container box frame providing a pair of opposite right and left openings between the container box frame and the top roof, wherein one opening of the pair of opposite right and left openings is larger in size than another; and
- a pair of top windows mounted along the pair of opposite right and left openings.

In another aspect of the present invention, the top roof includes:

- a top cover above and aligned with the open top of said container box frame and having right and left front corners and right and left rear corners aligned with upper ends of right and left front corners and right and left rear corners of said container box frame, the top cover having a pitch for provide proper drainage; and
- a plurality of coupling fittings removably attached to each one of the right and left front corners and the right and left rear corners of the top cover to enable lifting the packaged container housing structure to and from a foundation site.

In another aspect of the present invention, one of the pair of top windows mounted to the opening of larger size may include an air slot provided above the top window, the air slot giving access to air flow to enter the open top of said container box frame into the interior space of said container box frame.

In yet another aspect of the present invention, the top roof includes a rain guard that extends outwardly from the top roof to cover an air slot provided above one of the top windows mounted to the opening of larger size to prevent precipitation from entering the interior space of said container box frame through the air slot.

In another aspect of the present invention, the air slot includes a mesh to prevent unwanted entry of insects.

In another aspect of the present invention, the packaged container housing structure also includes a plurality of support feet disposed in the interior space in the container box frame, selected ones of the support feet being attachable to selected ones of the deployable panels and to the container box frame under the closed bottom thereof at least adjacent to each one of the right and left front corners and the right and left rear corners of the closed bottom, the tubular feet being adjustable in length independent of one another so as to enable positioning the selected deployable panels and the container box frame in a level orientation upon a mounting site.

In another aspect of the present invention, each of the plurality of support feet includes an elongated tube, a threaded stem affixed on and protruding from one end of the elongated tube so as to extend coaxially therewith, an annular-shaped attachment disc enabling anchoring of the support foot to the mounting site, and a pair of annular threaded sections, one of the annular threaded sections being affixed on, and projecting from, the attachment disc, the other of the annular threaded sections being defined on an opposite end of the elongated tube from the threaded stem affixed at the one end of the elongated tube. The annular threaded sections are threadably engageable with one another such that the attachment disc extends laterally outwardly from the elongated tube being rotatable in opposite directions relative to the attachment disc so as to correspondingly retract and extend the elongated tube toward and away from the attachment disc to thereby adjust the length of the support foot and enable positioning the selected deployable panels and the container box frame in the level orientation upon the mounting site.

In another aspect of the present invention, the packaged container housing structure also includes another container box frame in addition to the one container box frame, the container box frames having complementary interengageable latches mounted at ones of the opposite ends of said container box frames placed adjacent to one another that become fastened together upon the container box frames being placed end-to-end at the adjacent one ends in a double unit format.

In another aspect of the present invention, the plurality of deployable panels of the packaged container housing structure includes wall panels with doorways and wall panels which are solid. The wall panels are interchangeable so as to provide different iterations of rooms in a completed house constructed from the packaged housing structure in both the single and double unit formats.

In another aspect of the present invention, a packaged container housing structure includes:

a container box frame of a rectangular configuration and a single unit format, the container box frame comprising, a plurality of elongated corner members having one pair thereof disposed upright at respective right and left front corners of said container box frame and another pair thereof disposed upright at respective right and left rear corners of the container box frame, the elongated corner members of the pairs thereof extending parallel to one another, a plurality of elongated side edge members having one pair thereof disposed transversely between respective upper ends and respective lower ends of the right front and rear corners of the container box frame and another pair thereof disposed transversely between respective upper ends and respective lower ends of the left front and rear corners of the container box frame, the elongated side edge members of the pairs thereof extending parallel to one another, a plurality of elongated end edge members having one pair thereof disposed transversely between the respective upper ends and respective lower ends of the right and left front corners of the container box frame and another pair thereof disposed transversely between the respective upper ends and respective lower ends of the right and left rear corners of the container box frame, the elongated end edge members of the pairs thereof extending parallel to one another, the elongated corner members and the elongated side and end edge members being rigidly affixed together to form an interior space in the container box frame and an open top, a closed bottom, a pair of opposite right and left open sides and a pair of opposite open ends, on said container box frame;

a plurality of deployable panels disposed in the interior space in said container box frame adjacent said opposite right and left open sides and the opposite open ends thereof, selected ones of said deployable panels being movable relative to respective ones of the pluralities of elongated corner members and side edge members at right and left sides of the container box frame for deploying and erecting one or more rooms at right and left sides of the container box frame;

a top roof mounted on the container box frame providing a pair of opposite right and left openings between the container box frame and the top roof, comprising a top cover above and aligned with the open top of said container box frame and having right and left front corners and right and left rear corners aligned with upper ends of right and left front corners and right and left rear corners of the container box frame, the top cover having a pitch to provide proper drainage;

a pair of top windows mounted along the pair of opposite right and left openings, wherein one opening of the right and left openings includes an air slot provided above the mounted top window, said air slot giving access to air flow to enter the open top of the container box frame into the interior space of the container box frame; and a plurality of coupling fittings removably attached to each one of the right and left front corners and the right and left rear corners of the top cover to enable lifting the packaged container housing structure to and from a foundation site.

In another aspect of the present invention, a packaged container housing construction method includes:

providing a container box frame of a rectangular configuration defining an interior space and an open top, a closed bottom having at least one air vent, a pair of opposite right and left open sides and a pair of opposite front and rear open ends;

providing a plurality of deployable panels in the interior space of the container box frame adjacent to the opposite right and left open sides and opposite front and rear open ends such that selected ones of the deployable panels are movable relative to respective ones of the opposite right and left open sides of the container box frame for deploying and erecting one or more rooms at right and left sides of the container box frame;

providing a top roof mountable on the container box frame, the roof top providing a pair of opposite right and left openings between said container box frame with pair of top windows mounted thereon, wherein one opening of the right and left openings includes an air slot provided above the mounted top window giving access to air flow to enter said open top of the container box frame into the interior space of the container box frame;

providing a plurality of support feet from the interior space in the container box frame, the support feet being adjustable in length independent of one another;

retrieving selected ones of the support feet from the interior space in the container box frame and attaching the selected support feet under the closed bottom of the container box frame at least adjacent to each one of right and left front corners and right and left rear corners of the closed bottom thereof;

adjusting the length of each of the support feet so as to enable positioning the container box frame in a level orientation upon a mounting site; and positioning the container box frame in the level orientation upon a foundation site.

In another aspect of the present invention, the packaged container housing construction method also includes moving a plurality of top windows mounted along opposite sides of the top roof toward and away from side openings between the top roof and the open top of the container box frame to regulate the air flow into and from the side openings between the top roof and the open top of and the interior space in the container box frame.

In another aspect of the present invention, the packaged container housing construction method also includes deploying and erecting selected ones of the deployable panels as wall panels, ceiling panels and floor panels relative to opposite right and left open sides of the container box frame so as to provide one or more rooms on the right and left sides of the container box frame.

In another aspect of the present invention, the packaged container housing construction method also includes:

- attaching selected other ones of the support feet to a bottom of each of the floor panels; and
- adjusting the length of each of the support feet so as to enable positioning the floor panel in a level orientation upon the mounting site.

In another aspect of the present invention, the packaged container housing construction method also includes:

- providing another container box frame in the single unit format in addition to the one container box frame in the single unit format;
- placing the container box frames end-to-end at adjacent ones of opposite ends thereof to form a double unit format; and
- fastening the container box frames together by interengaging complementary latches mounted at the adjacent ones of the opposite ends of the container box frames.

In another aspect of the present invention, the packaged container housing construction method also includes interchanging the wall panels having doorways with wall panels which are solid so as to provide different iterations of rooms in a completed house in both the single and double unit formats.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which:

FIGS. 4A and 4B present respective enlarged fragmentary isometric views of a near lower left corner of the packaged container housing structure and one of the plurality of support feet before its attachment to the bottom of the packaged container housing structure, as seen in the dashed circle in FIG. 4, and after its attachment;

FIGS. 37-47, 37A-45A, 37B-39B and 41B-41D present in a sequence of isometric views the crane assisting in deployment and erection of ceiling (or roof), wall and floor panels of the pair of packaged container housing structures in the double unit format in a manner similar to the deployment and erection of those of the packaged container housing structure in the single unit format as shown in FIGS. 7-31.

FIG. 57 presents a top perspective view of the packaged container structure with an add-on roof structure that can be used as storage space for A/C units, water heaters, and the like.

Like reference numerals refer to like parts throughout the several views of the drawings.

DETAILED DESCRIPTION

Figure 1:
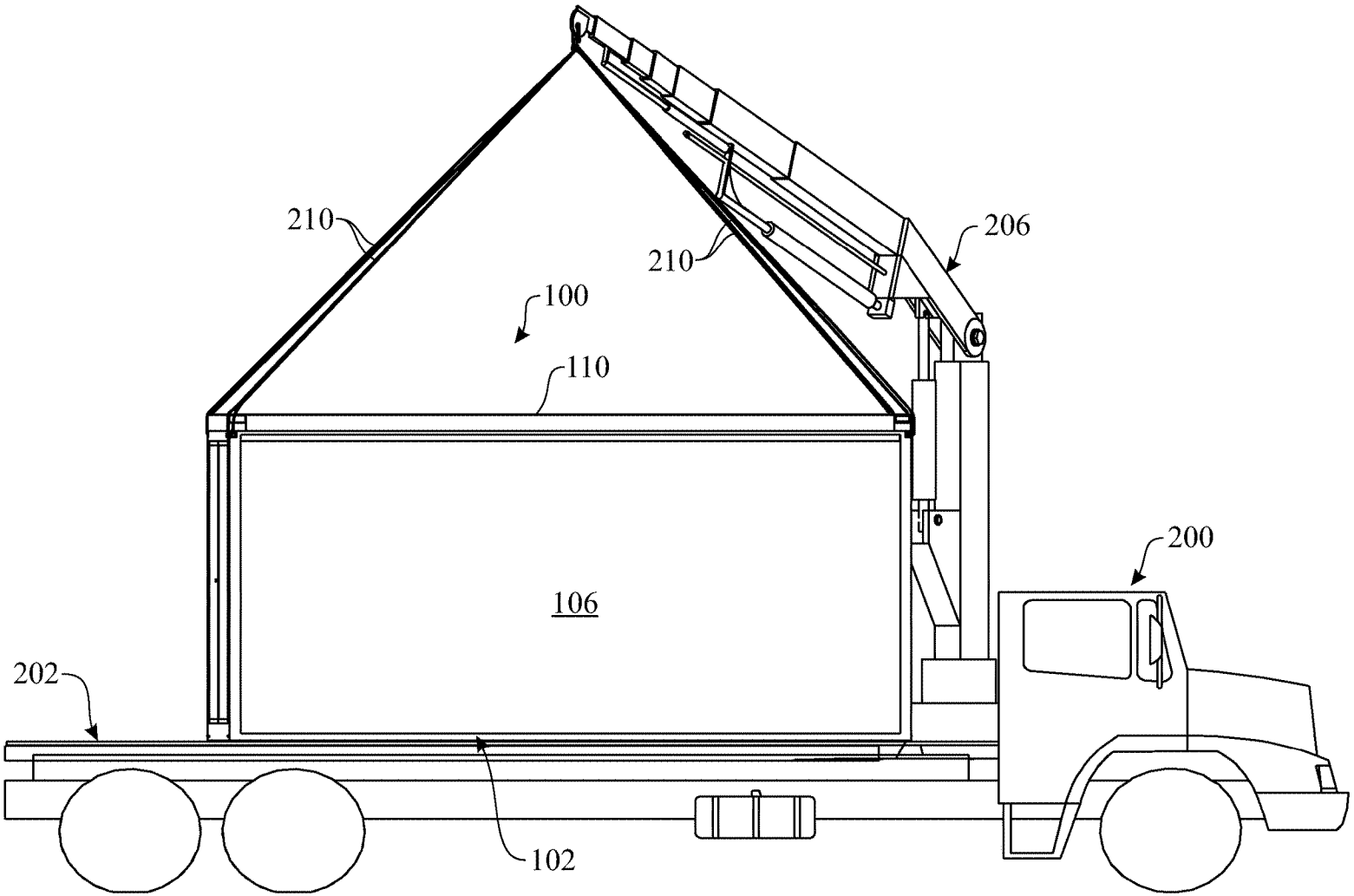
FIG. 1 presents a side elevation view of an exemplary embodiment of a packaged container housing structure in accordance with aspects of the present invention, showing the packaged container housing structure on a flatbed of a transport truck at a site where a crane on the flatbed is prepared to lift the packaged container housing structure from the flatbed.
Figures 2, 2A:
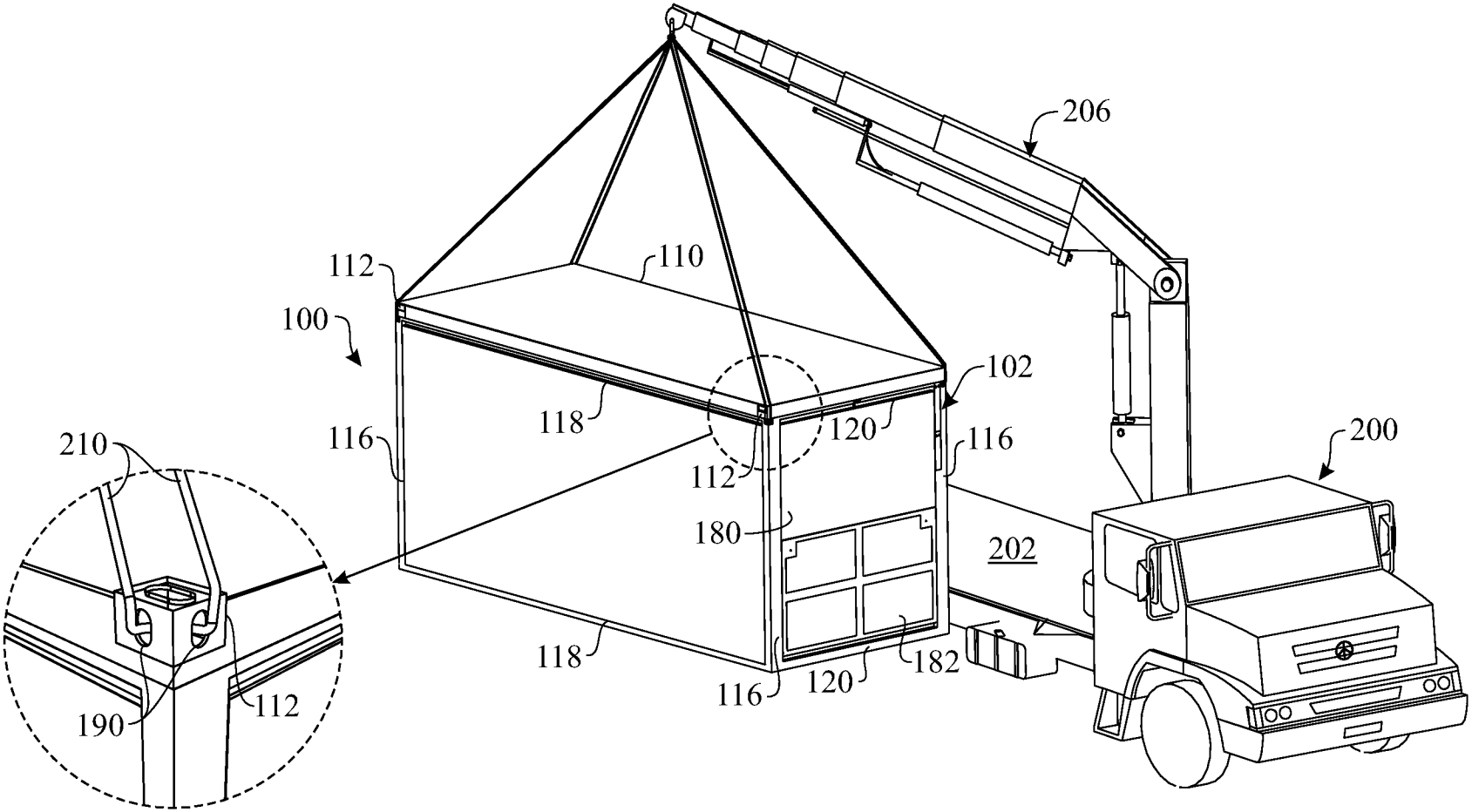
FIGS. 2 and 2A present isometric views of the packaged container housing structure originally introduced in FIG. 1, showing the packaged container housing structure being unloaded by the crane from the flatbed of the truck via lift lines extending through apertures in coupling fittings incorporated at corners of a roof on a container box frame.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIGS. 1-3. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIGS. 1-31, 3A-5A, 4B-5B, 7A, 11A-14A, 18A, 22A-23A, 27A-30A and 28B, there is illustrated an exemplary embodiment of a packaged container housing structure, generally designated 100, in accordance with aspects of the present invention. The packaged container housing structure 100 basically includes an elongated container box frame 102, a plurality of deployable panels including wall panels 104, ceiling panels 106 and floor panels 108 in the container box frame, a top roof 110 on the container box frame, and a plurality of coupling fittings 112 on the top roof. The packaged container housing structure 100 may be transported by a truck 200 on a flatbed 202 of the truck to a foundation site 204. There, a crane 206, preferably mounted along with the packaged container housing structure 100 on the flatbed 202 of the truck 200, may be employed to assist in unloading and setting up the packaged container housing structure 100 at the foundation site 204. The packaged container housing structure 100 also includes a plurality of support feet 114 disposed in the container box frame 102. Selected ones of the support feet 114 from the plurality thereof are attachable to the bottom of the container box frame 102 to enable positioning it in a level orientation upon the mounting site 204. The packaged container housing structure 100 may be transported and unloaded in other suitable ways.

Figure 3:
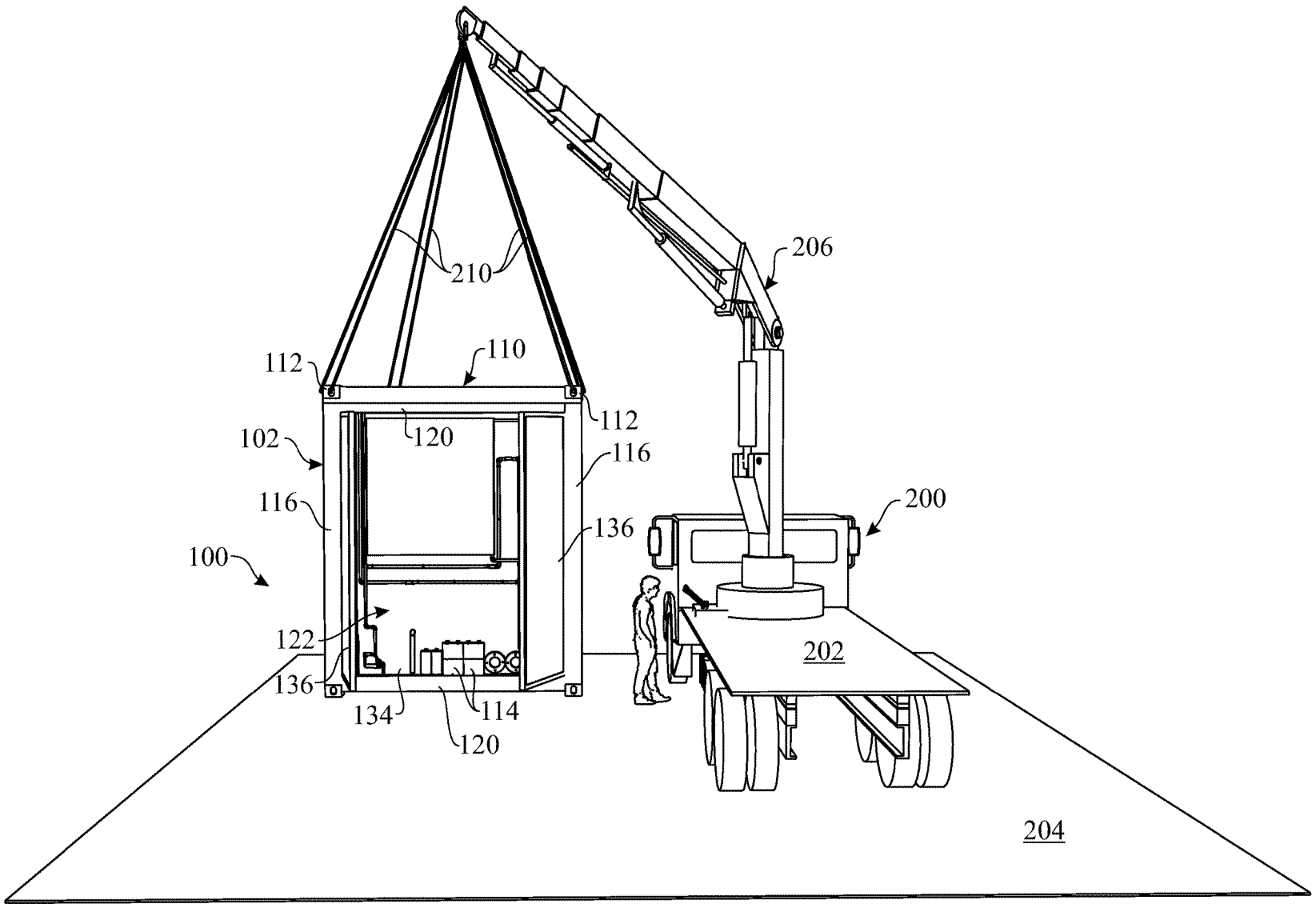
FIG. 3 presents an elevation view of the packaged container housing structure suspended beside the truck by the lift cable lines from the crane on the flatbed of the truck, with a pair of double doors at one end of the packaged container housing structure being open to show a plurality of support feet disposed within the packaged container housing structure.

As shown in FIGS. 1-6, 2A-5A and 3B-5B, the elongated container box frame 102 of the packaged container housing structure 100 is of a rectangular configuration and a single unit format. The container box frame 102 basically includes a plurality of elongated corner members 116, a plurality of elongated side edge members 118 and a plurality of elongated end edge members 120, all of which, by way of example but not limitation, may take the form of elongated rigid metal tubes. The elongated corner members 116 have one pair thereof disposed upright at respective right and left front corners of the container box frame 102 and another pair thereof disposed upright at respective right and left rear corners of the container box frame. The elongated corner members 116 of both pairs extend parallel to one another. The elongated side edge members 118 have one pair thereof disposed transversely between respective upper ends and respective lower ends of the right front and rear corners of the container box frame 102 and another pair thereof disposed transversely between respective upper ends and respective lower ends of left front and rear corners of the container box frame. The elongated side edge members 118 of both pairs extend parallel to one another. The elongated end edge members 120 have one pair thereof disposed transversely between respective upper ends and respective lower ends of right and left front corners of the container box frame 102 and another pair thereof disposed transversely between respective upper ends and respective lower ends of right and left rear corners of the container box frame. The elongated end edge members 120 of both pairs extend parallel to one another. The elongated corner members 116 and the elongated side and end edge members 118, 120 adjacent their respective ends are rigidly affixed together to form an interior space 122 in the container box frame 102 and an open top 124, a pair of opposite right and left open sides 128, 130, a pair of opposite front and rear open ends 132, 134, and a closed bottom 126 also incorporating a metal plate forming a floor 127 (see FIG. 4). The rear open end 134 of the container box frame 102 is normally closed, but may be opened, by a pair of outwardly-swingable double doors 136 respectively pivotally mounted to the opposite upright corner members 116, as shown in FIG. 3.

Also, as shown in FIG. 3, a plurality of the support feet 114 are disposed in the interior space 122 in the container box frame 102 and accessed by opening the double doors 136. As shown in FIGS. 4-10 and 12, four of the support feet 114 are applied under the deployable floor panels 108 and the closed bottom 126 of the container box frame 102, with one support foot being applied adjacent to each one of the four corners of the container box frame. Also, an additional four of the support feet 114 may be applied under a central area of the closed bottom which will be under the kitchen service area of the housing structure 100. For the sake of simplicity, in FIGS. 4, 5, 4A, 4B and 5A, four support feet 114 are shown applied directly under the four corners of the container box frame 102; however, due to the presence of an additional set of four coupling fittings 112 applied directly under the respective four corners of the container box frame 102 (which were there for facilitating vertical stacking of container box frames in their previous, or original, use as shipping containers) the four support feet 114 are actually applied offset from, and thus adjacent to, the four corners of the container box frame, as shown in FIGS. 6-10. The support feet 114 and the coupling fittings 112 may be fabricated using known techniques from any suitable material, for example a metal, such as steel.

Figure 3B:
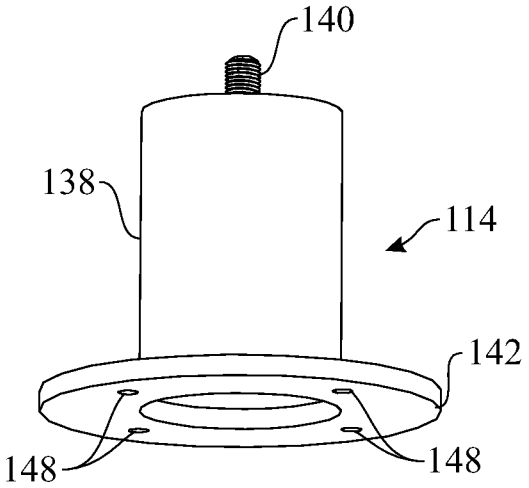
FIGS. 3A and 3B present respective enlarged exploded and assembled isometric views of an elongated tube and an annular-shaped attachment disc of one of plurality of the support feet.
Figure 3A:
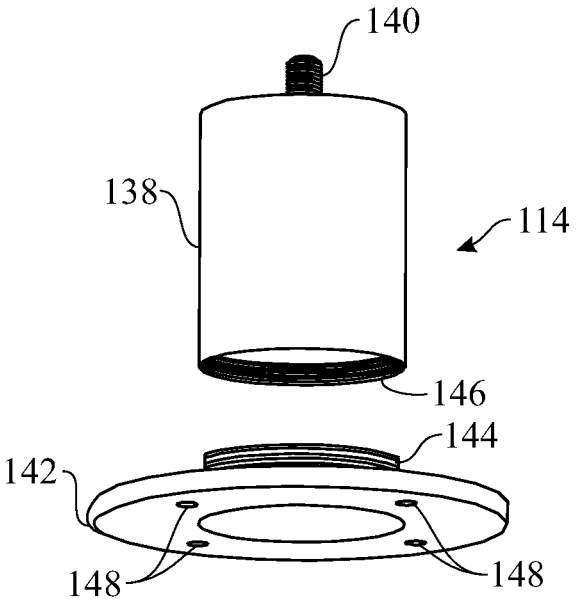
Figure 4:
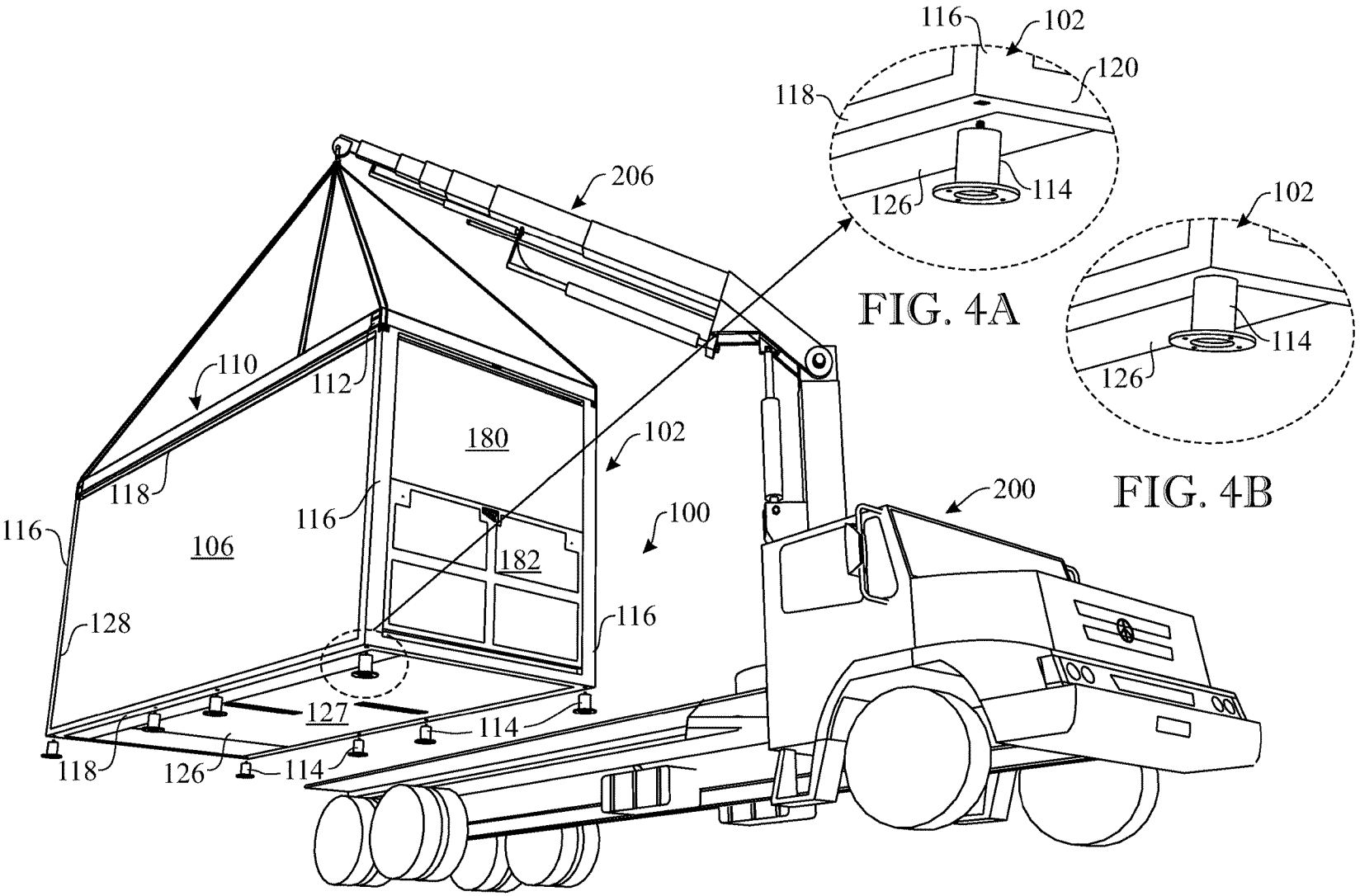
FIG. 4 presents a lower isometric view similar to that of FIG. 2, now showing the respective locations where the plurality of support feet will be attached to the bottom of the packaged container housing structure.

As shown in FIGS. 3A and 3B, each of the support feet 114 includes an elongated tube 138, a threaded stem 140 affixed on and protruding from one end of the elongated tube so as to extend coaxially therewith, an annular-shaped attachment disc 142, and a pair of annular threaded sections 144, 146. The one annular threaded section 144 is affixed on, and projects from, the attachment disc 142. The other annular threaded section is defined on an opposite end of the elongated tube 138 from the threaded stem 140 affixed at the one end of the elongated tube. The annular threaded sections 144, 146 are threadably engageable with one another such that the attachment disc 142 extends laterally, or radially, outwardly from the elongated tube 138 being rotatable in opposite directions relative to the attachment disc so as to correspondingly retract and extend the elongated tube toward and away from the attachment disc. The rotation of the elongated tube 138 relative to the attachment disc 142 adjusts the length of the support foot 114 to thereby enable positioning the container box frame 102 in a level orientation upon the foundation site 204.

Figure 5A:
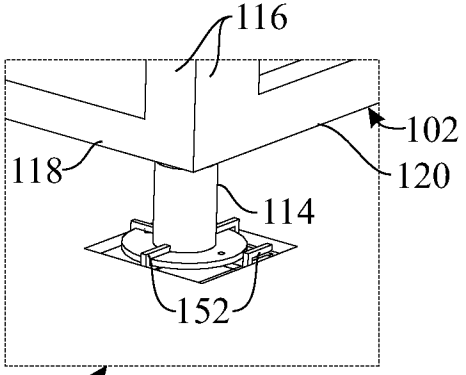
FIG. 5A presents an enlarged isometric view of a near lower left corner of the packaged container housing structure and one of the plurality of support feet attached to the bottom of the packaged container housing structure, as seen in the dashed square in FIG. 5, showing the annular-shaped attachment disc of the one support foot being partially secured on the top end of one concrete stake by beam clamps on a plurality of arms of a cross-shaped anchor incorporated by the concrete stake, as shown in FIG. 5B.
Figure 5B:
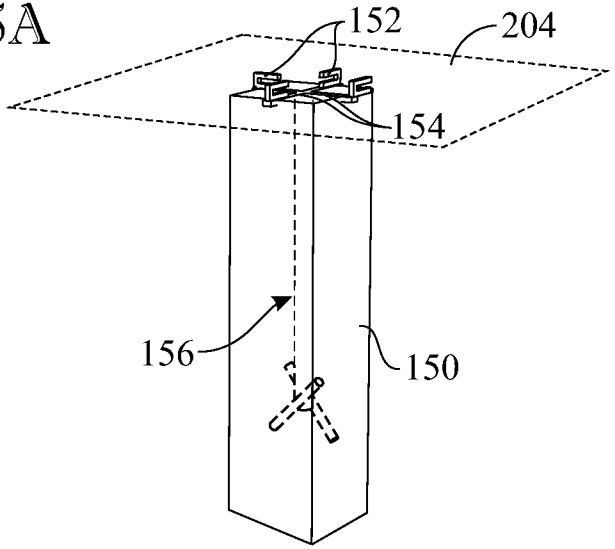
FIG. 5B presents an enlarged isometric view of one of the plurality of concrete stakes to which the annular-shaped attachment disc of one support foot will be secured.
Figure 5:
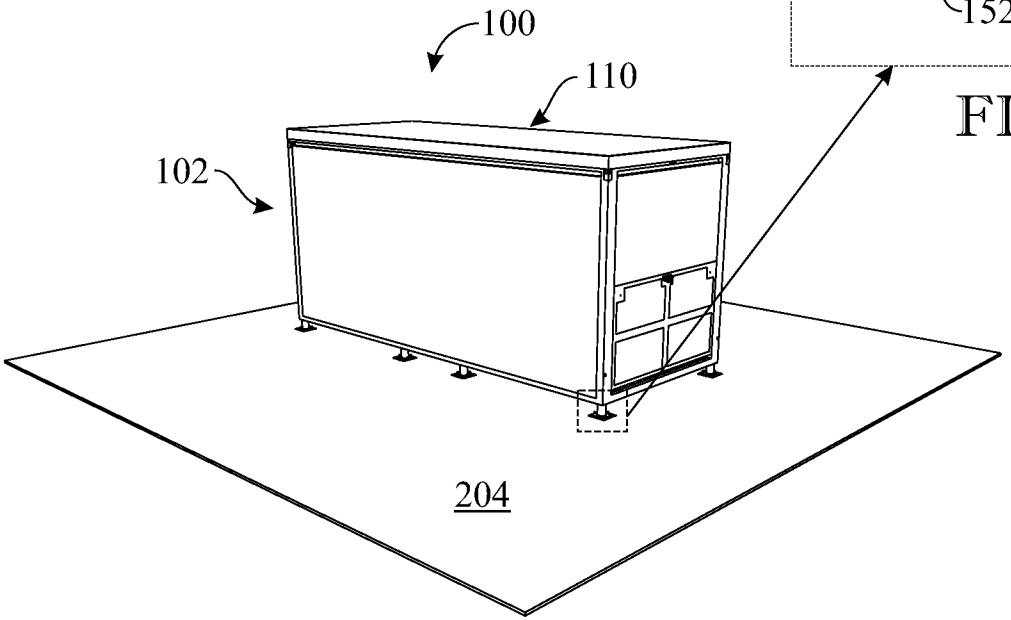
FIG. 5 presents an upper isometric view of the packaged container housing structure supported at a foundation site by the plurality of support feet shown positioned on a corresponding plurality of concrete stakes sunk into the ground below the foundation site, with one concrete stake being shown in FIG. 5B.
Figure 6:
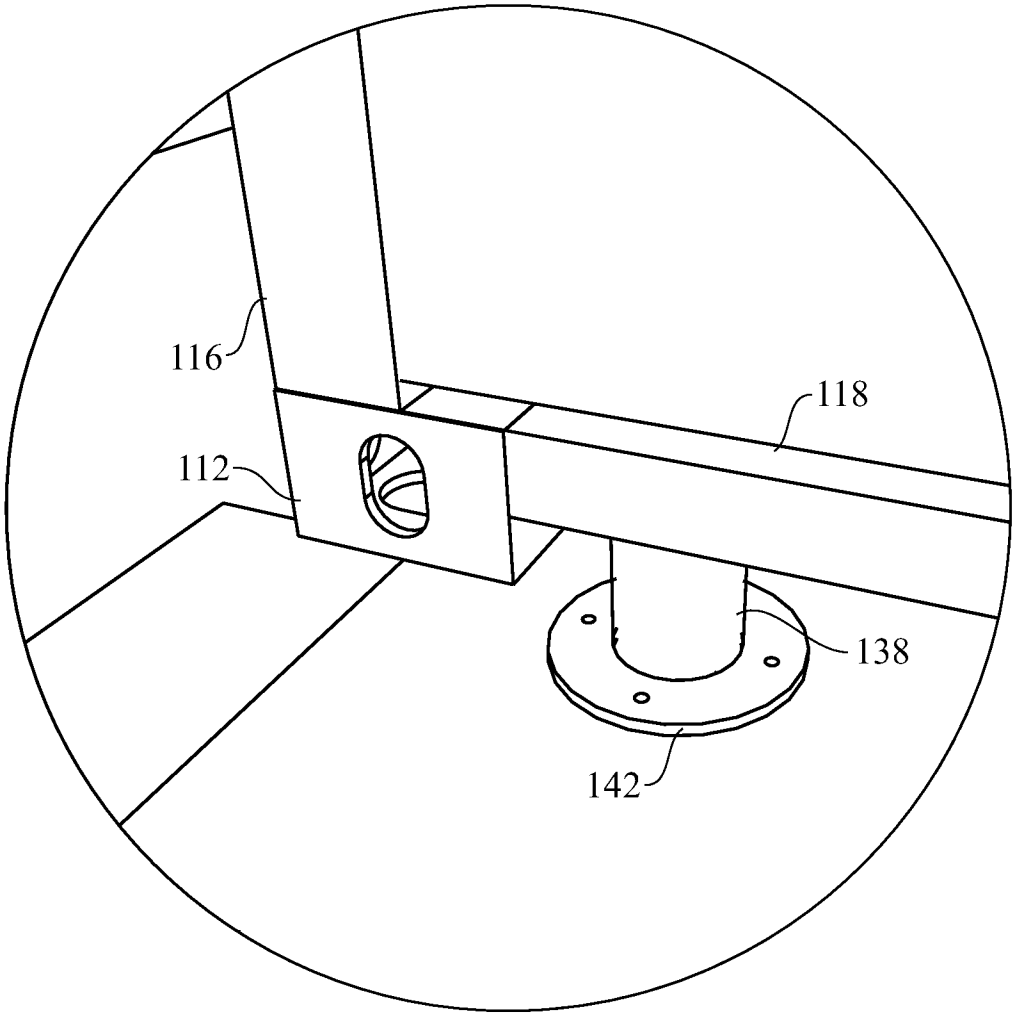
FIG. 6 presents an enlarged fragmentary isometric view of a lower corner of the packaged container housing structure supported on the foundation site by one of the plurality of support feet and will be secured thereto by screws inserted through the array of apertures in the annular-shaped attachment disc of the one support foot and fixed in the foundation site.

As shown in FIG. 6, a lower corner of the packaged container housing structure 100 is supported on the foundation site 204 by one of the support feet 114, which is offset from the corner of the packaged container housing structure. Apertures 148 arrayed in angularly spaced relationship from one another are provided through the annular-shaped attachment disc 142 to enable anchoring the support foot 114 to the foundation site 204. Screws (not shown) may be inserted through the apertures 148 in the attachment disc 142 and fixed in the foundation site 204 to secure the packaged housing structure 100 upon the foundation site. As shown in FIGS. 5 and 5A, an alternative approach may be employed to anchor the plurality of support feet 114, which are applied under the packaged container housing structure 100, to the foundation site 204. In the alternative approach, multiple concrete stakes 150, which correspond in number to the multiple support feet 114 supporting the packaged housing structure 100, are sunk into the ground below the foundation site 204. An example of the concrete stake 150 is partially shown in FIG. 5A and fully shown in FIG. 5B. The annular-shaped attachment disc 142 of each support foot 114 is secured on the top end of each concrete stake 150 by beam clamps 152 on a plurality of arms 154 of a cross-shaped anchor 156 incorporated by the concrete stake. The anchor 156 may be fabricated from any suitable material, for example a metal such as steel.

As shown in FIGS. 1-4, 7-31, 2A, 7A and 22A-23A, the top roof 110 of the packaged container housing structure 100 is movably mounted on the container box frame 102 and movable toward and away from the open top 124 thereof between lower and upper displaced positions relative to the container box frame to correspondingly close and open access of air flow between the top roof and the open top of the container box frame into the interior space thereof. By way of example but not limitation, the top roof 110 may include a top cover 158 and a plurality of elongated legs 160. The top cover 158, being flat or planar in configuration, is disposed above and aligned with the interconnected side and end edge members 118, 120 forming the open top 124 of the container box frame 102. The top cover 158 has a pair of elongated side members 162 and a pair of elongated end members 164 extending between and rigidly interconnecting the side members at their opposite ends, and a flat sheet or panel 166, for example made of a selected opaque or translucent material, such as a suitable plastic, affixed about its periphery to the side and end members. The interconnected side and end members 162, 164 form right and left, front and rear, corners 168 that are aligned with upper ends 170 of right and left, front and rear, corner members 116 of the container box frame 102. The legs 160 may be affixed to and protrude downward from the corners 168 of the top cover 158, and may be slidable within and relative to passages 172 formed within the upper ends 170 of the corner members 116 of the container box frame 102 so as to enable the top roof 110 to be operable between a closed state and an open state. When the top roof 110 is in an open state a gap is formed the top cover 158 and the open top 124 of the container box frame 102 to create a pathway for air to flow throughout the interior space 122 of the container box frame. The coupling fittings 112 are each integrated into one of the corners 168 of the top cover 158 to enable lifting the packaged container housing structure when the top roof 110 is in a closed state and fastened to the container box frame 102 in a compact condition, as shown in FIGS. 1-4 and 2A.

Also, as shown in FIGS. 22-24 and 22A-23A, a plurality of top windows 174 are pivotally mounted along, and depend downwardly from, the opposite side members 162 of the top cover 158 of the top roof 110. The top windows are pivotally deployable toward and away from opposite side openings 176, created between the side members 162 of the raised top cover 158 and the upper side edge members 118 of the container box frame 102, in order to regulate air flow into and from the side openings 176 into the interior space 122 in the container box frame. The elongated legs 160 and the side and end members 162, 164 of the top cover 158 may, by way of example but not limitation, take the form of elongated rigid metal tubes.

Figures 7, 7A:
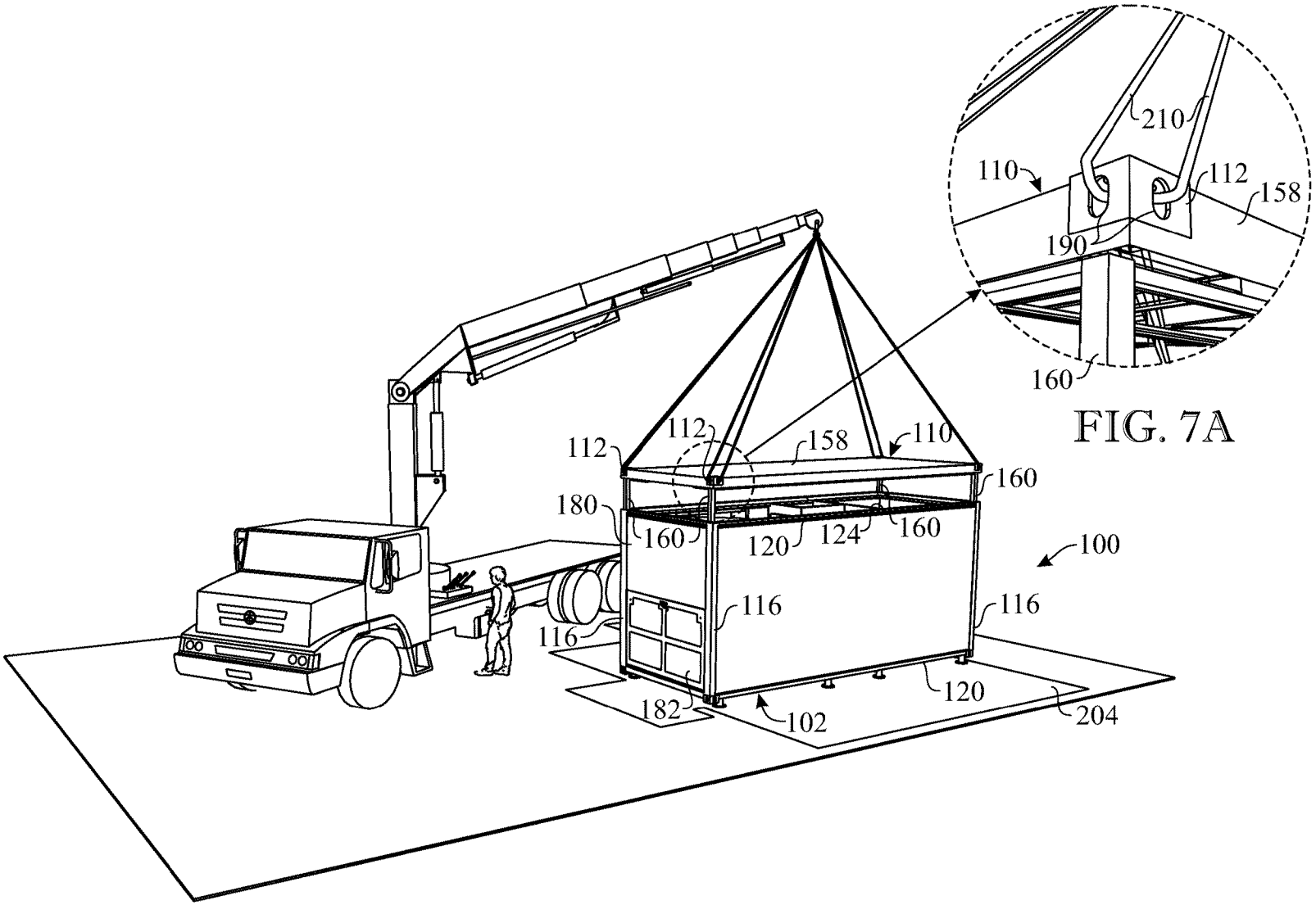
FIGS. 7 and 7A present isometric views of the packaged container housing structure in which a top roof of the packaged container housing structure is being lifted upwardly by a crane via lift cable lines extending from hollow coupling fittings incorporated at corners of the top roof on a container box frame.
Figures 8, 8A:
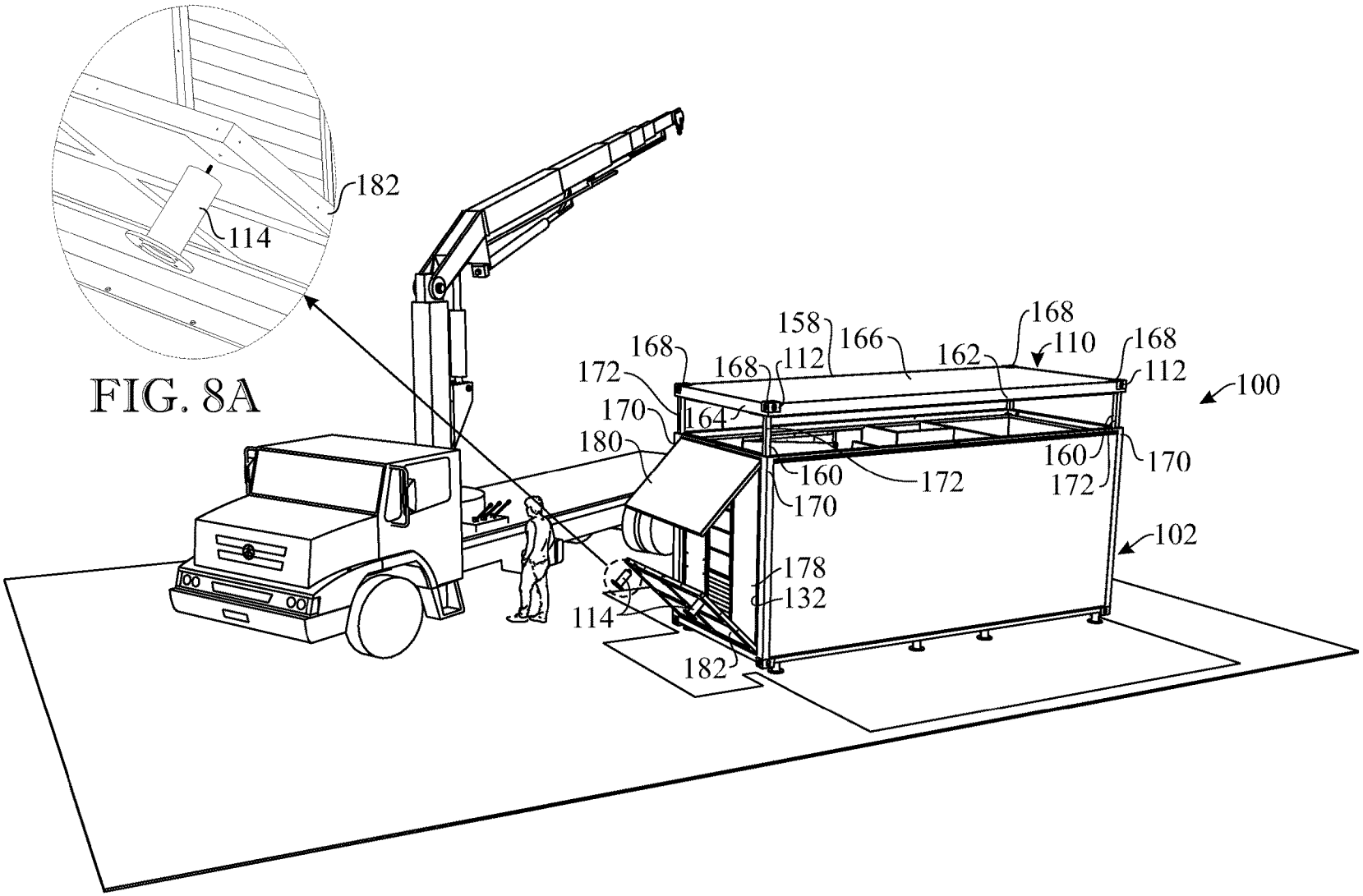
FIGS. 8 and 8A present isometric views of the packaged container housing structure in which a service entry is being erected on one end of the packaged container housing structure by deploying an upper for providing an exterior roof for the service entry and deploying a lower panel and attaching support feet to a bottom of the lower panel for providing an exterior floor for the service entry.

As shown in FIGS. 7-25 and 8A, the packaged container housing structure 100 may also include a service entry 178 on the front open end 132 of the container box frame 102 and a pair of upper and lower lids or panels 180, 182 of the plurality of panels being mounted to the container box frame across the service entry. More particularly, the upper and lower panels 180, 182 are pivotally mounted respectively to the upper and lower end edge members 120 at the front open end 132 of the container box frame 102, which is respectively at corresponding one ends of the open top 124 and closed bottom 126 of the container box frame. The upper panel 180 is pivotally deployable relative to the container box frame 102 to provide an exterior roof for the service entry 178 adjacent to the front open end 132 and open top 124 of the container box frame. The lower panel 182 is pivotally deployable relative to the container box frame 102 to provide an exterior floor for the service entry 178 adjacent to the front open end 132 and closed bottom 126 of the container box frame. Also, as best shown in FIGS. 8 and 8A, selected others of the support feet 114 are attachable to the bottom of the lower panel 182, at opposite corners of a front edge portion thereof. The support feet 114 are adjustable in length independent of one another, as described hereinabove, so as to position the lower panel in a level orientation upon the mounting site 204.

Figure 9:
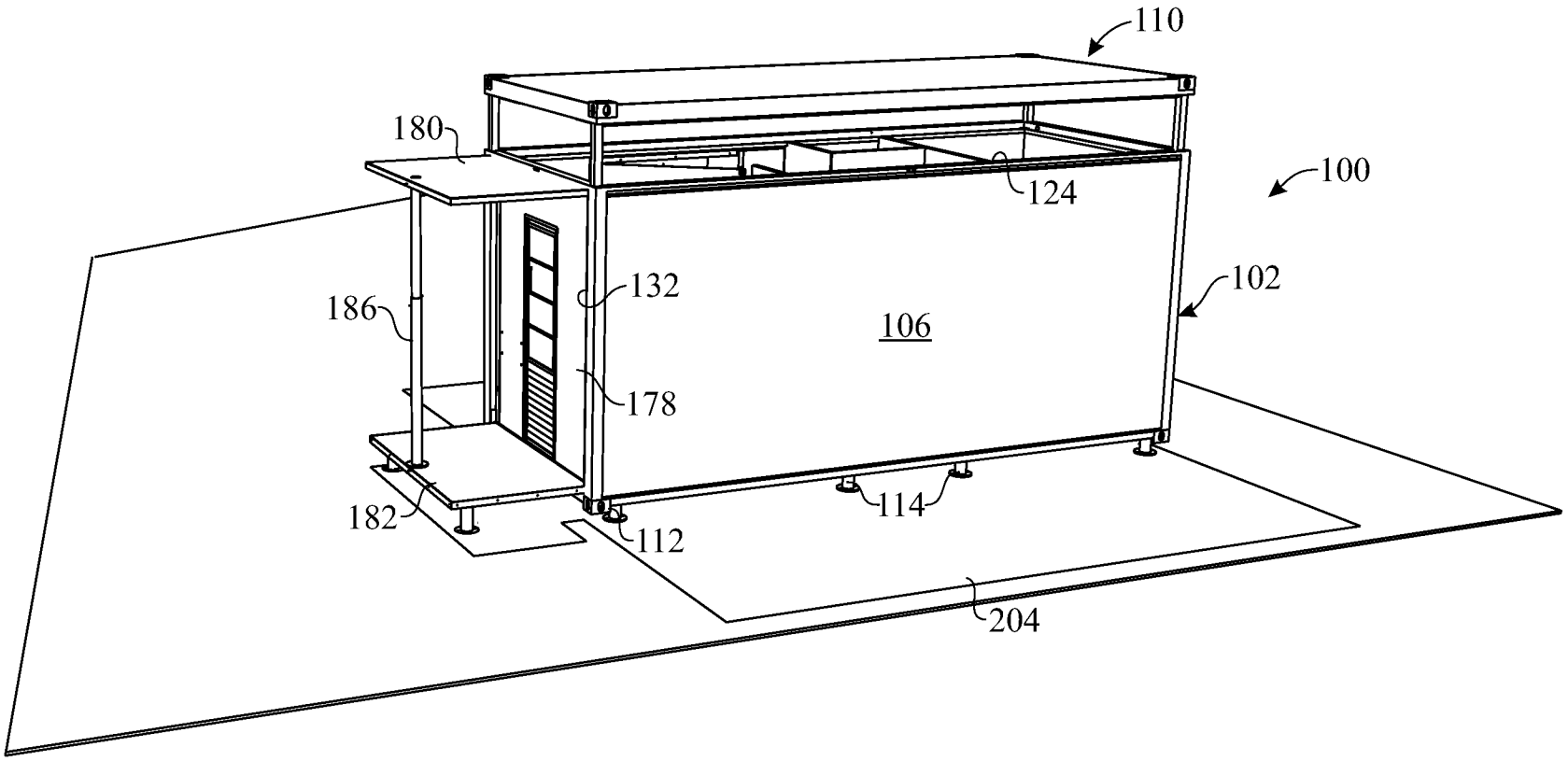
FIG. 9 presents an isometric view of the packaged container housing structure with the service entry shown at an intermediate stage of its erection in which a telescopic tubular scaffolding support is temporarily deployed between the upper and lower panels.
Figure 10:
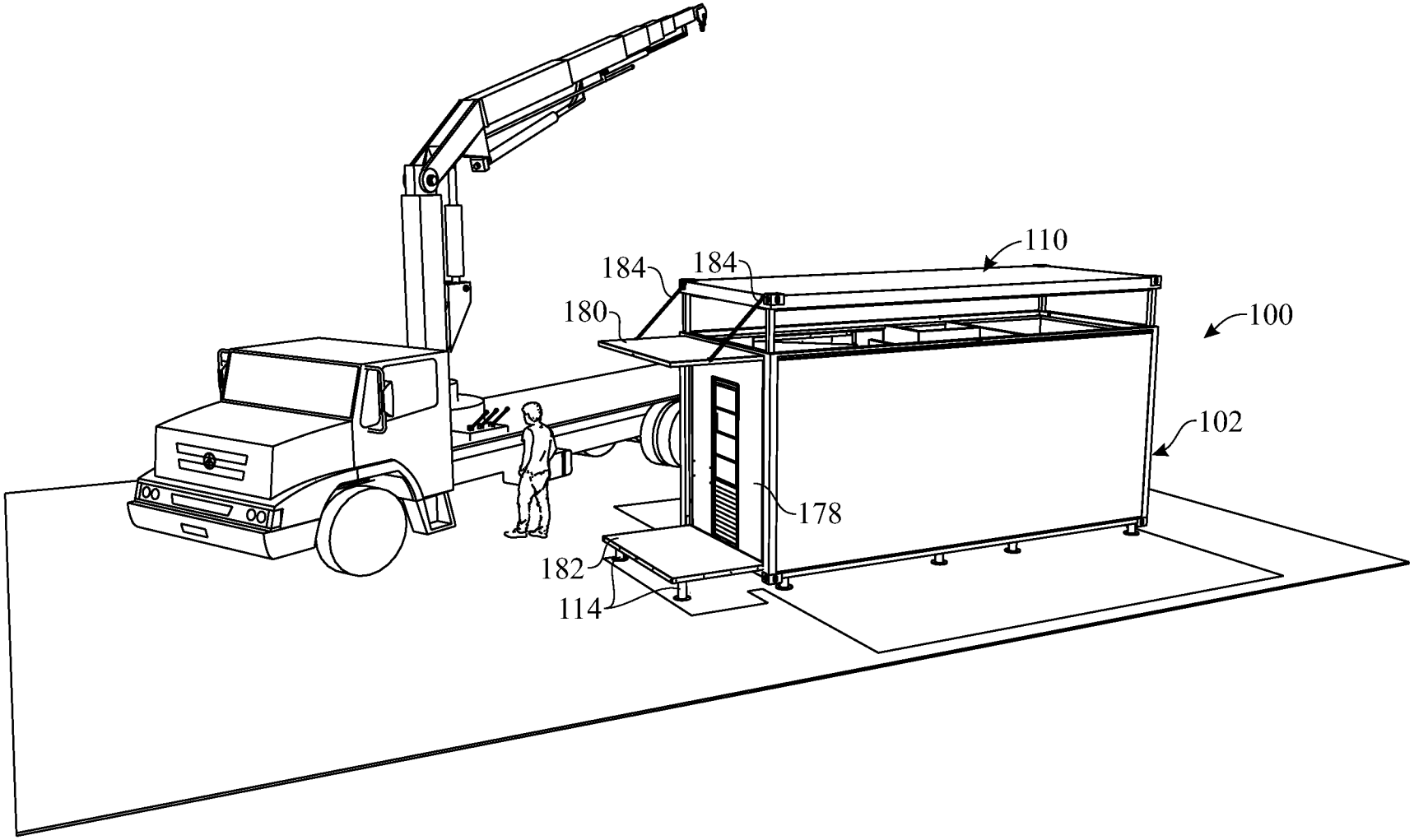
FIG. 10 presents an isometric view of the packaged container housing structure in which its top roof and the exterior roof and floor for its service entry are in their installed positions.
Figures 11, 11A:
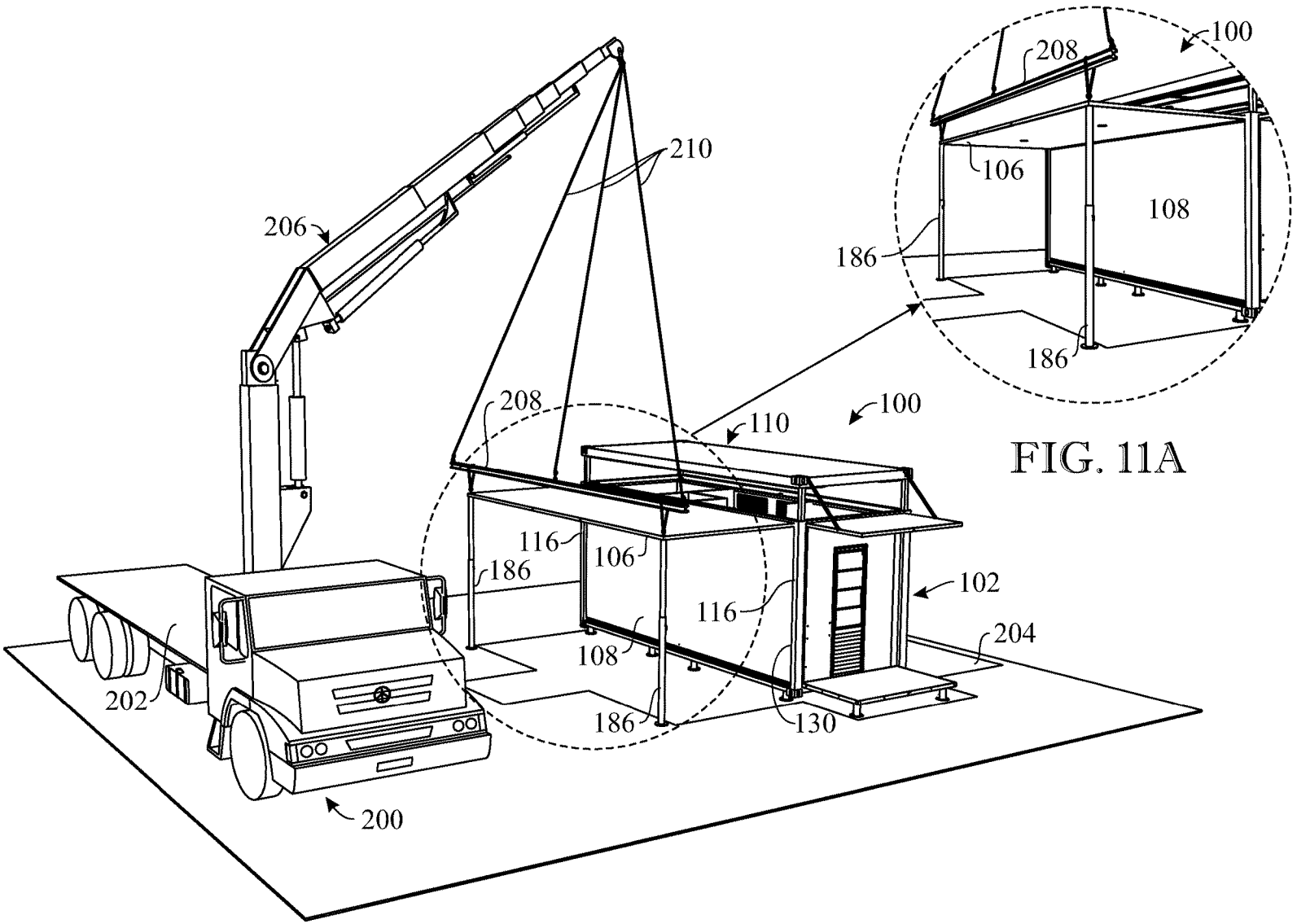
FIGS. 11-18, 11A-14A and 18A present in a sequence of isometric views the crane assisting in deployment of some ceiling (or roof), wall and floor panels from the container box frame of the packaged container housing structure and erection of one or more rooms on the left side of the container box frame.
Figures 12, 12A:
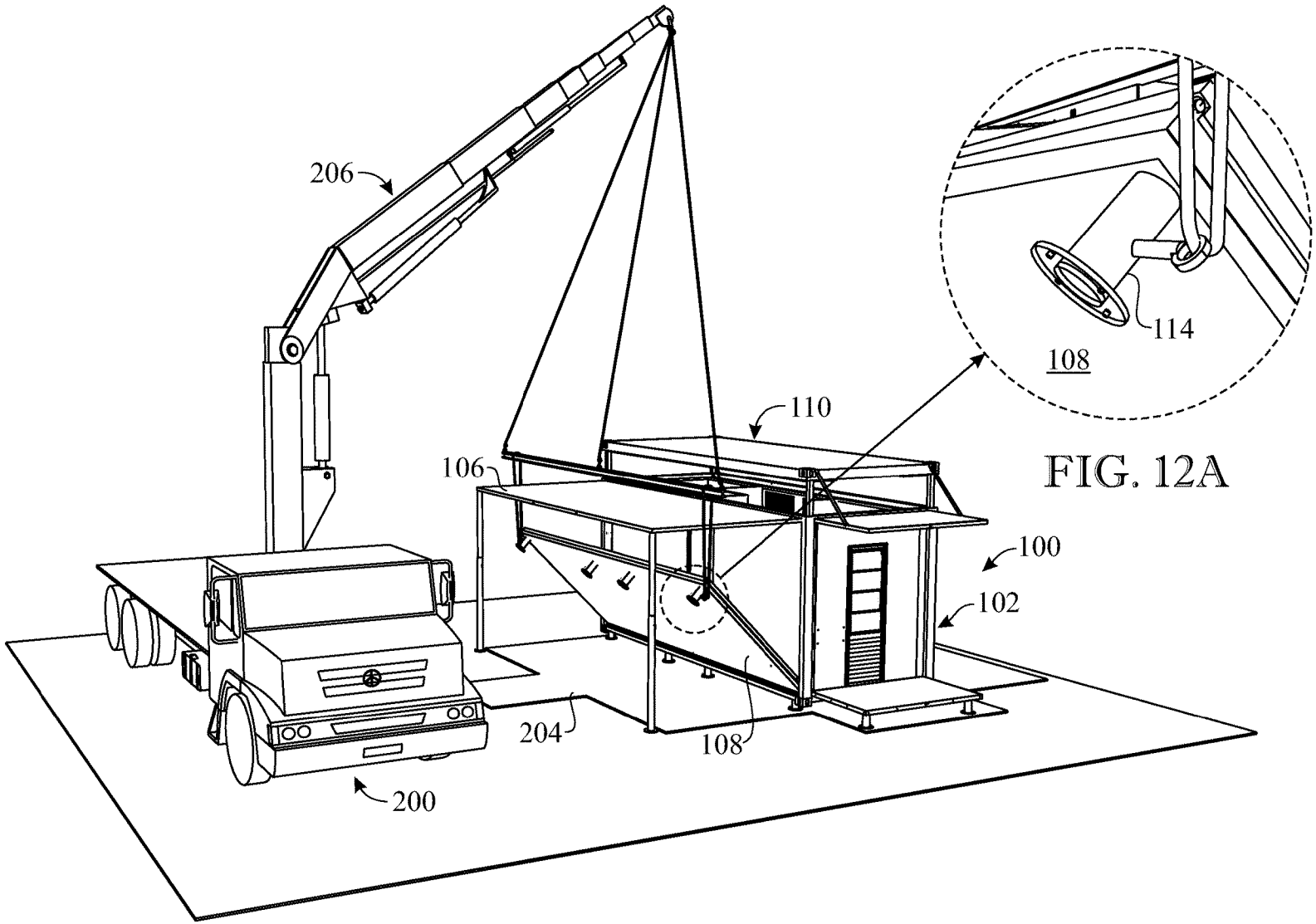
Figures 13, 13A:
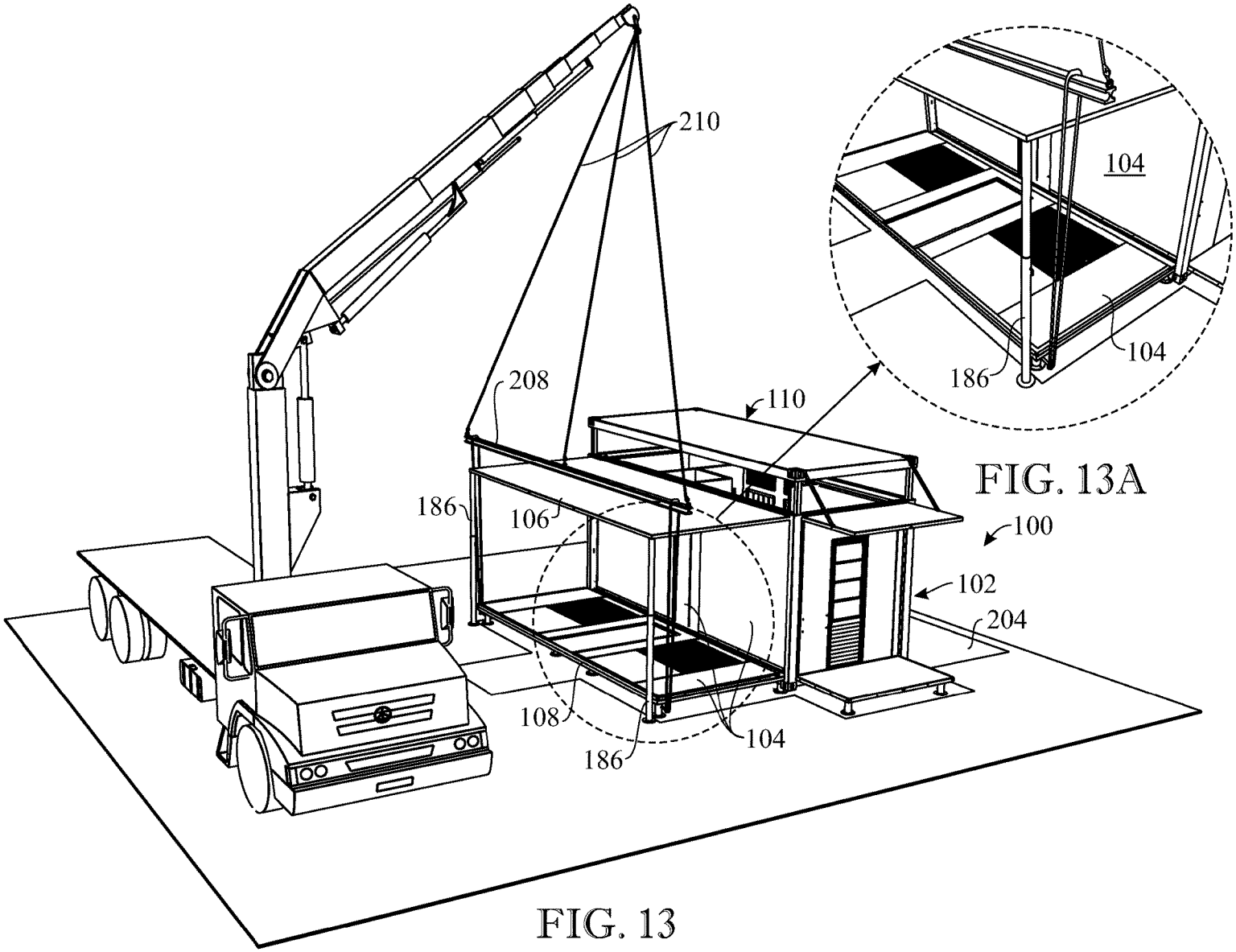
Figures 14, 14A:
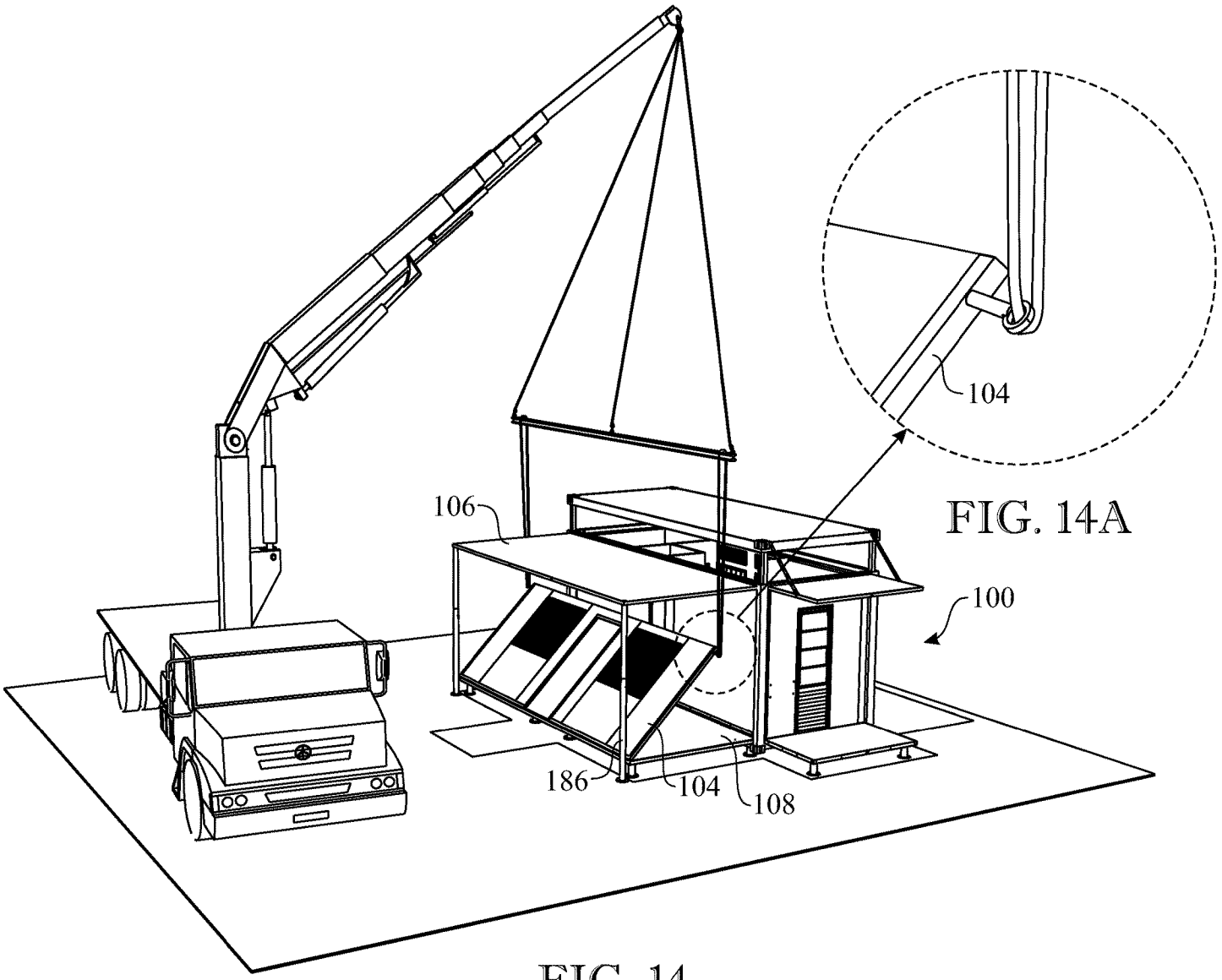
Figure 15:
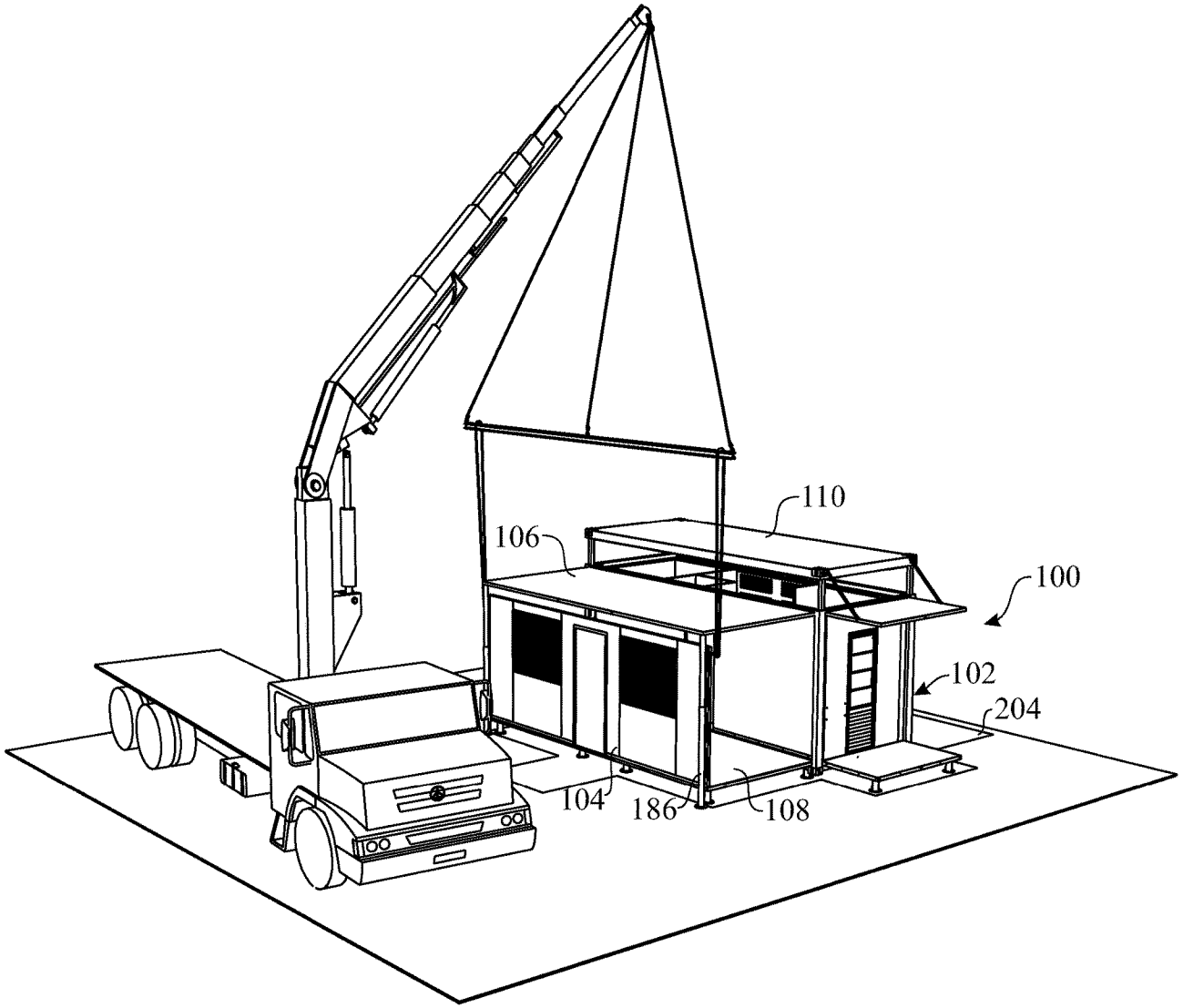
Figure 16:
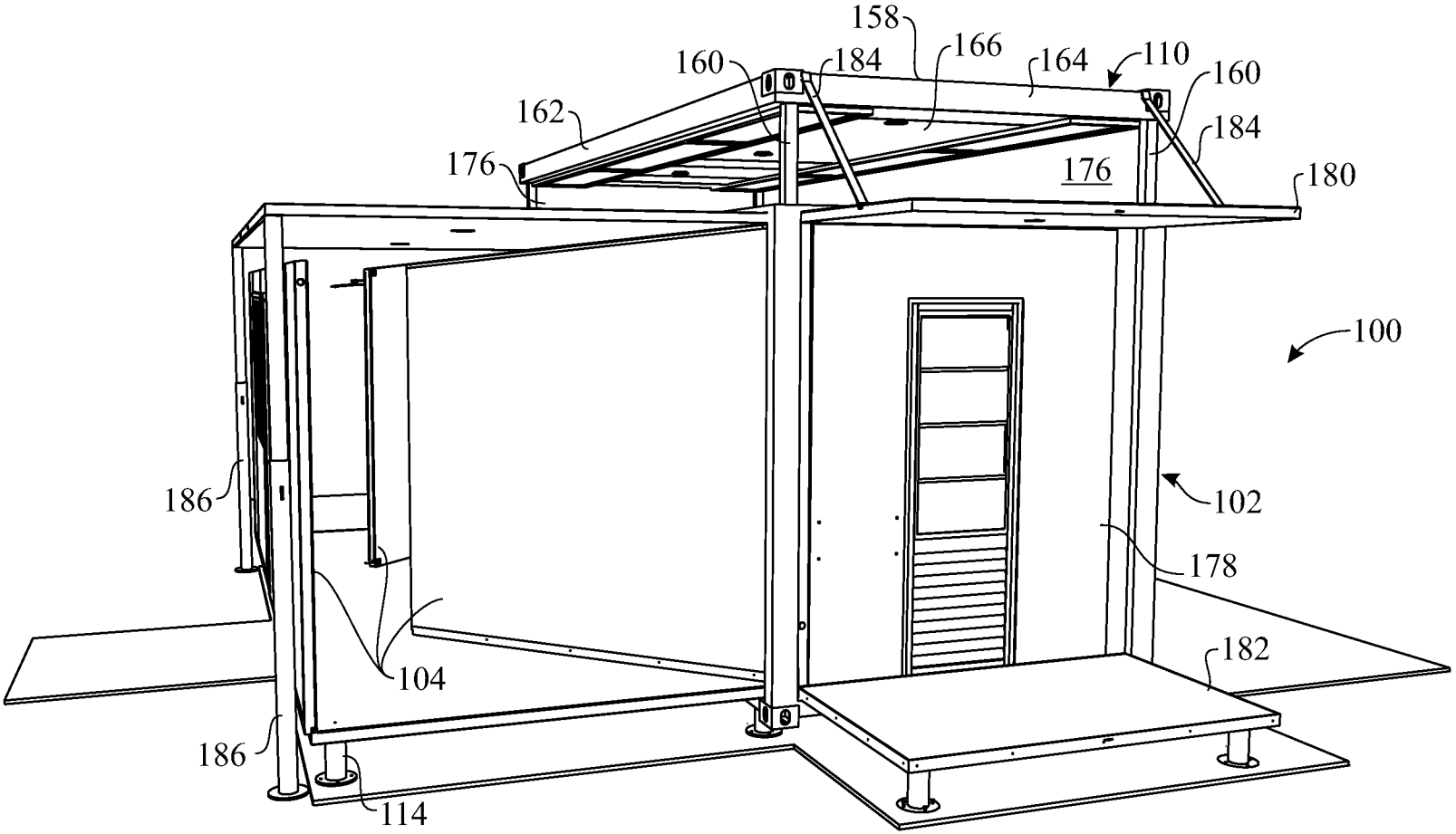
Figure 17:
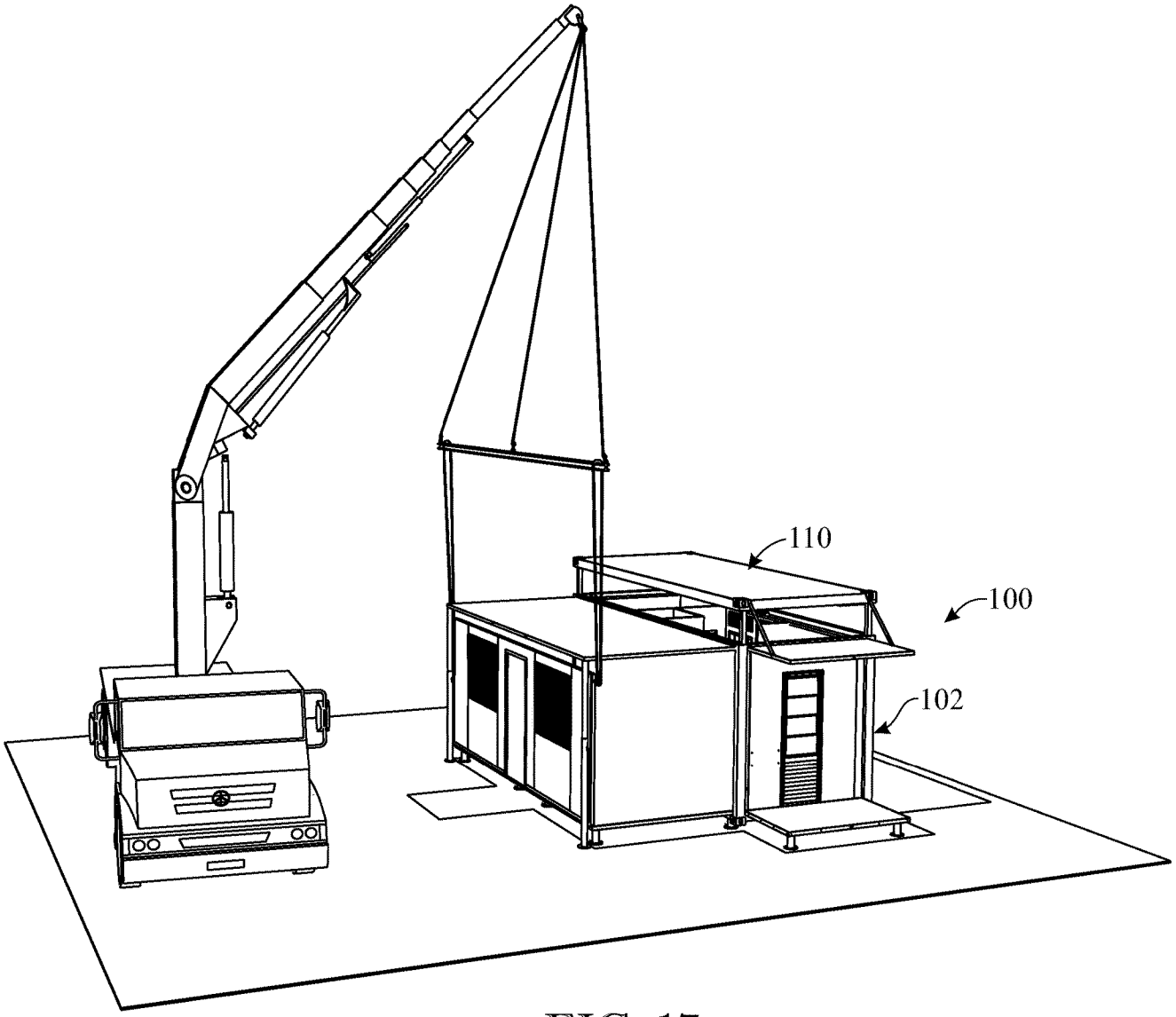
Figures 18, 18A:
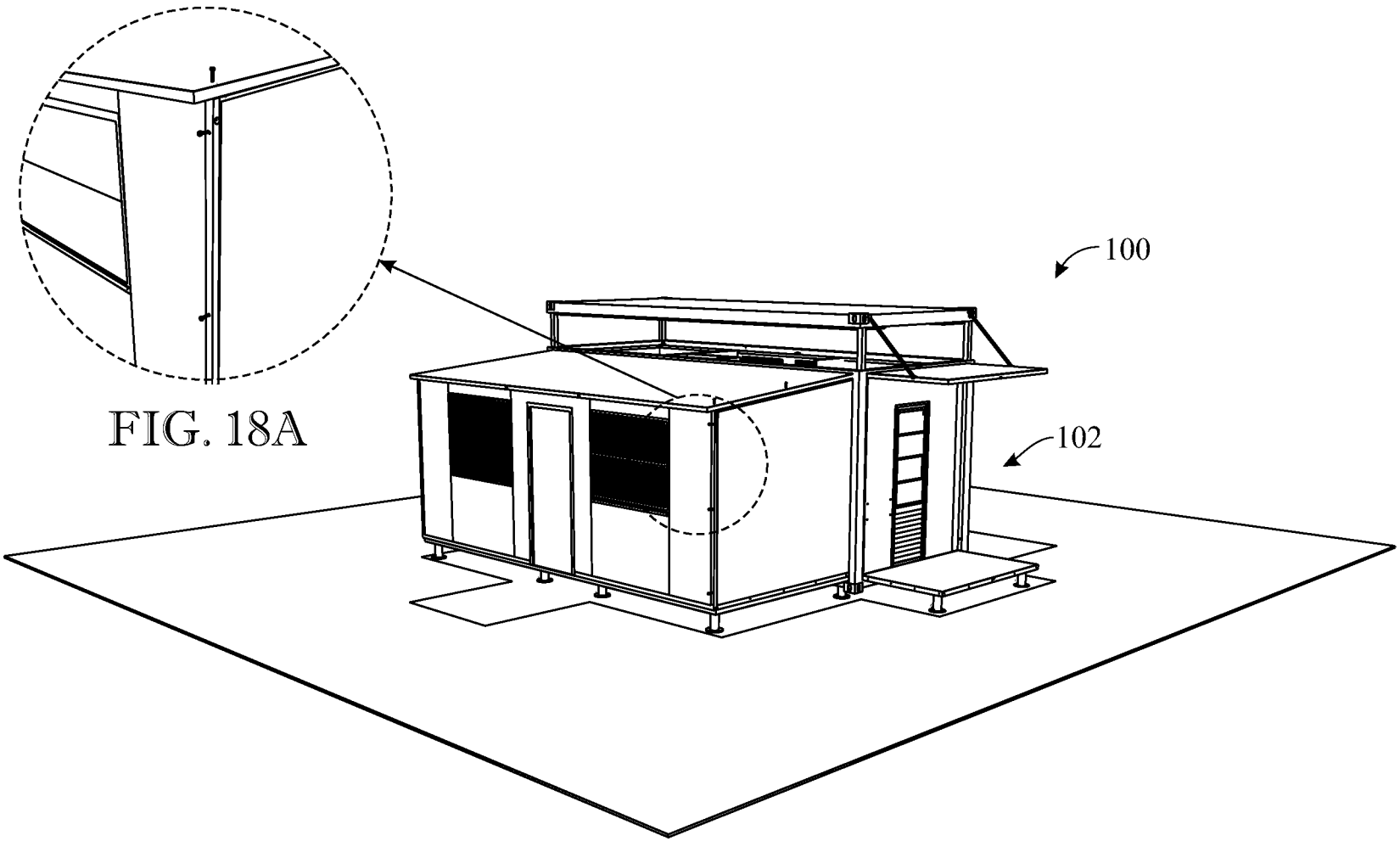

Further, as shown in FIGS. 10-31 and 22A-23A, a pair of braces 184 disposed in the interior space 122 in the container box frame 102 may be retrieved, deployed and placed at the same angles between and attached to intermediate locations along opposite side edges of the upper panel 180 and the front end member 164 of the top cover 158 of the top roof 110 so as to support the upper panel in a desired plane so as to provide the exterior roof for the service entry 178 to the container box frame. As shown in FIG. 9, once the support feet 114 are installed onto the bottom of the lower panel 182, a telescopic tubular scaffolding support 186 may be temporarily deployed between the upper and lower panels 180, 182, adjacent the respective front edges thereof, to support the upper panel in a horizontal orientation until installation of the pair of braces 184 is completed; then the telescopic tubular scaffolding support 186 is removed.

Figure 31:
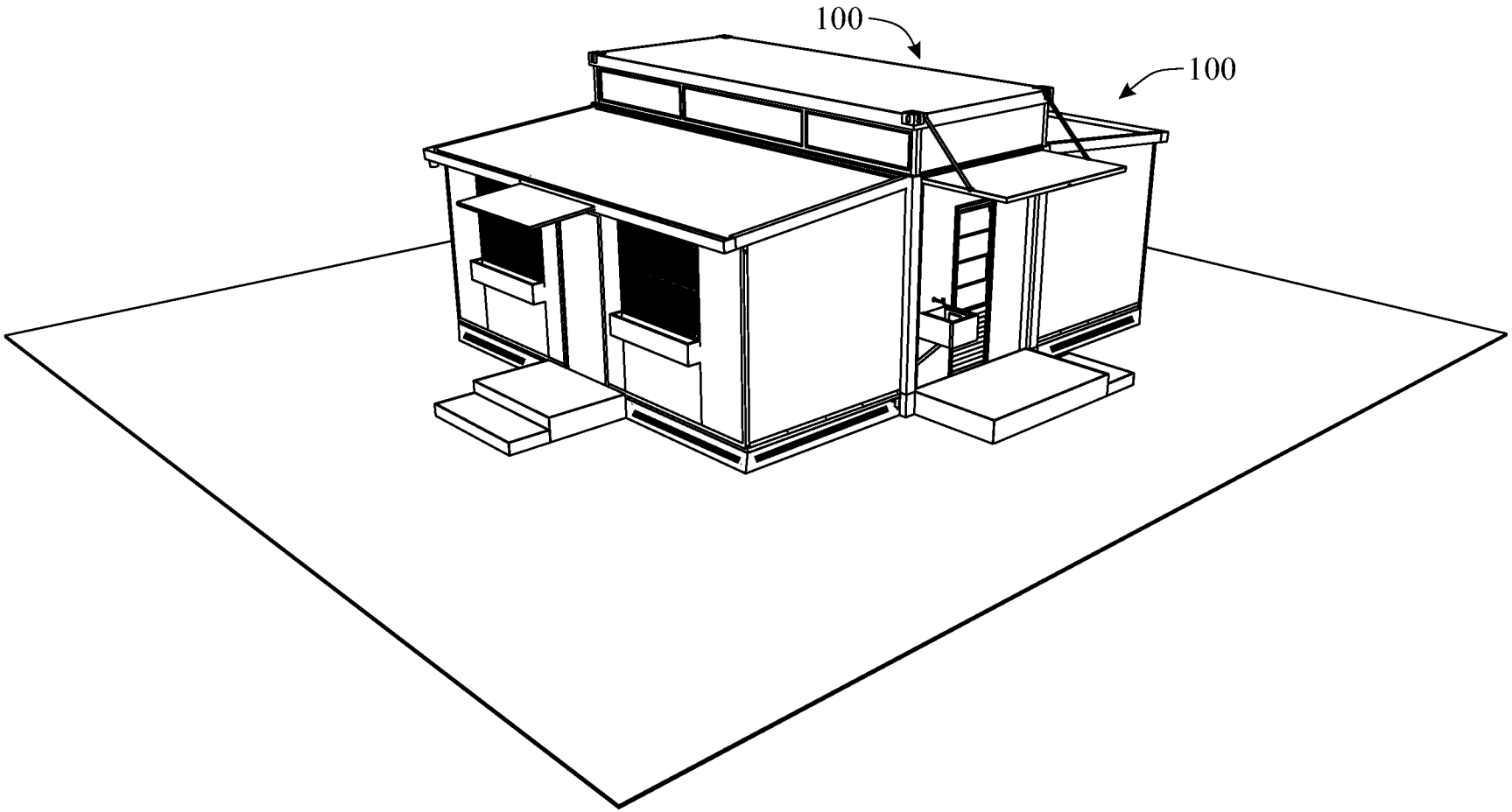
Figure 32:
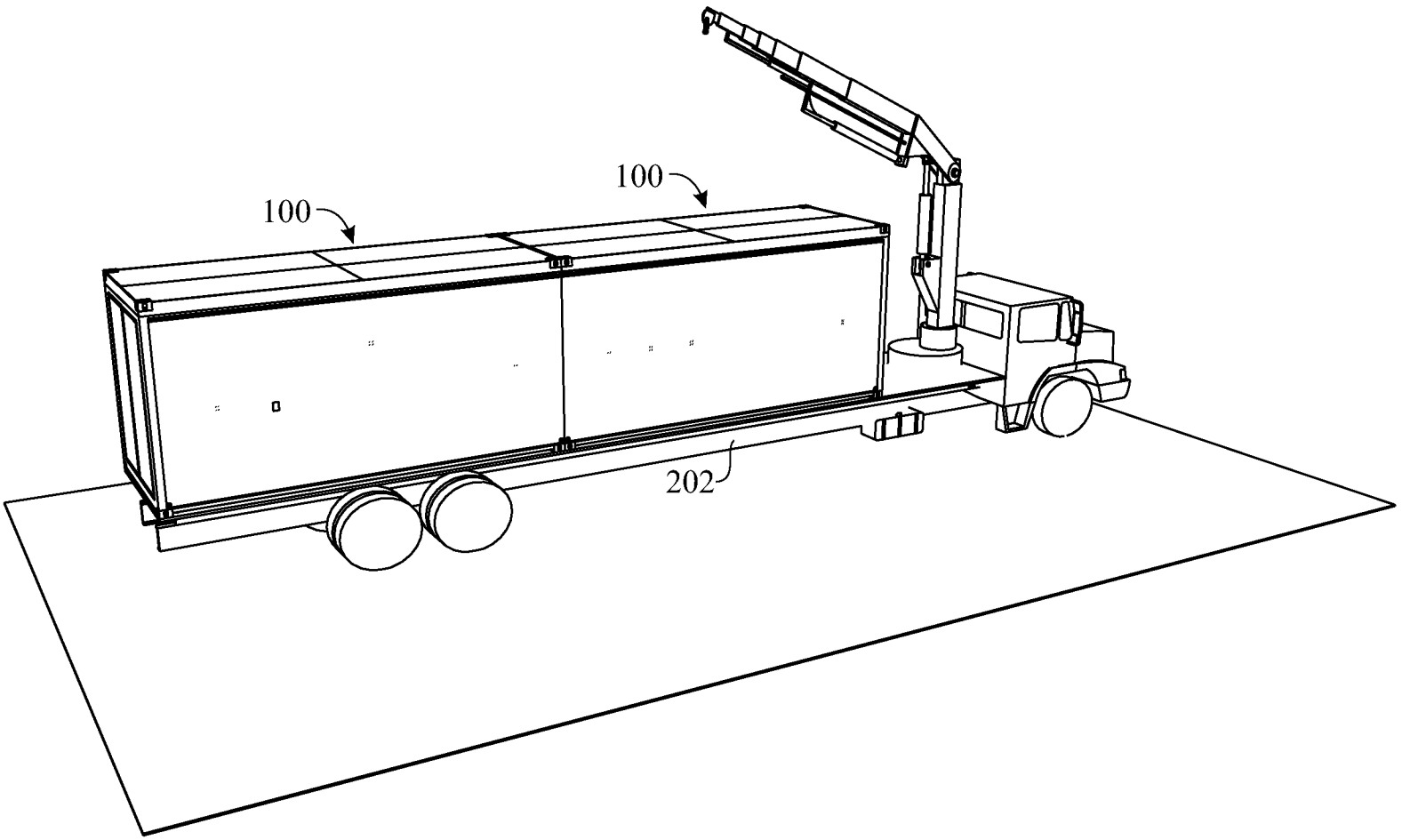
FIGS. 32-35 present in a sequence of isometric views the crane assisting in unloading, transporting and setting up a pair of packaged container housing structures in a manner comparable to deployment and erection of the packaged container housing structure in the single unit format as shown in FIGS. 1-6 and in addition showing the pair of packaged container housing structures being placed end-to-end to form a double unit format.
Figure 33:
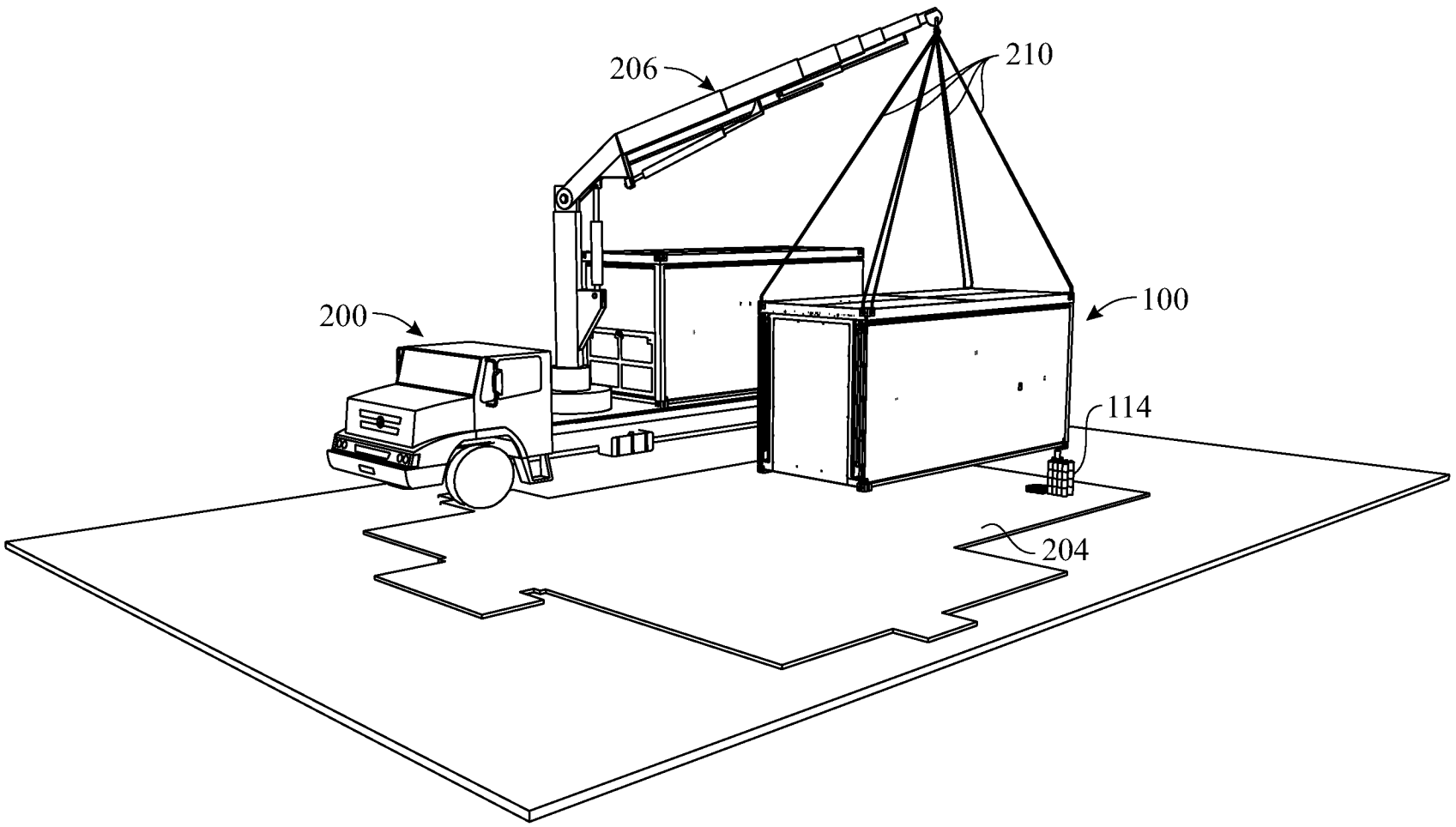
Figure 34:
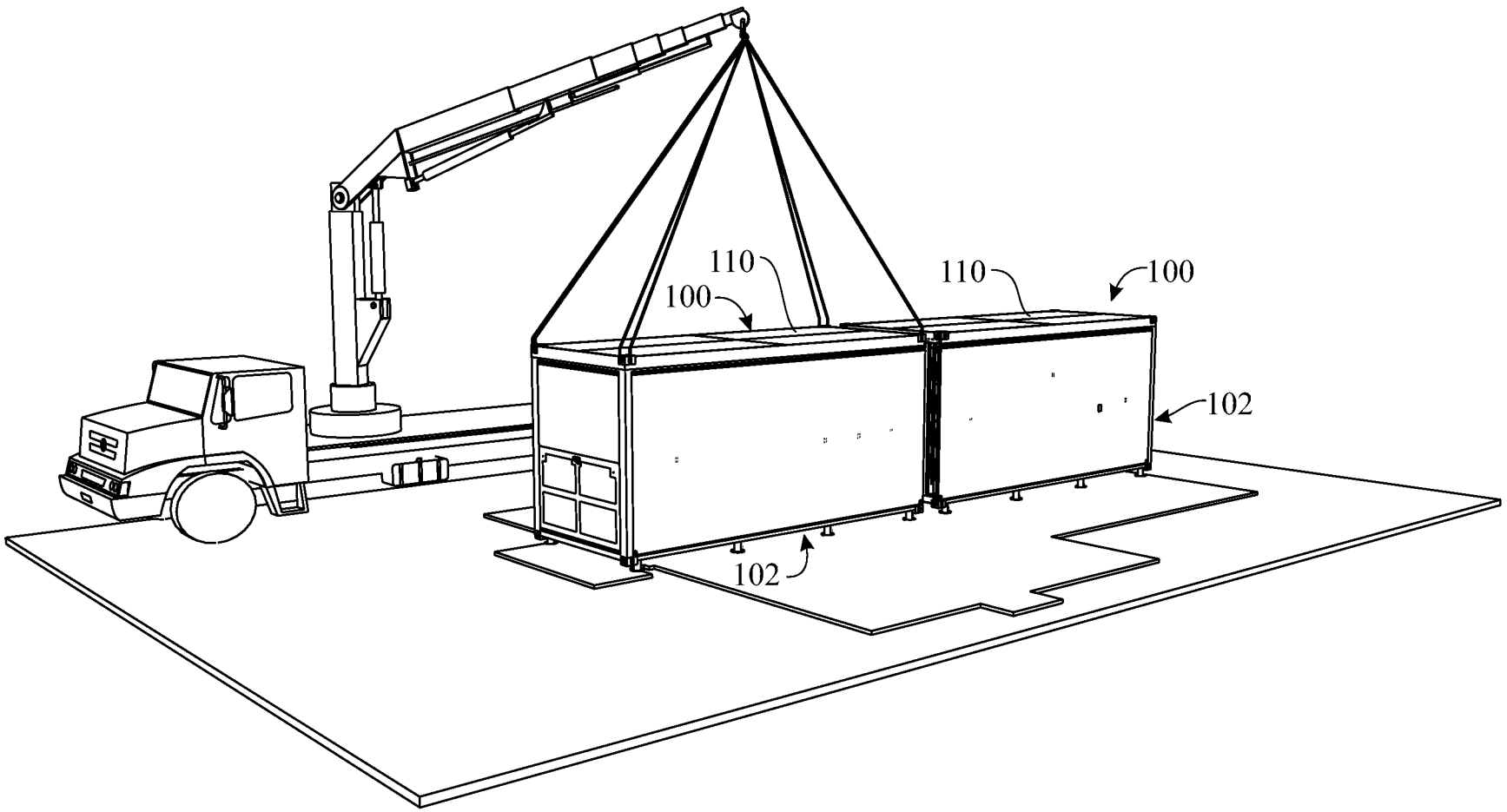
Figure 35:
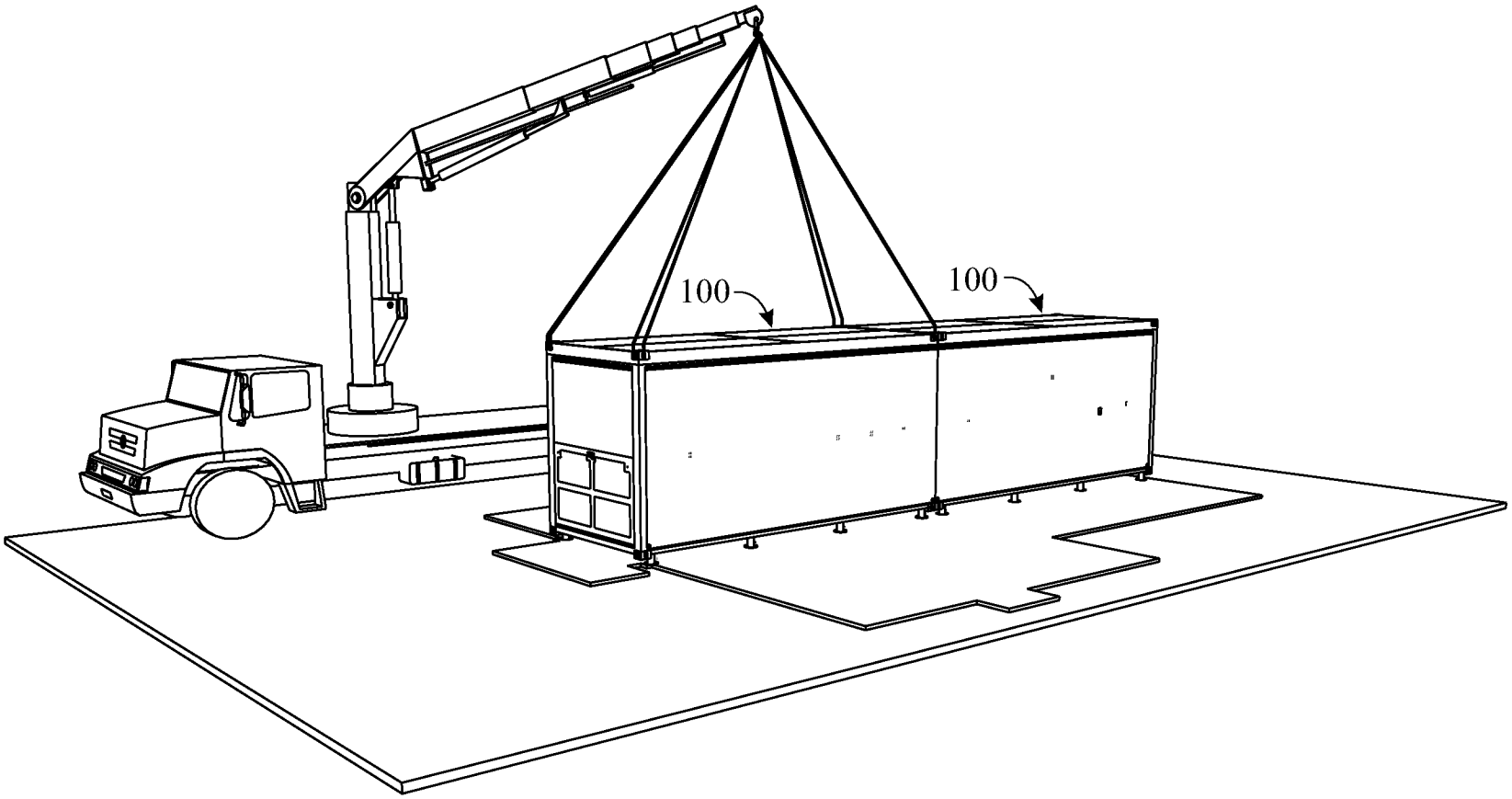
Figures 36, 36A, 36B, 36C, 36D, 36E, 36F, 36G:
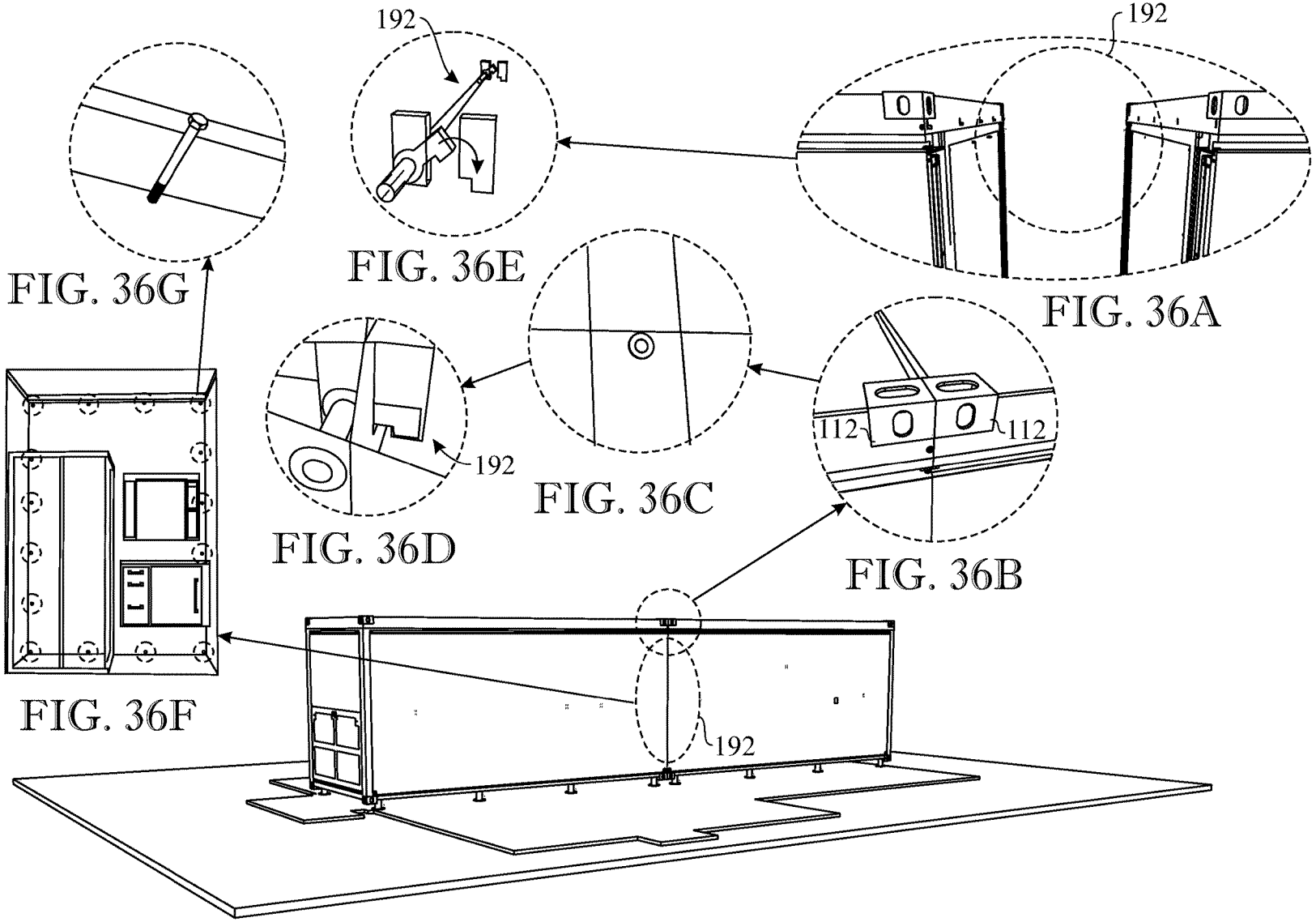
FIGS. 36 and 36A-36G present isometric views of the pair of container box frames and their complementary interengageable latches mounted at adjacent ones of the opposite ends of the container box frames that are fastenable together upon the container box frames being placed end-to-end in the double unit format.
Figures 37, 37A, 37B:
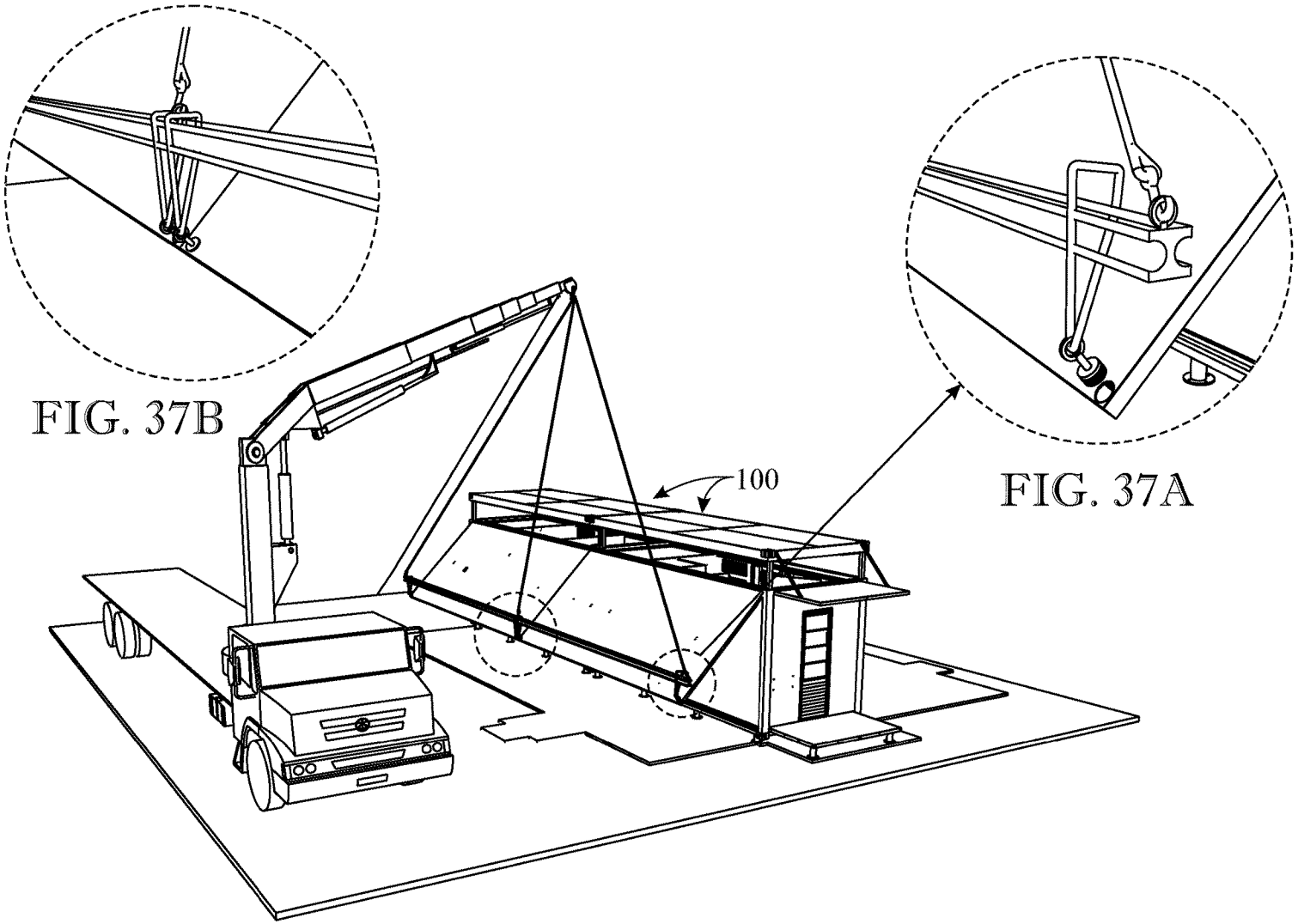
Figures 38, 38A, 38B:
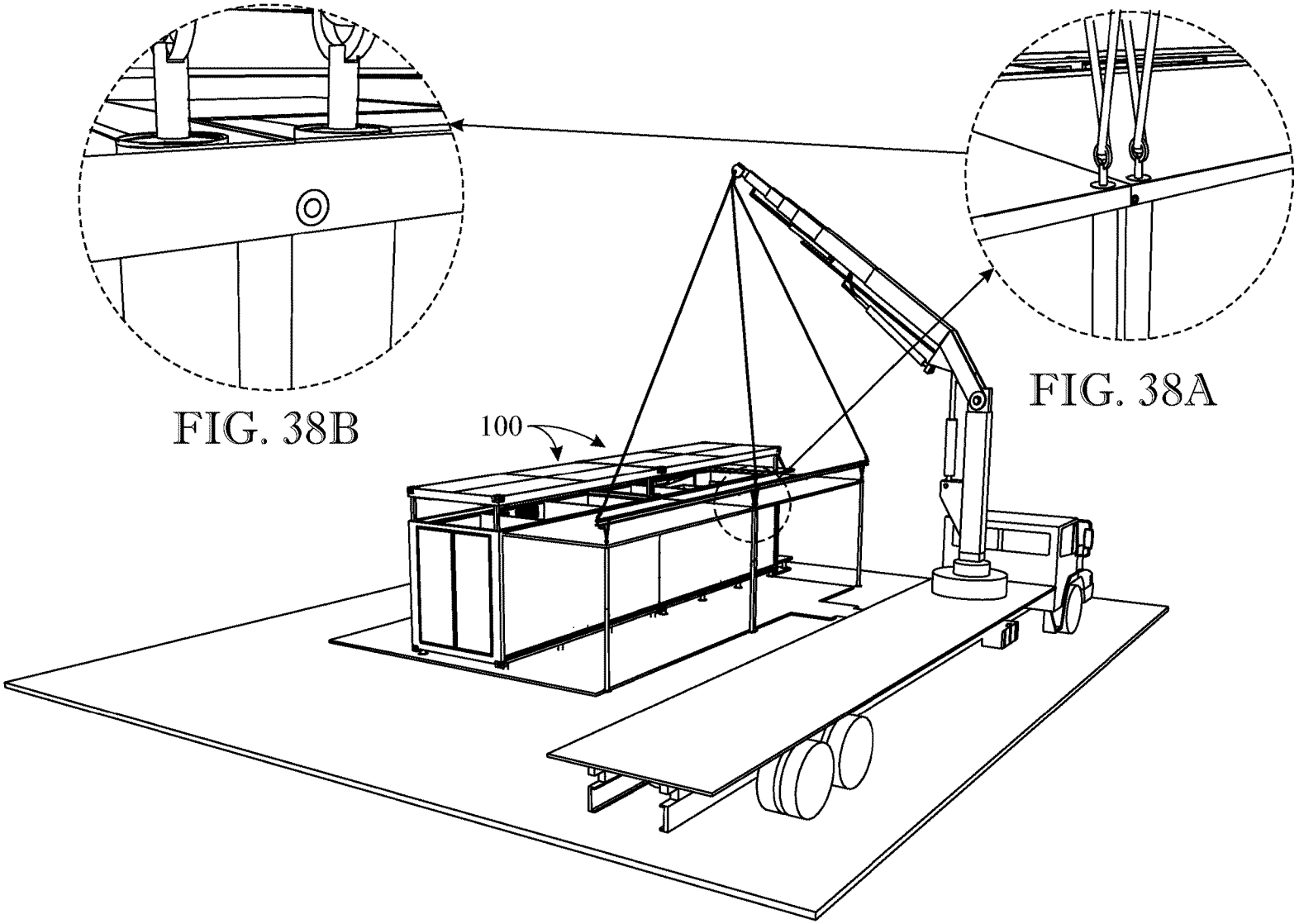
Figure 39:
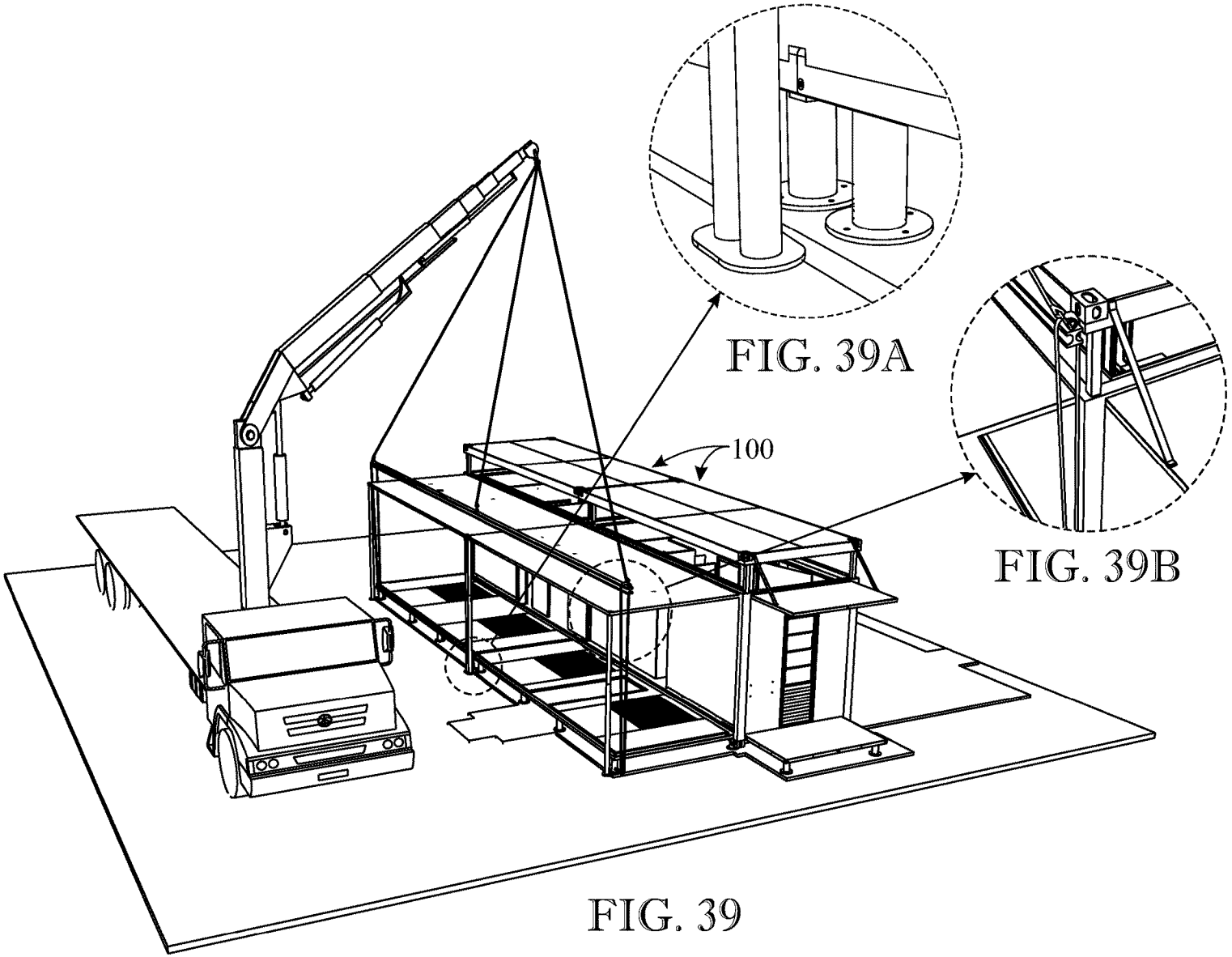
Figures 40, 40A:
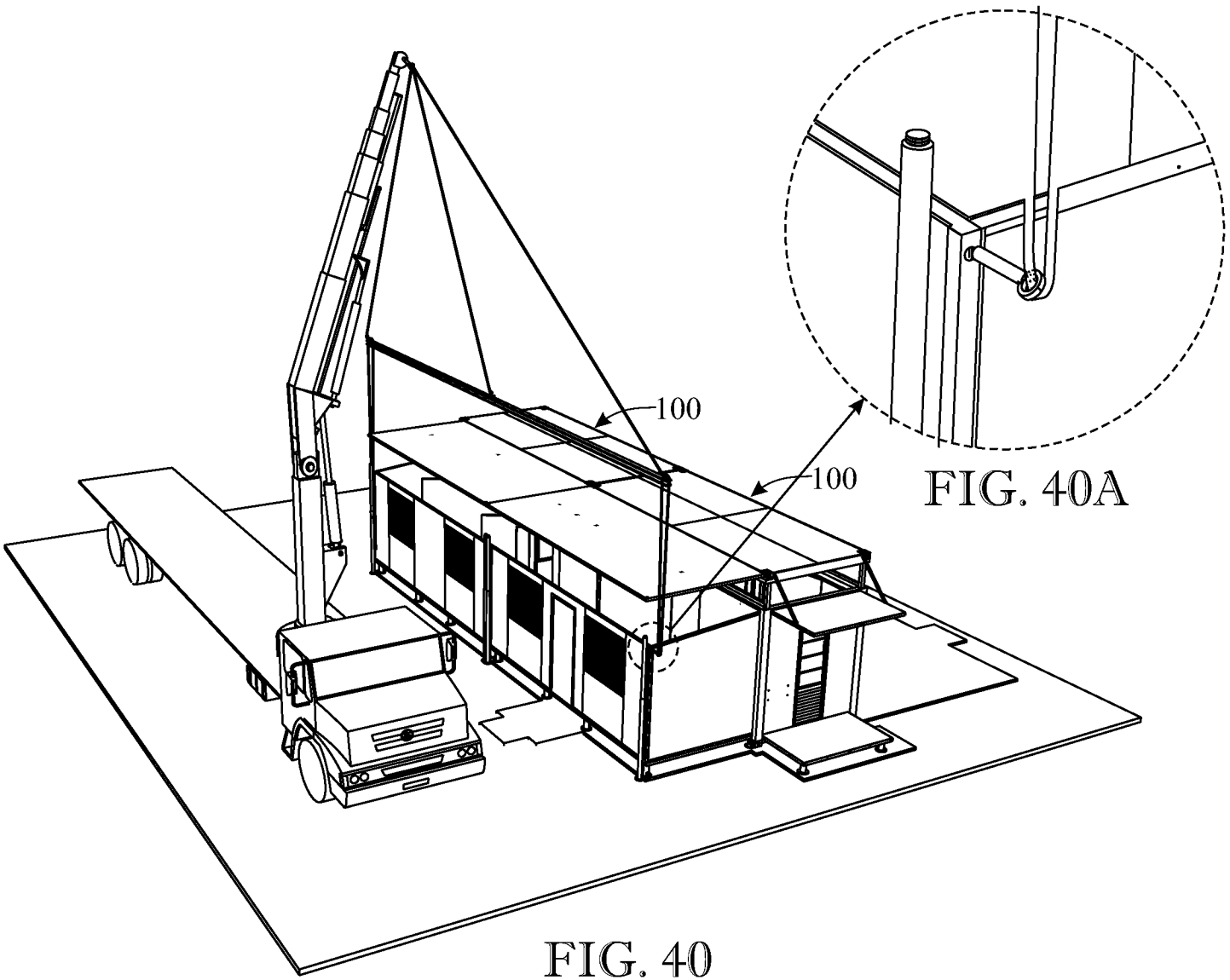
Figure 41:
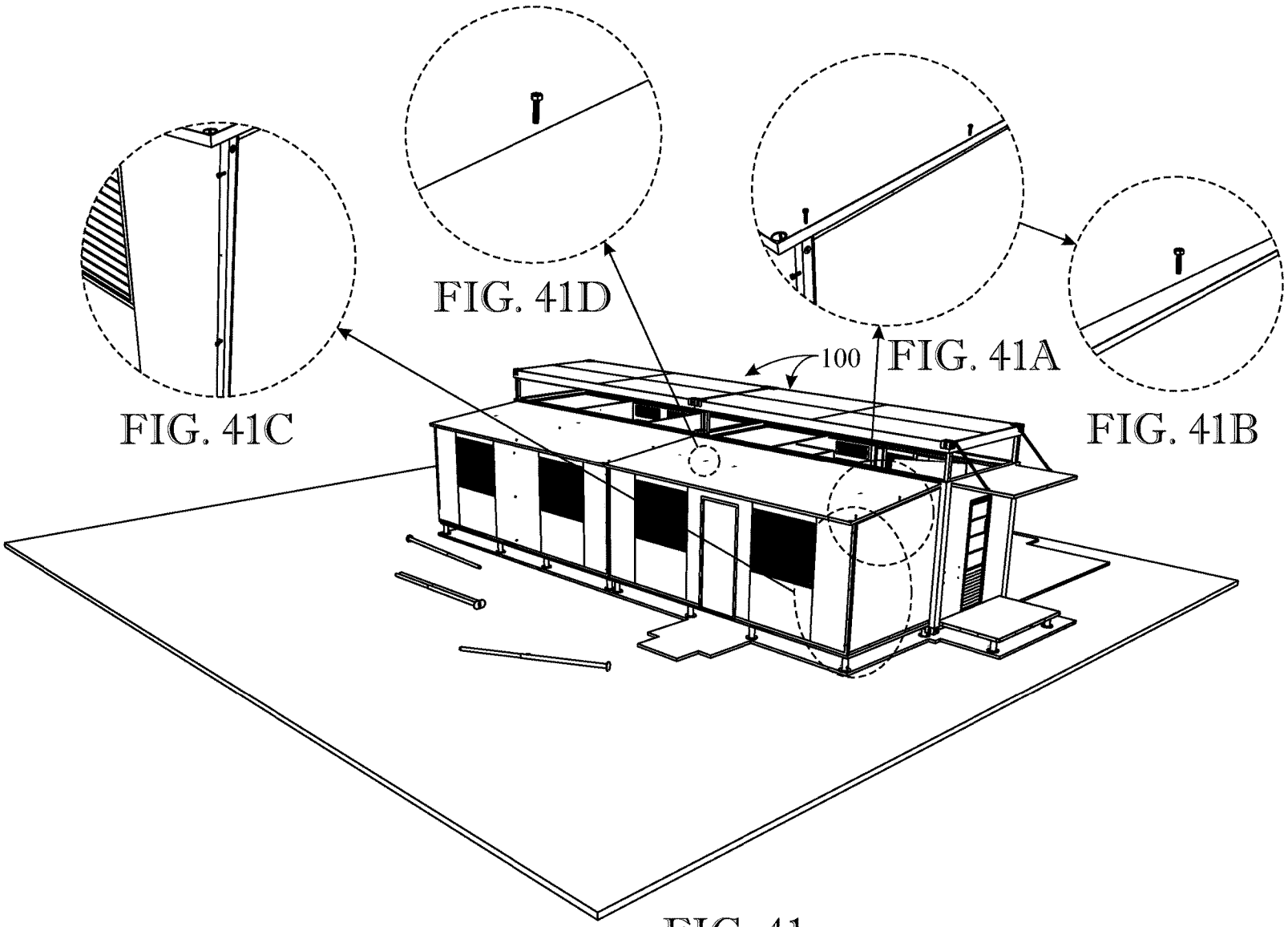
Figures 42, 42A:
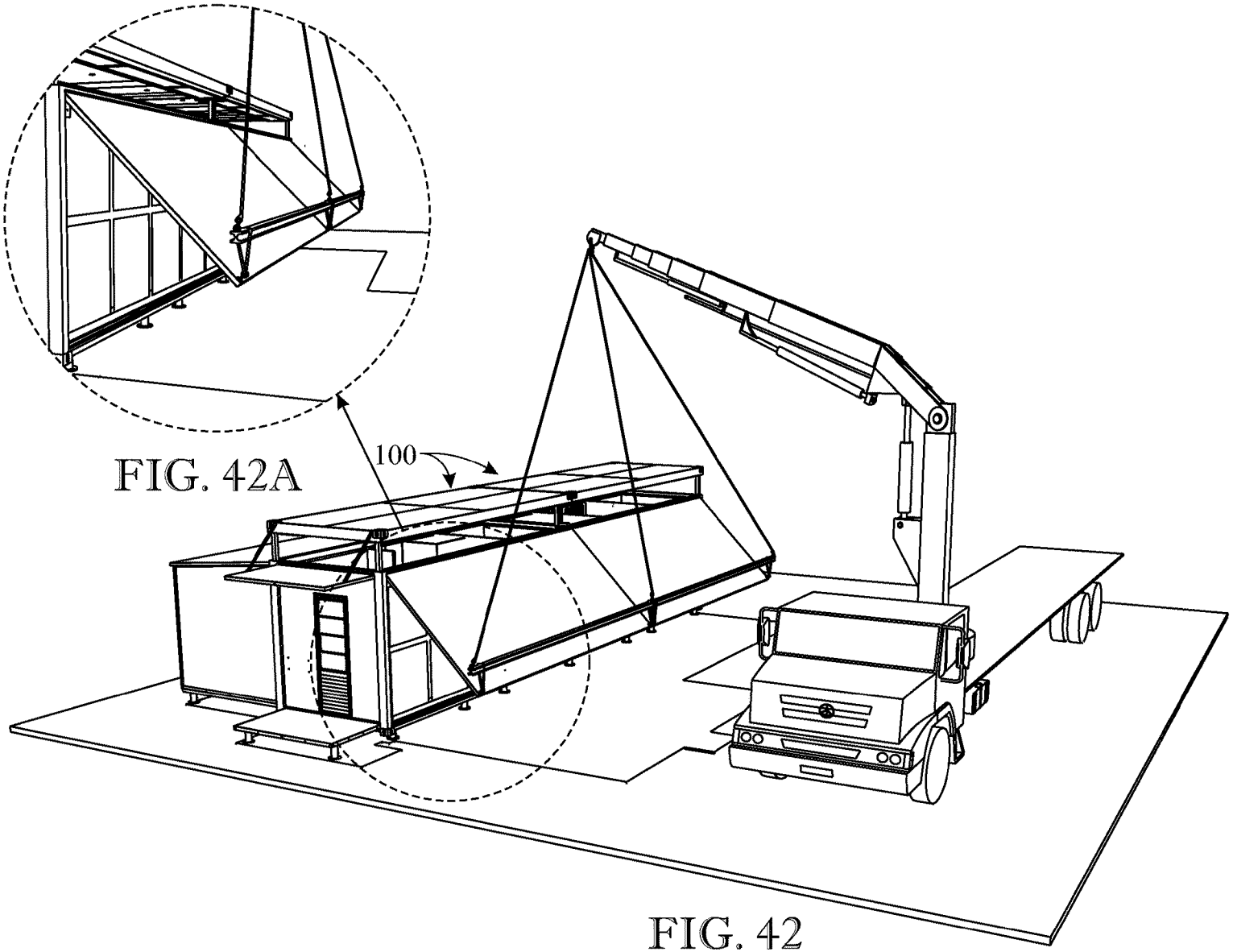
Figures 43, 43A:
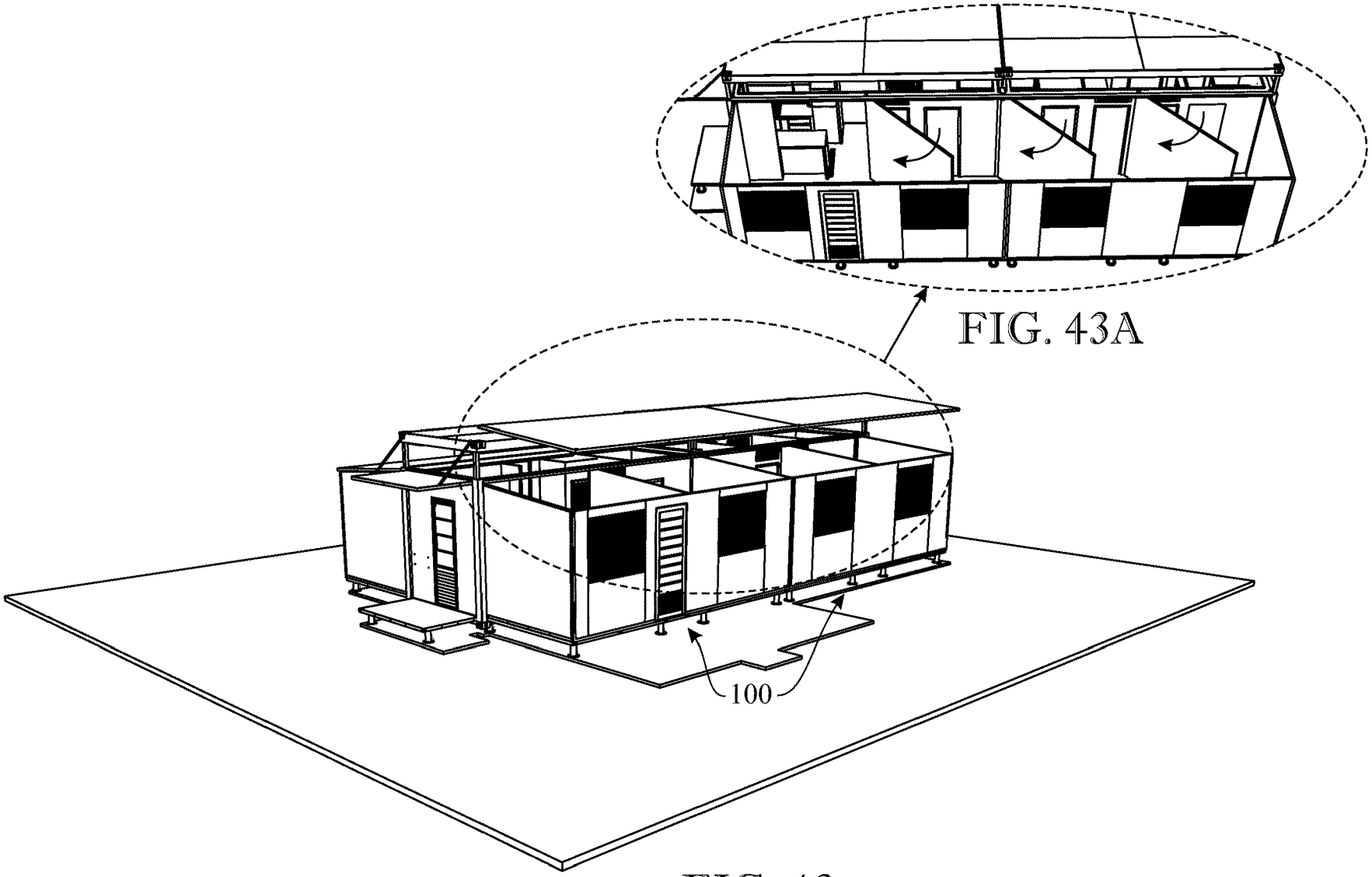
Figures 44, 44A:
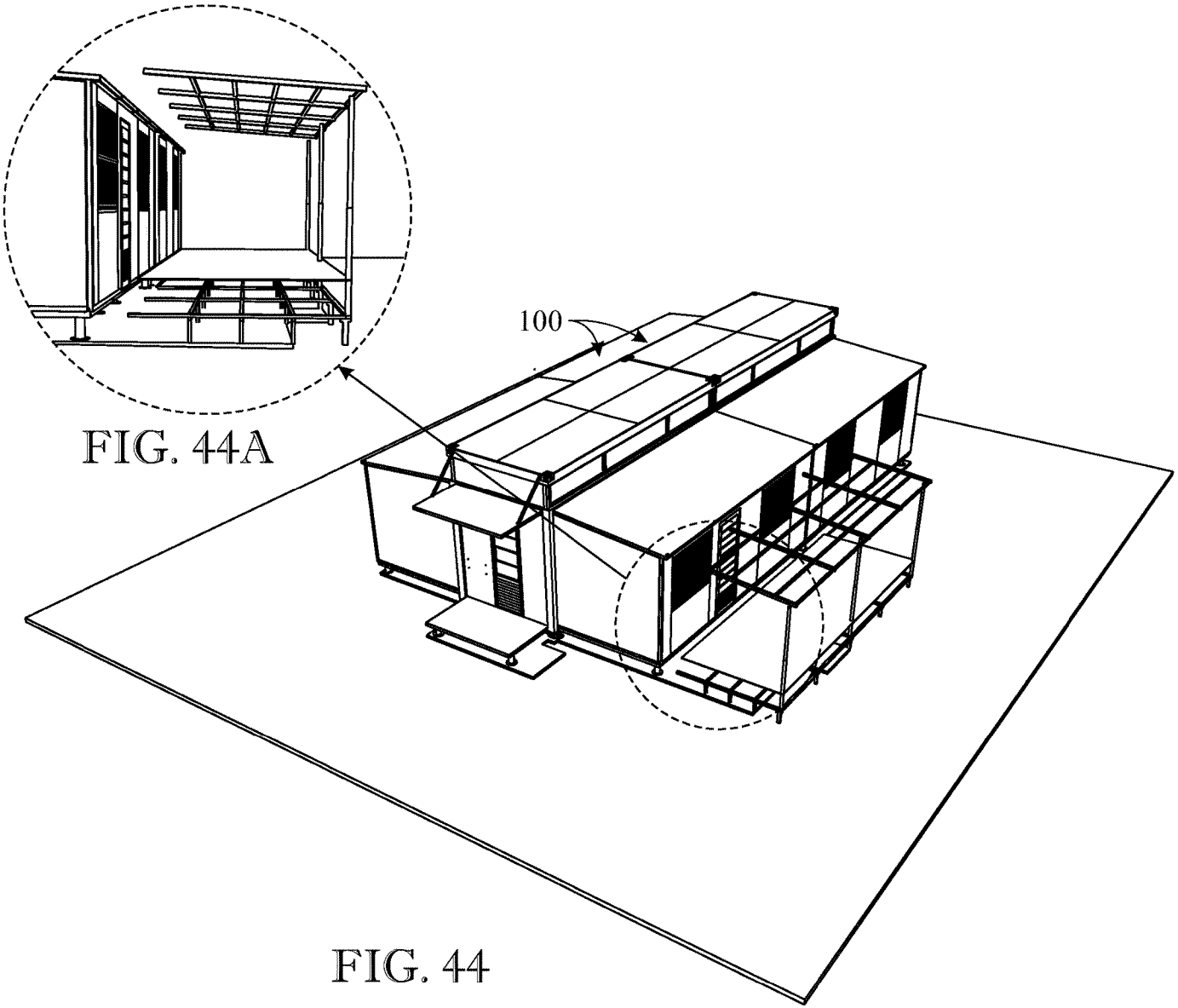
Figures 45, 45A:
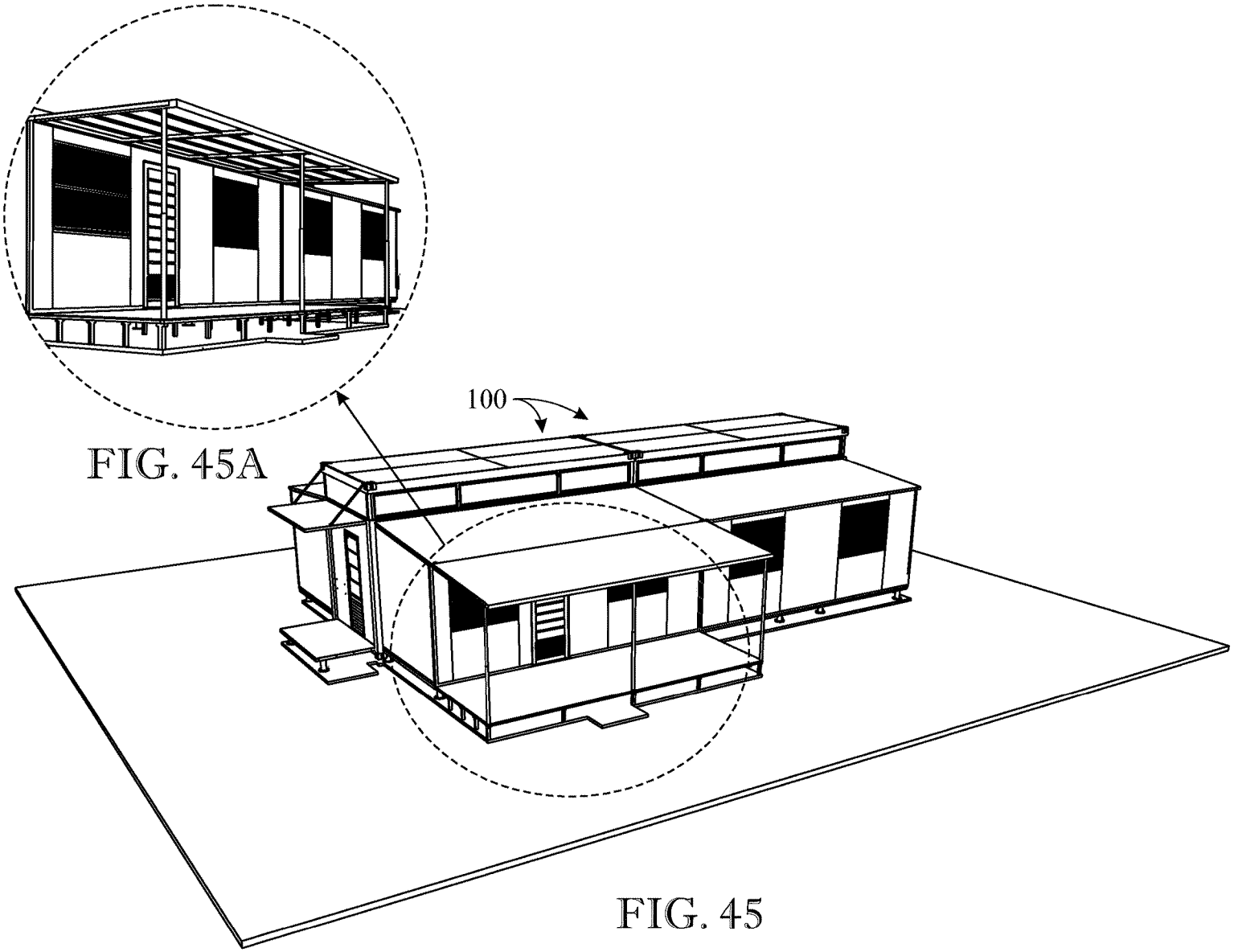
Figure 46:
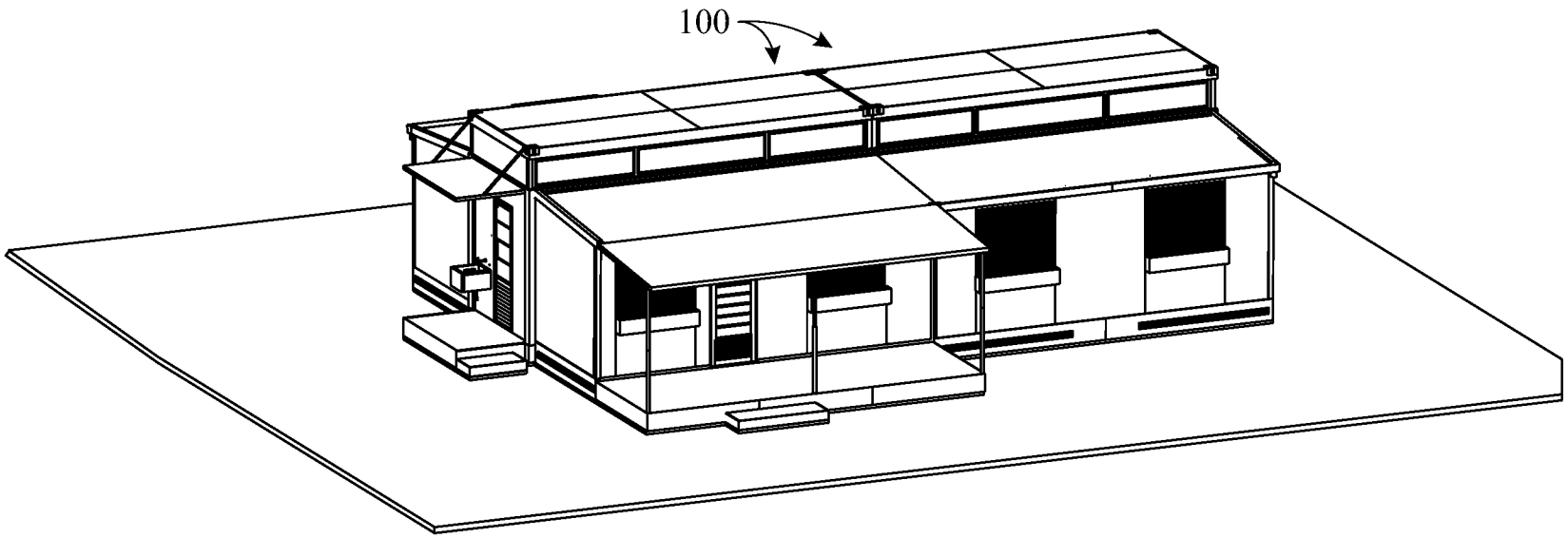
Figure 47:
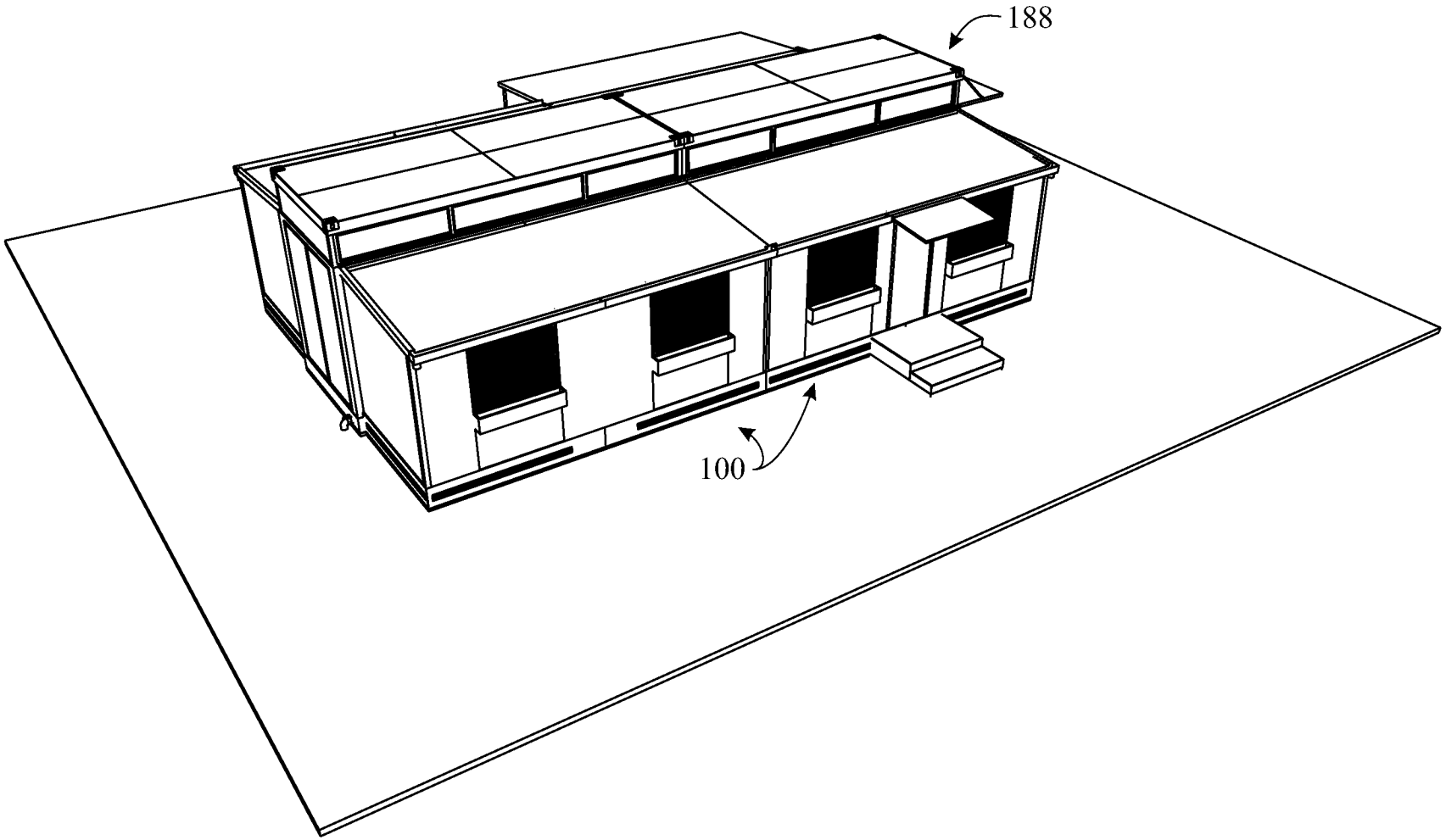

As shown in FIGS. 11-21, 11A-14A and 18A, the plurality of wall panels 104, ceiling panels 106 and floor panels 108 of the deployable panels are disposed in the interior space 120 in the container box frame 102. The wall panels 104, ceiling panels 106 and floor panels 108, being generally planar in configuration, are pivotally mounted, and movable relative, to the elongated corner and side members 114, 116 at the opposite right and left open sides 126, 128 of the container box frame 102 and relative to each other for deploying and erecting one or more rooms at the right and left sides of the container box frame. The crane 206 may also be employed to assist in deploying and erecting these components of the packaged container housing structure 100 to construct a completed house 188 at the site 204, as shown in FIG. 31. An elongated lift rail 208, a plurality of lift cable lines 210, and a plurality of the telescopic support tubes 186 may be employed to assist the crane 206 in erecting these components.

Referring again to FIGS. 1-31, 7A, 8A, 11A-14A, 18A, 22A-23A, 27A-30A and 28B, there is illustrated an exemplary embodiment of the overall packaged container housing construction method for deployment of the packaged container housing structure 100 in accordance with aspects of the present invention. As shown in FIGS. 1-4, the top roof 110 is initially retracted to a position adjacent to the open top 124 of the container box frame 102 in which the top roof is releasably locked or fastened in a suitable manner onto the interconnected corner members 116 or upper side and end edge members 118, 120 of the container box frame 102 so as to enable lifting of the packaged container housing structure 100 via the top roof 110 by use of the lift cable lines 210 extending from the crane 206 through the apertures 190 of the corner coupling fittings 112 on the top roof. With the top roof 110 fastened at its initial position in relation to the container box frame 102, FIGS. 1-6 show the crane 206 being used for unloading, transporting and setting up the packaged container housing structure 100 (in the single unit format) at the foundation site 204.

At setup the packaged container housing structure 100 is at a position elevated above the foundation site 204 and the support feet 114 are applied to the bottom of the container box frame 102. Once completed when the support feet 114 are fastened to the foundation site 204, the top roof 110 is then unlocked or unfastened in relation to the container box frame 102. As shown in FIGS. 7 and 7A, the crane 206 is used for lifting of the unfastened top roof 110 upwardly from and relative to the container box frame 102 to its final position in which it is spaced above the open top 124 of the container box frame.

FIGS. 8, 8A, 9 and 10 show deploying and erecting the service entry 178 of the packaged container housing structure 100 by deploying and erecting the upper and lower panels 180, 182 to provide the exterior roof and floor for the service entry of the container box frame 102. The upper and lower panels 180, 182 are deployed by being pivotally moved, such as manually, from their initial position, in which they are mounted to the container box frame 102 across the service entry 178 at the front open end 132 of the container box frame 102, relative to the service entry to horizontal positions in which they respectively provide the exterior roof and an exterior floor for the service entry. The pair of braces 184 are retrieved from the interior space 122 in the container box frame 102, and deployed between and attached to the upper panel 180 and the top roof 110 so as to support the upper panel as the exterior roof for the service entry 178 to the container box frame. Also, selected other ones of the support feet 114 are applied to the bottom of the lower panel 182, after which the length of each of the support feet is adjusted to enable positioning the lower panel in a level orientation upon the mounting site 204.

Figure 19:
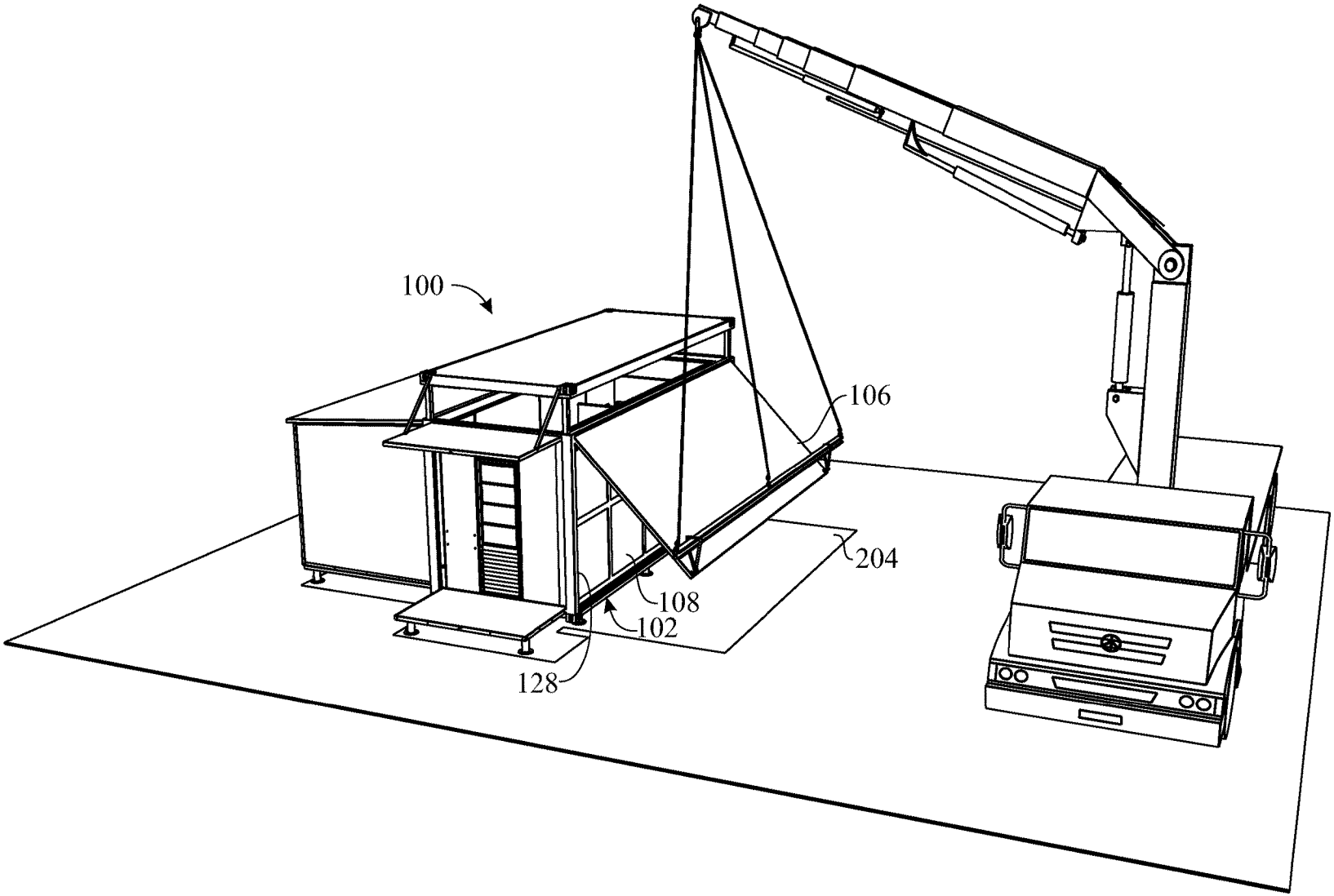
FIGS. 19-21 present in a sequence of isometric views the crane assisting in deployment of other ceiling (or roof), wall and floor panels from the container box frame of the packaged container housing structure and erection of one or more rooms on the right side of the container box frame.
Figure 20:
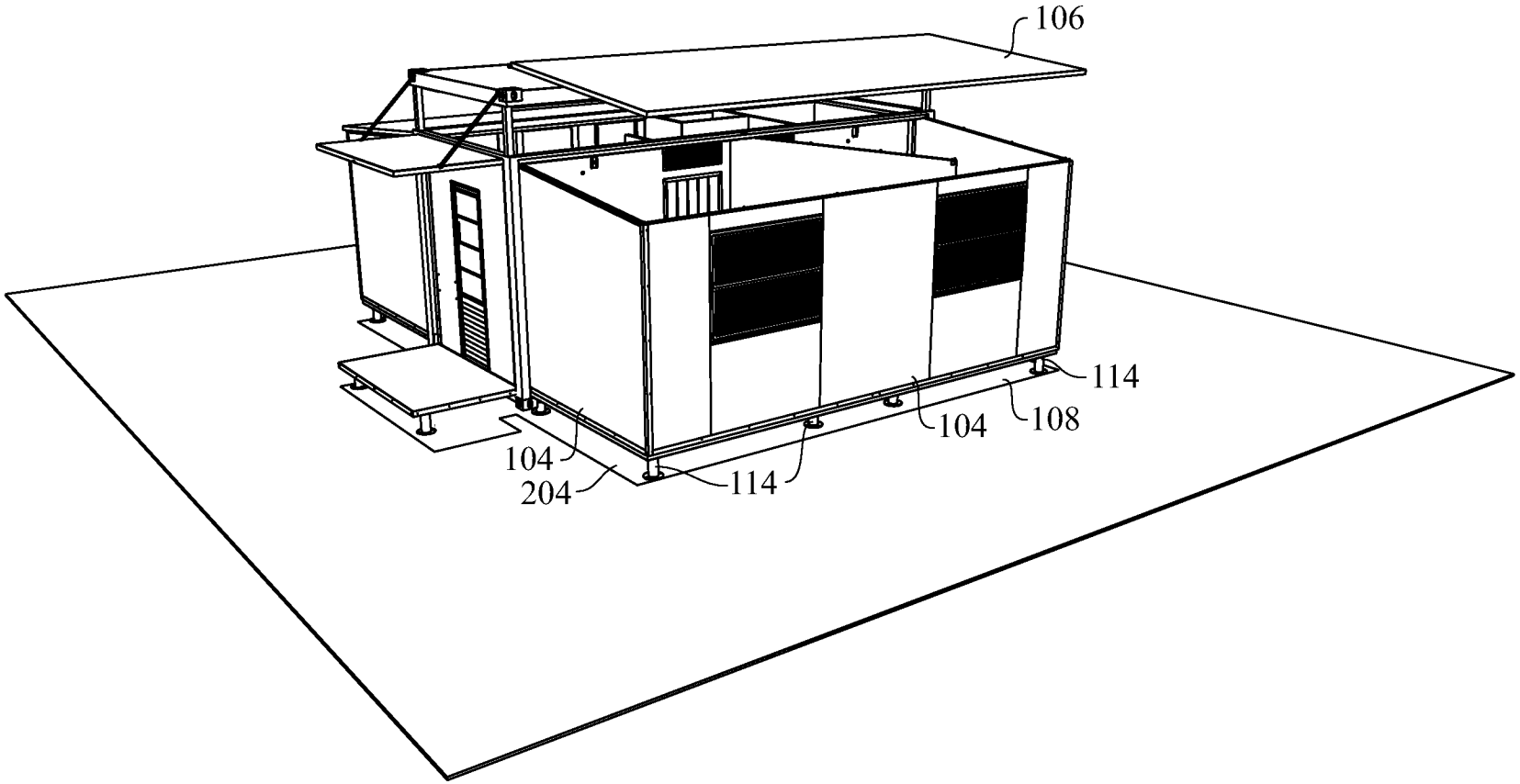
Figure 21:
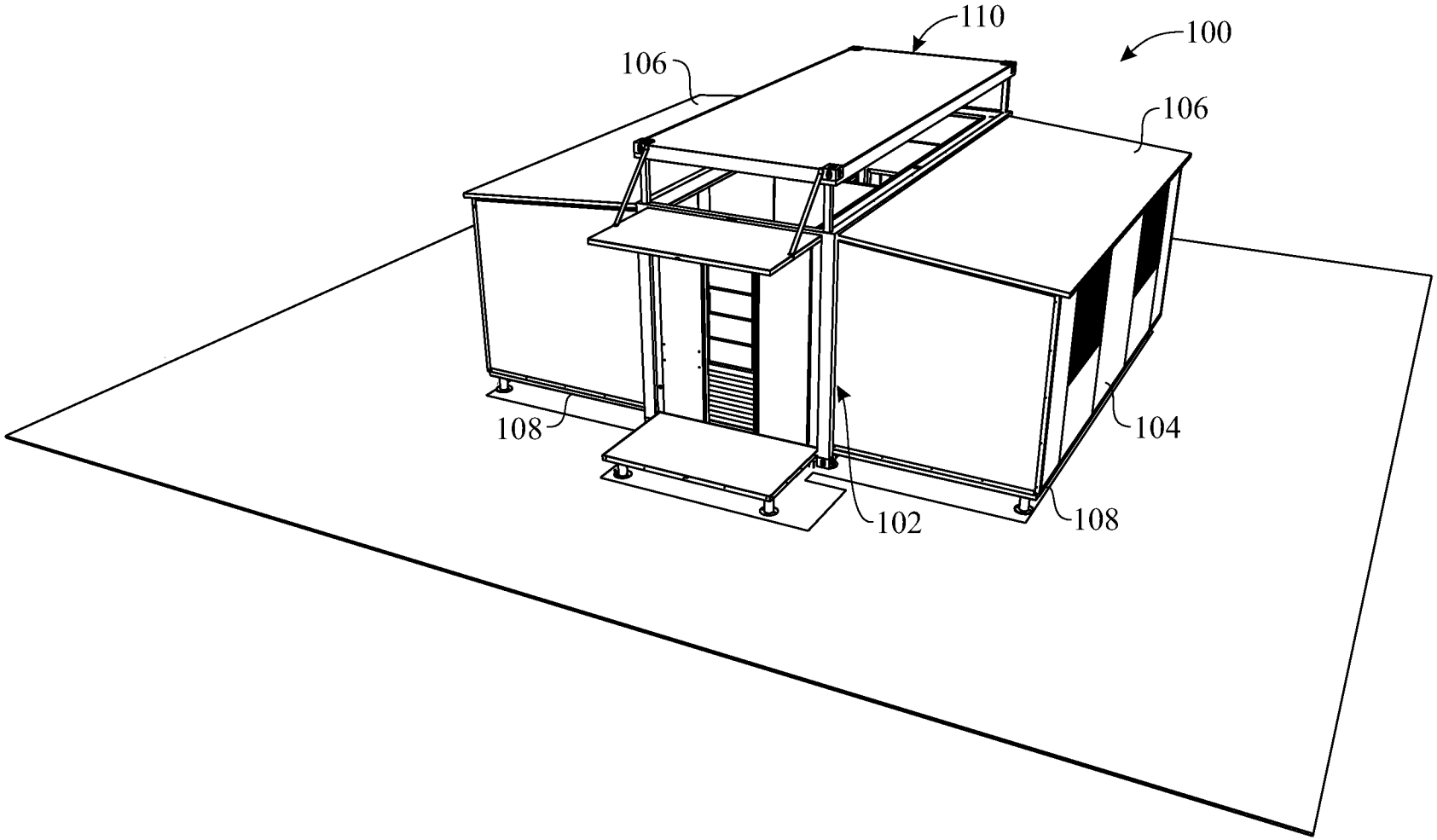
Figures 22, 22A:
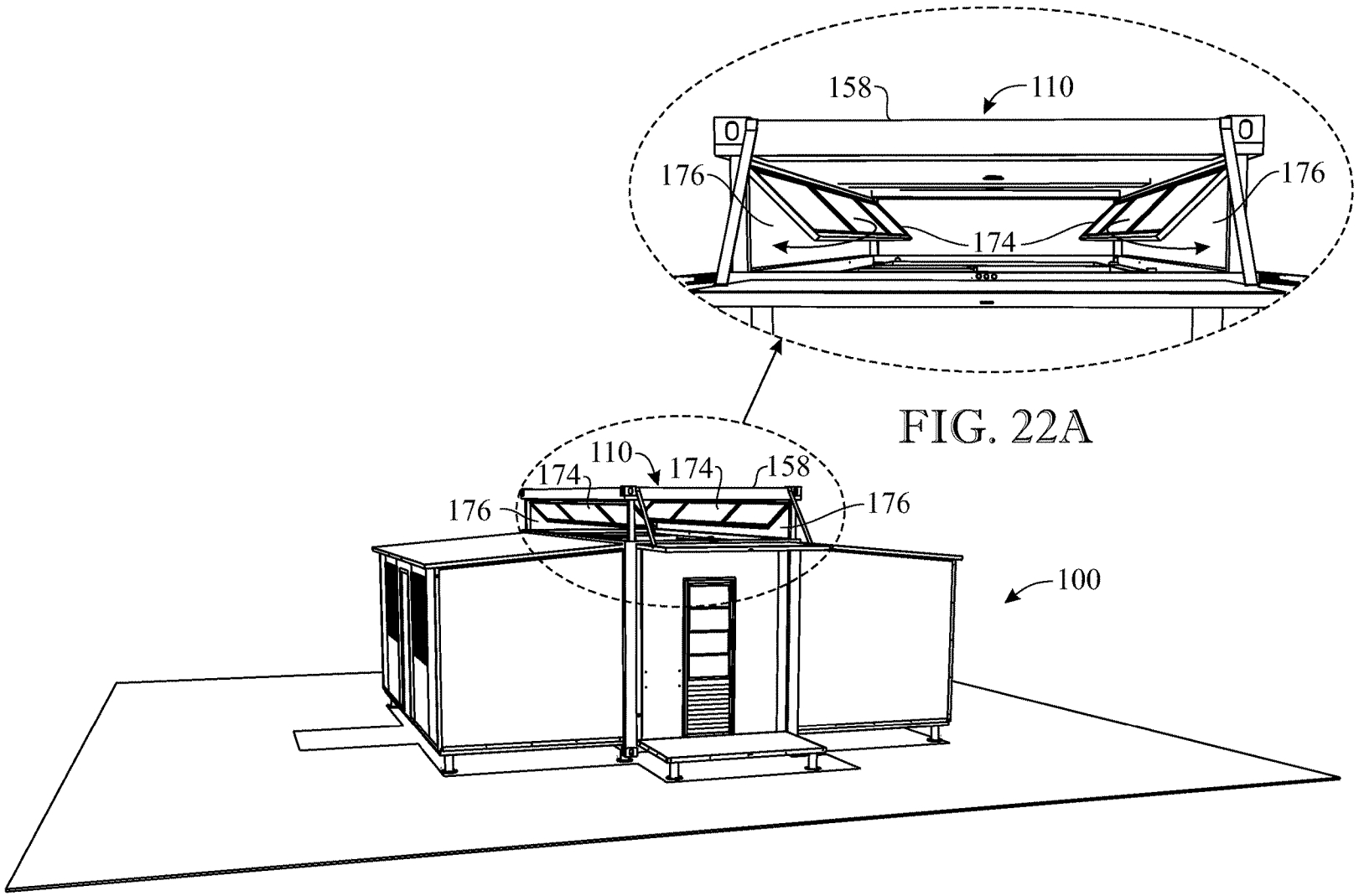
FIGS. 22-24 and 22A-23A present in a sequence of isometric views the deployment of top windows between the top roof and open top of the container box frame of the packaged container housing structure.
Figures 23, 23A:
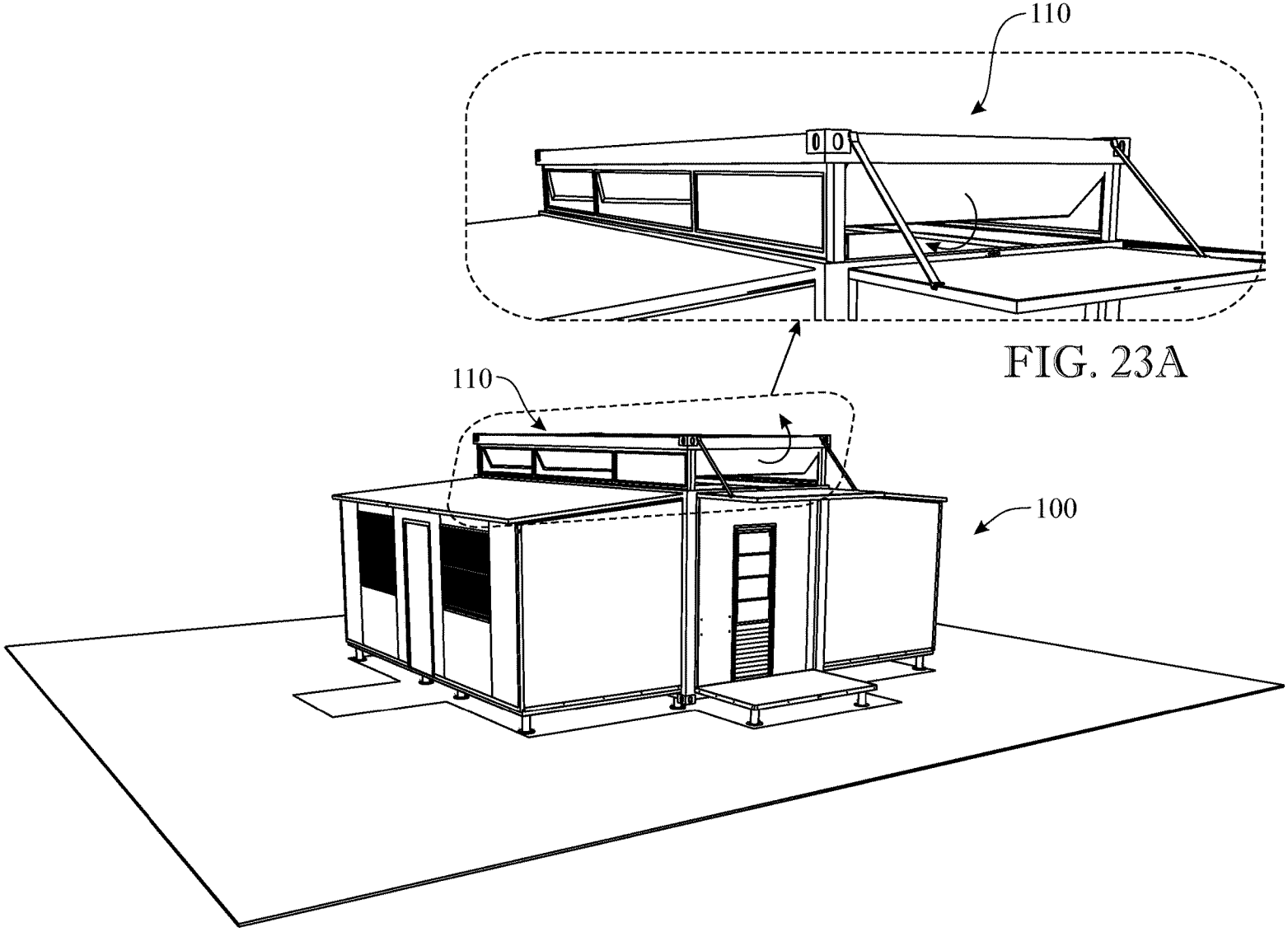
Figure 24:
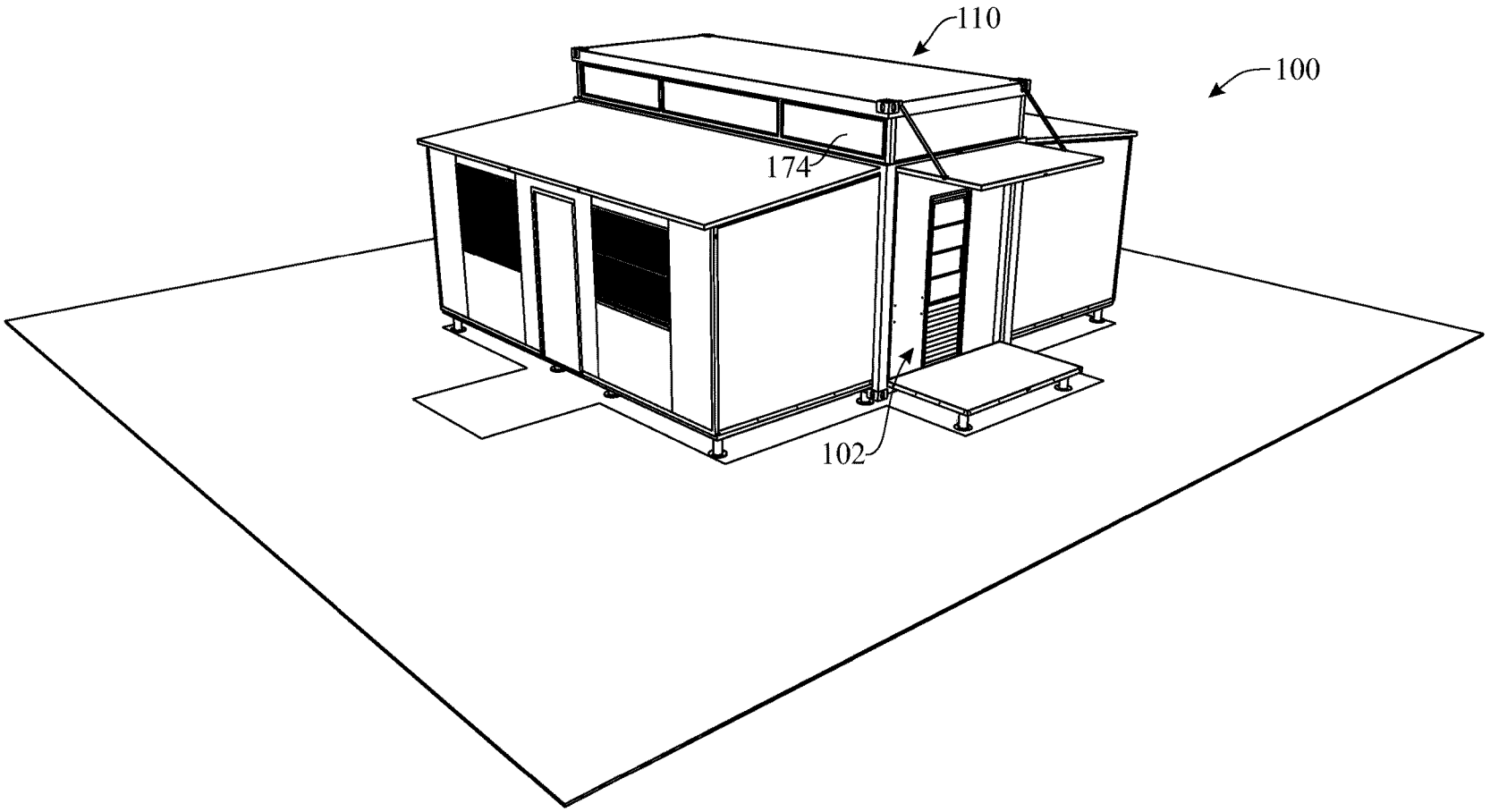
Figure 25:
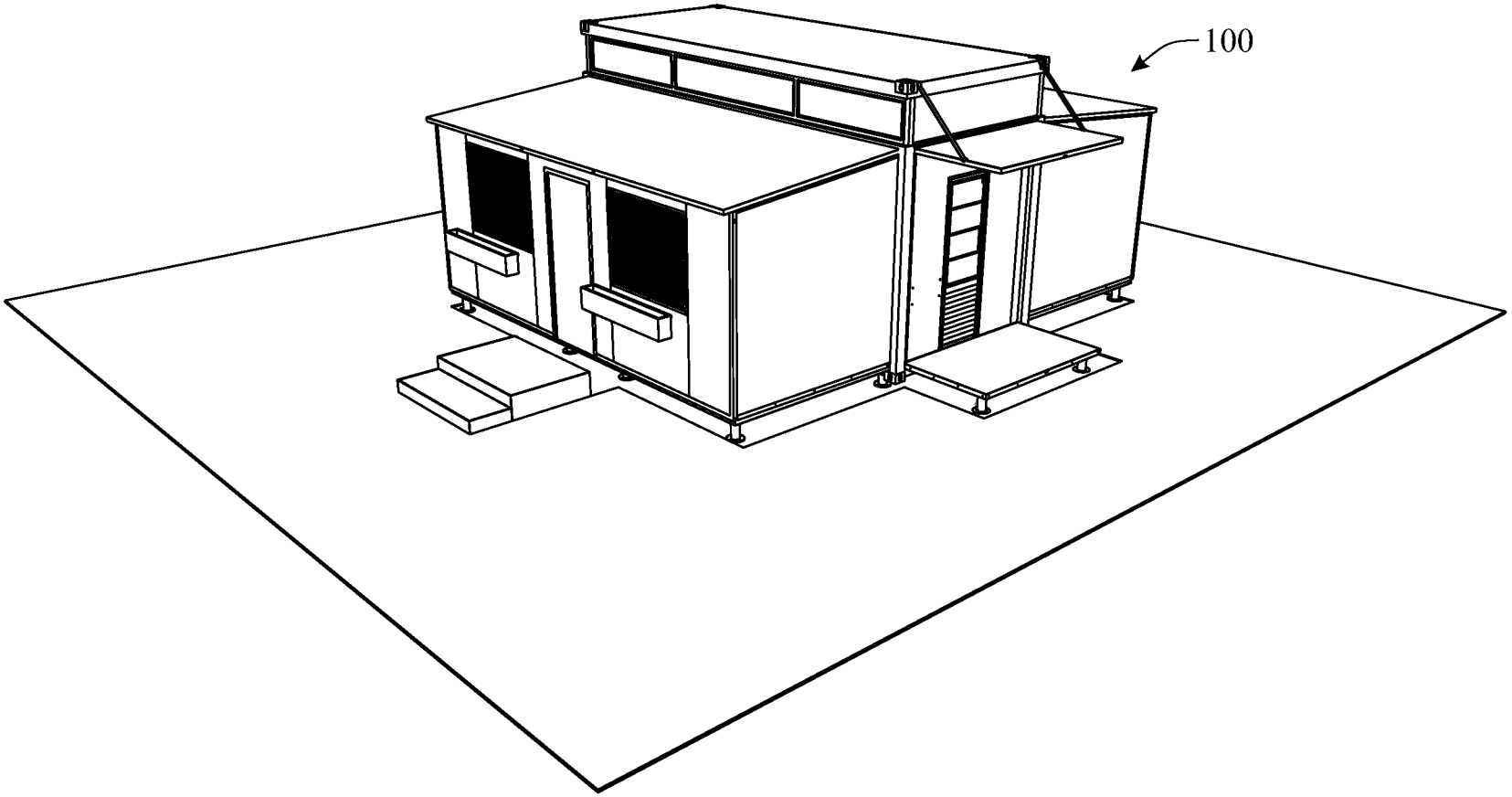
FIGS. 25-31, 27A-30A and 28B presents in a sequence of isometric views the installation of various external trims to complete the house as shown in FIG. 31.
Figure 26:
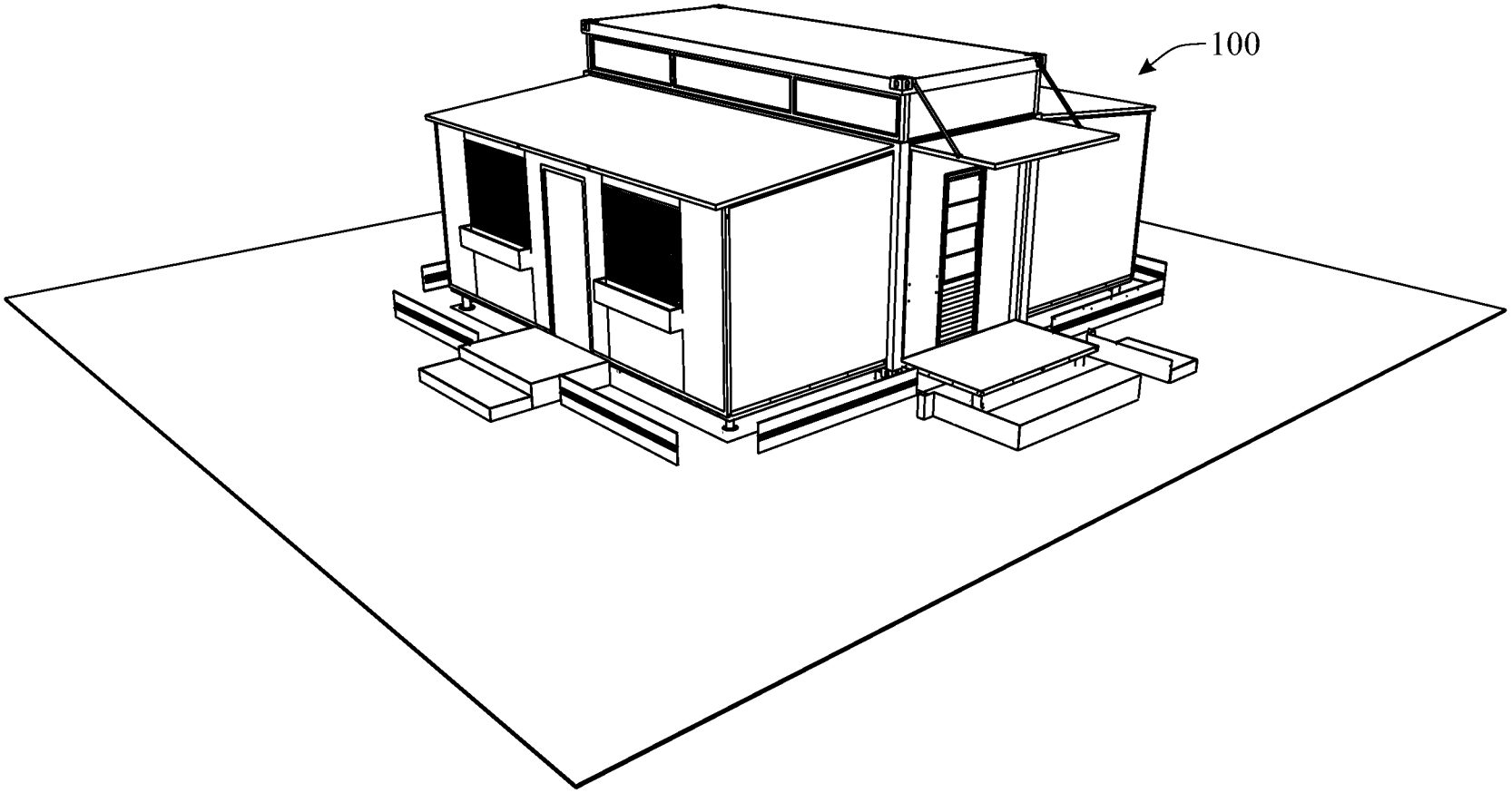
Figures 27, 27A:
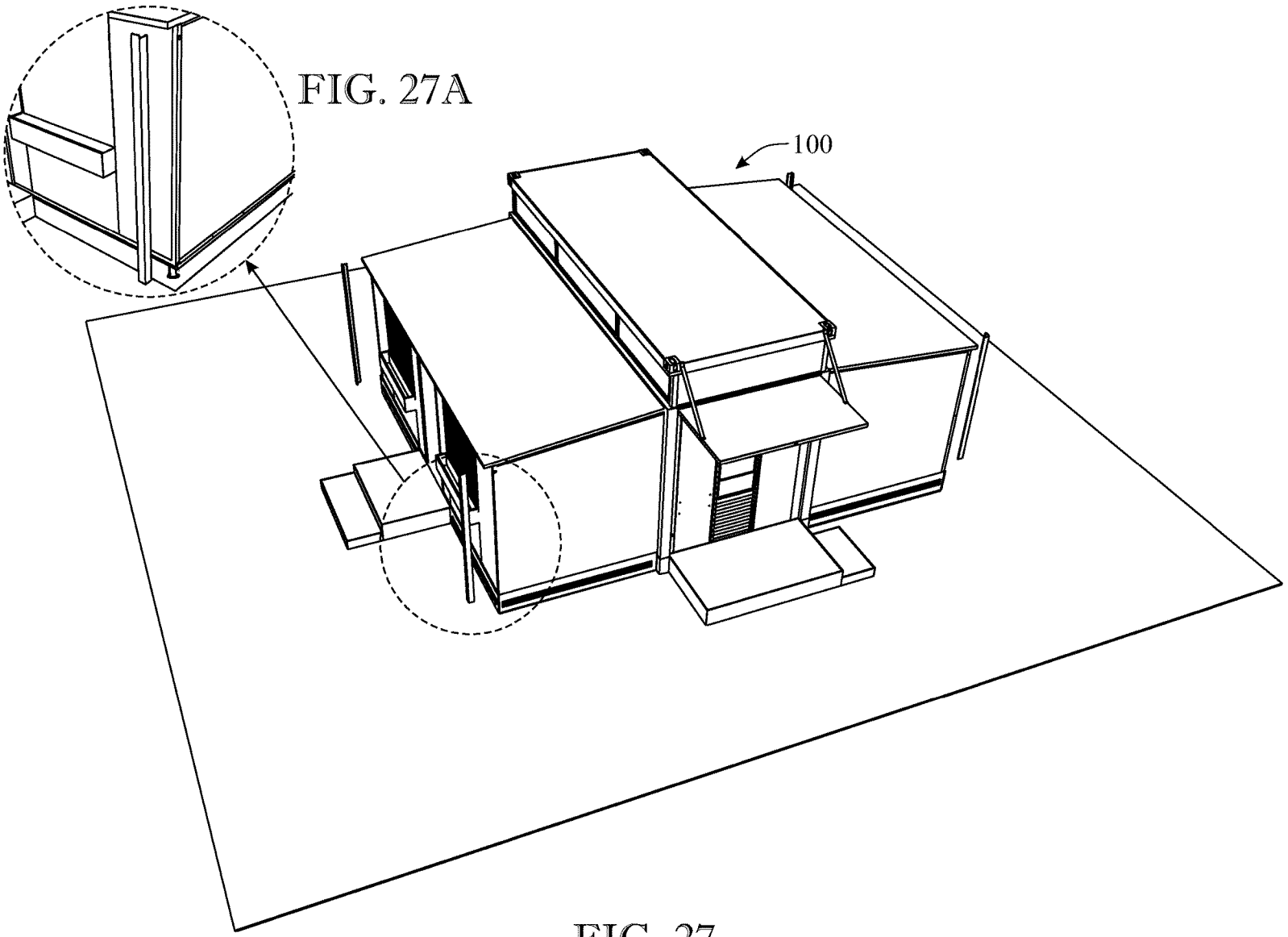
Figures 28, 28A, 28B:
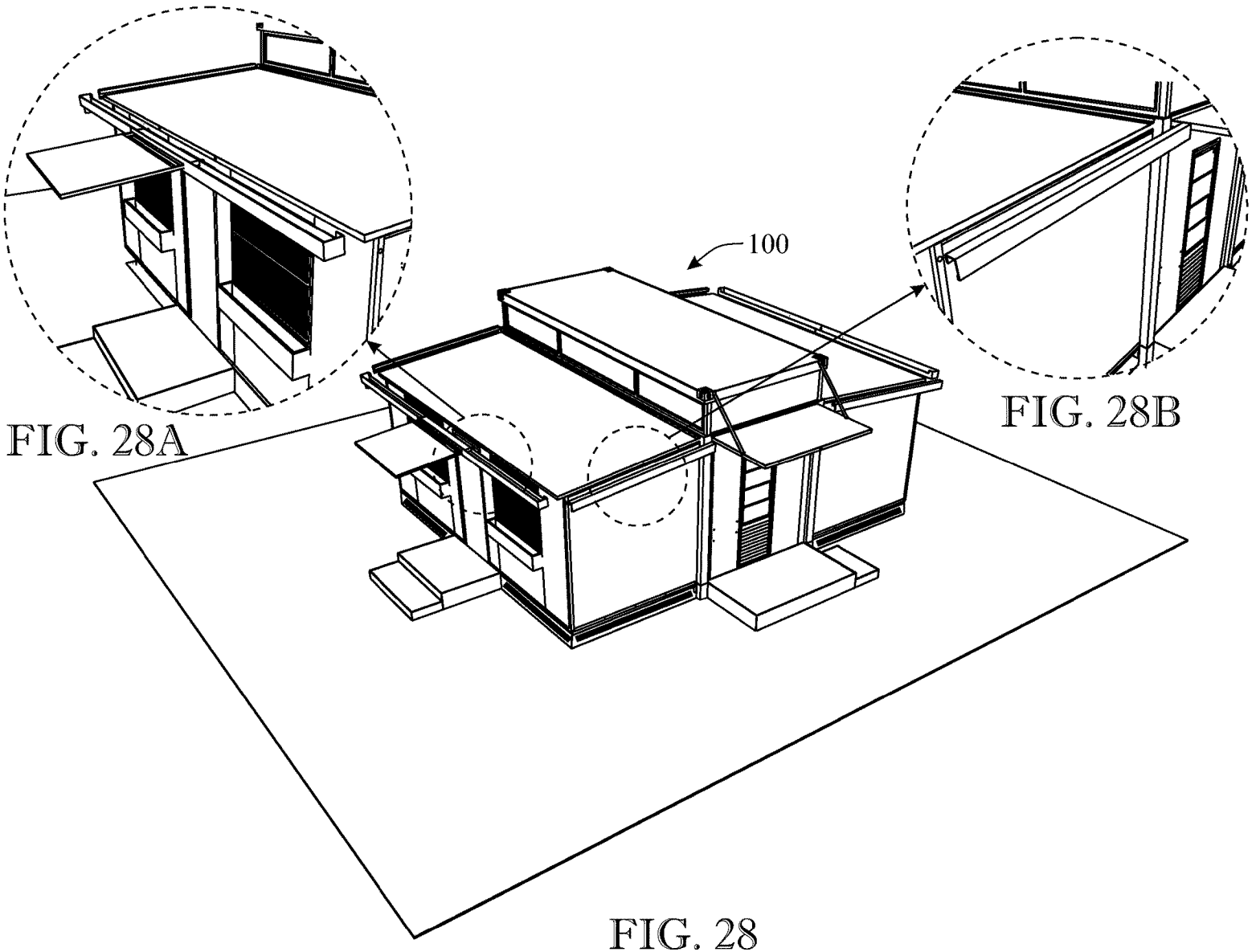
Figure 29:
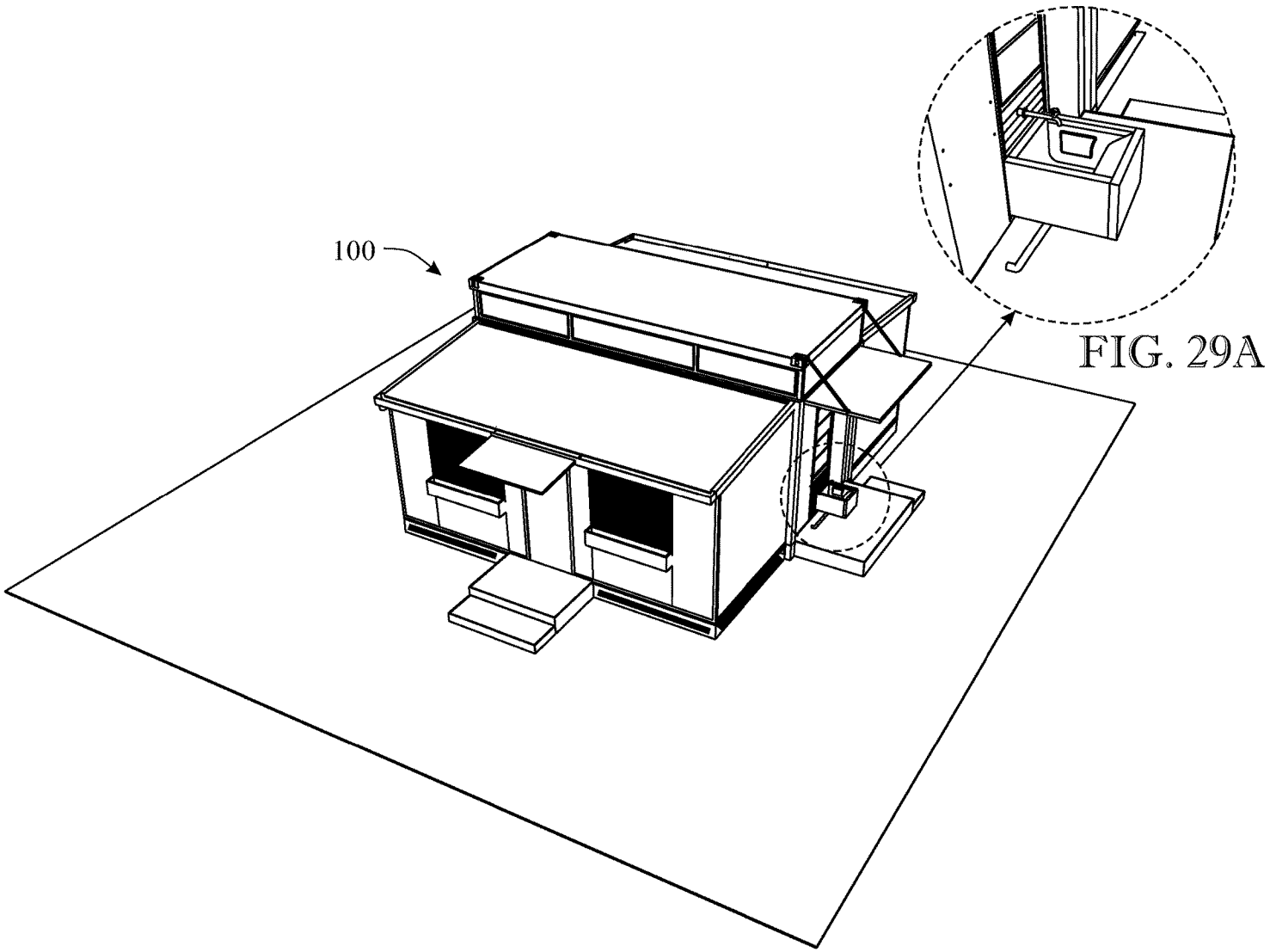
Figures 30, 30A:
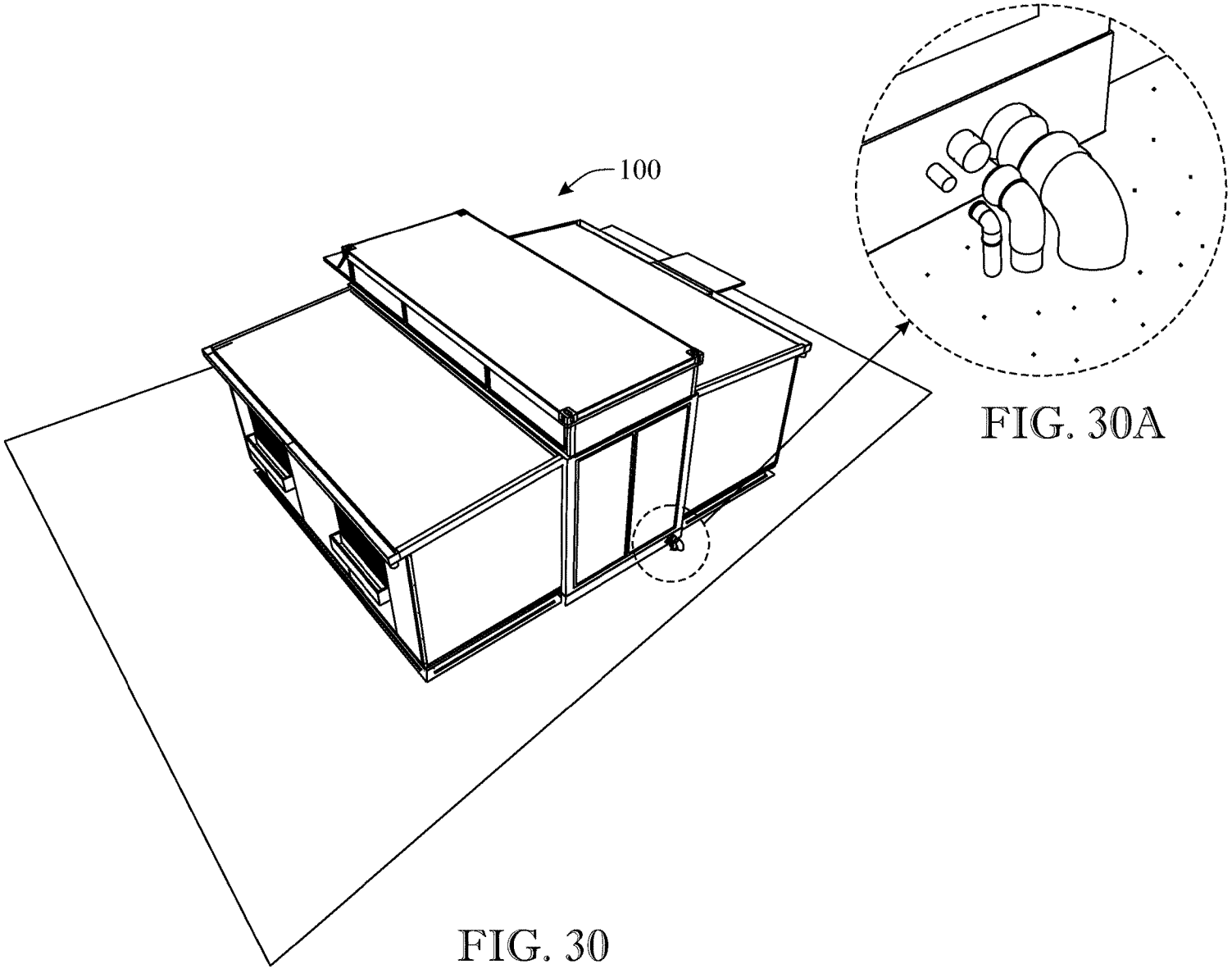

FIGS. 11-21, 11A-14A and 18A show deploying and erecting selected ones of the wall panels 104, ceiling panels 106 and floor panels 108 relative to the container box frame 102 so as to provide one or more rooms on at least one side, and preferably on both left and right sides, of the container box frame. FIGS. 11-18, 11A-14A and 18A show deploying and erecting left side room(s) and FIGS. 19-21 show deploying and erecting right side room(s) by unpacking and deploying the wall panels 104, ceiling panels 106 and floor panels 108 relative to the container box frame 102 of the packaged container housing structure 100. With respect to each side of the packaged container housing structure 100, each of the ceiling panels 106 covering the respective left and right open sides 130 of the container box frame 102 are deployed first by the crane 206 using the horizontal lift bar 208 and lift cable lines 210 so as to form a roof for the respective side rooms and to enable installing a pair of the telescopic support tubes 186 at each side to temporarily retain the roofs in horizontal erected orientations. Following thereafter the floor panels 108 are lowered part of the way by the crane 206 using the horizontal lift bar 208 and lift cable lines 210 so that selected other ones of the support feet 114 may be attached to the bottom of each of the floor panels and the length of each adjusted so as to enable positioning the floor panels in level orientations upon the mounting site. Following thereafter, the various wall panels 104 may be deployed to and secured at their final positions to complete the rooms. The temporary telescopic support tubes 186 may be removed.

FIGS. 22-24 and 22A-23A show the top windows 174 between the top roof 110 and the open top 124 of the container box frame 102. The top windows 174 are movably mounted along opposite sides of the top roof 110. The top windows are deployed by being moved toward and away from the side openings 176 between the top roof 110 and the open top 124 of the container box frame 102 to regulate the air flow into and from the side openings and the interior space 122 in the container box frame. Finally, FIGS. 25-31, 27A-30A and 28B show various external finishings which are installed to complete construction of the house 188 at the site 204, being shown in FIG. 31.

Turning now to FIGS. 32-51, 36A-45A, 36B-39B, 36C-36G and 41B-41D, there is illustrated an exemplary embodiment of a pair of the packaged container housing structures 100, which may be unloaded from the flatbed 202 of the truck 200, such as by the crane 206 and lift cable lines 210, and placed end-to-end and fastened together so as to have a rectangular configuration and a double unit format. FIG. 36 and FIGS. 36A-36G show container box frames 102 placed end-to-end at adjacent ones of the opposite ends thereof in a double unit format and fastened together by interengaging complementary latches 192 mounted at the adjacent ones of the opposite ends of the container box frames 102.

Figure 48:
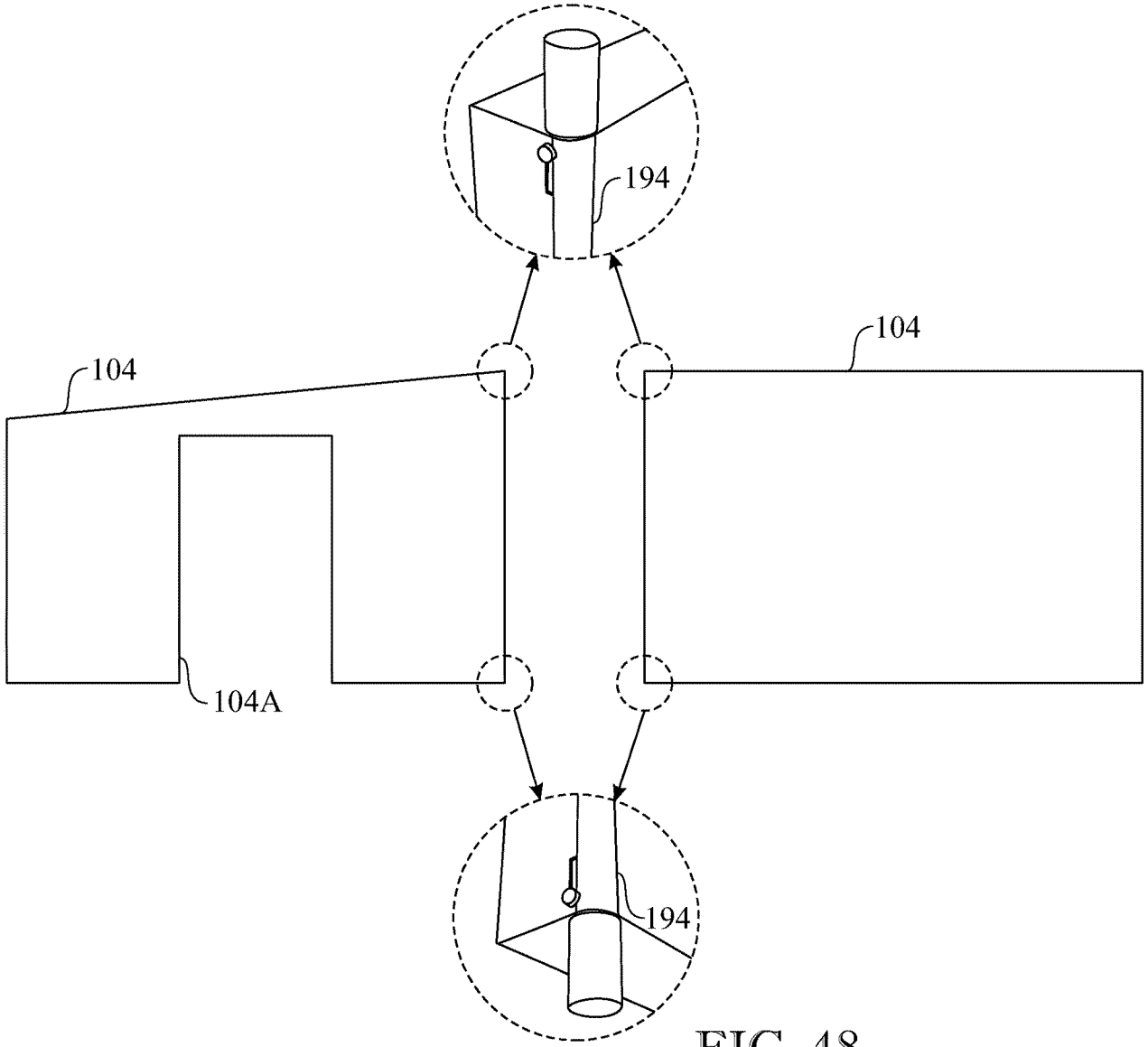
FIG. 48 presents a schematic view of one configuration of a slidable lock mechanism attached to upper and lower portions of interchangeable doorway panels or solid wall panels to secure them to the container box frame.
Figure 49:
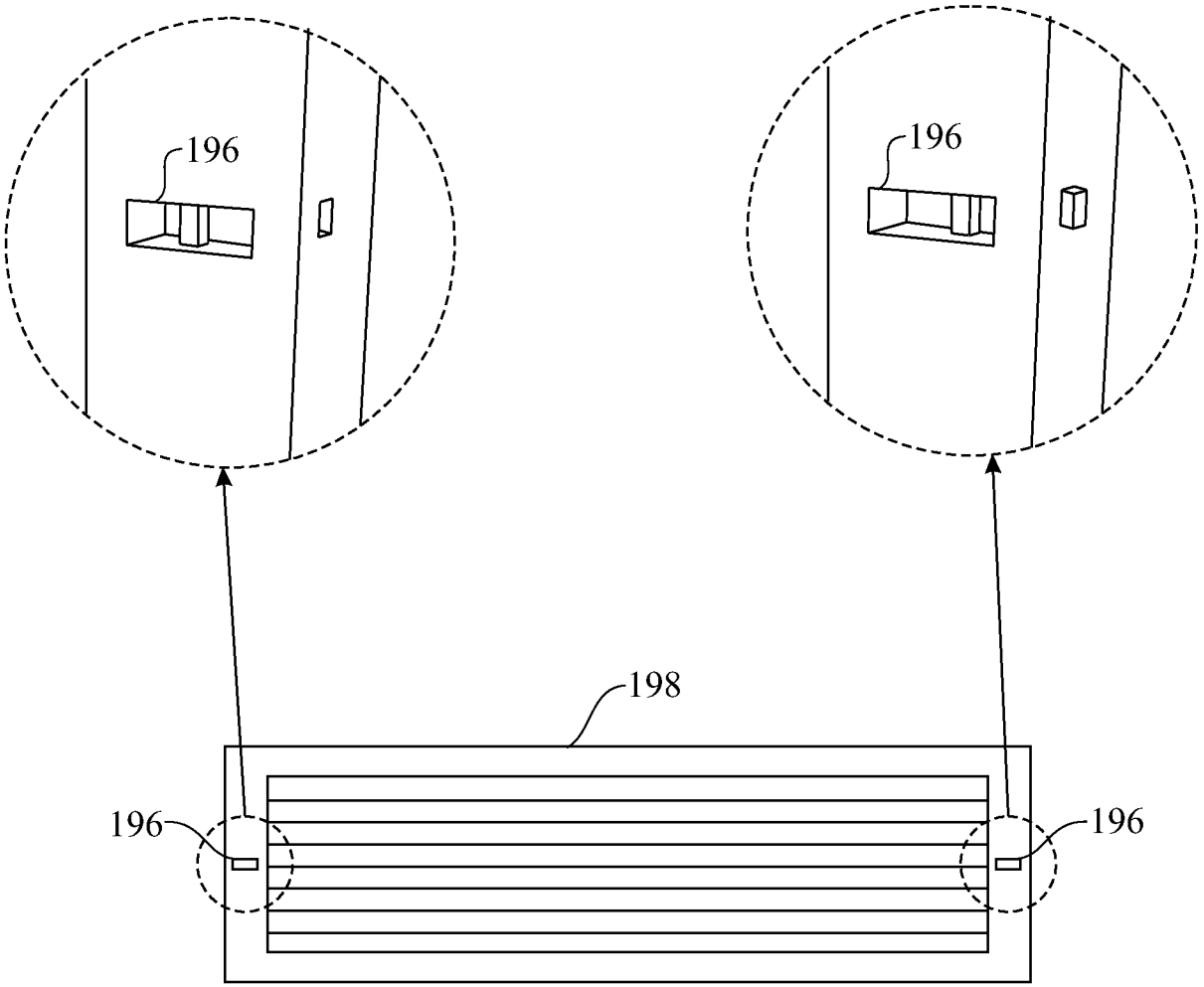
FIGS. 49 and 50 present schematic views of another configuration of a slidable lock mechanism attached to vent panels and interchangeable doorway panels or solid wall panels to secure them to the container box frame.
Figure 50:
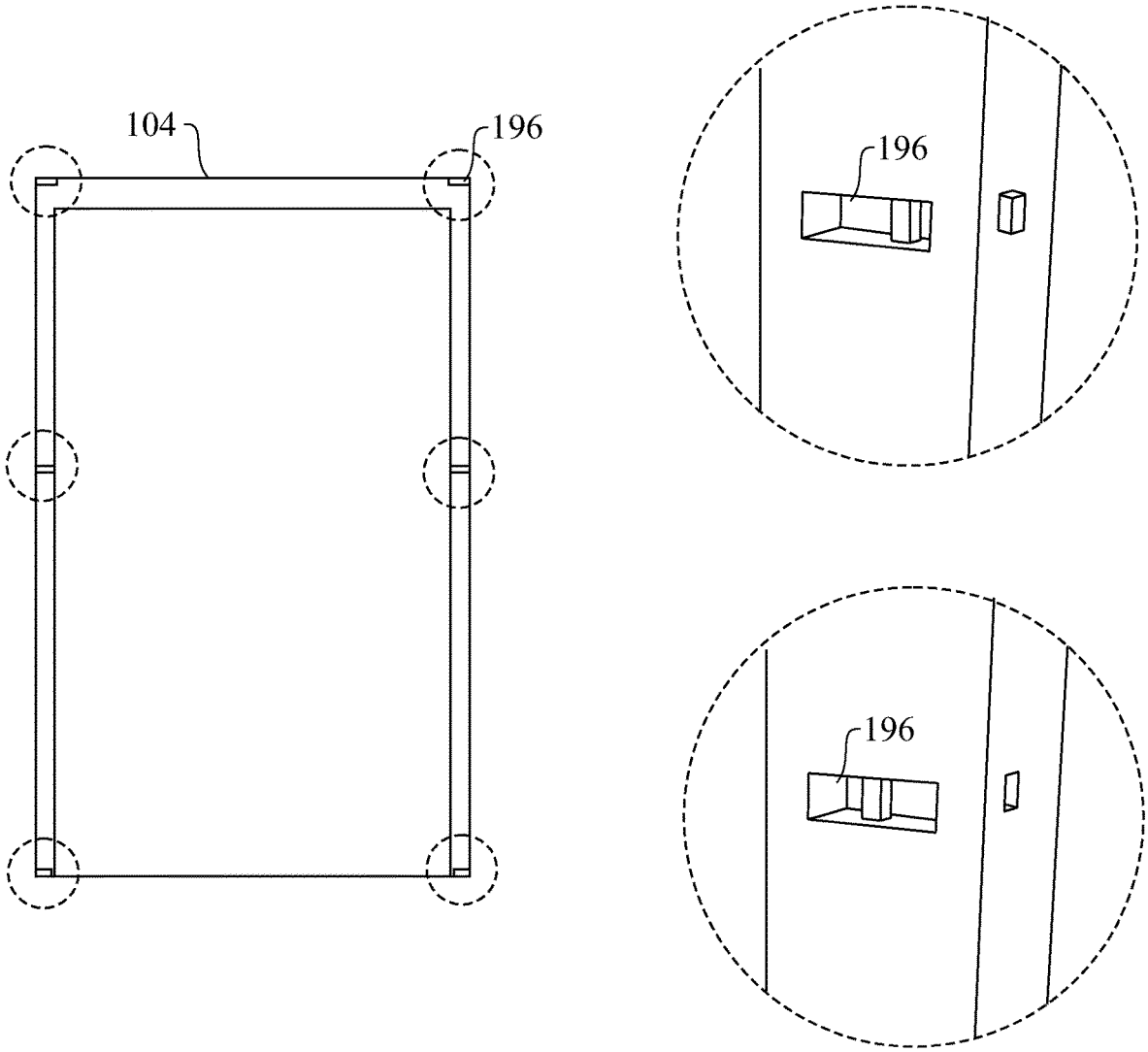
Figure 51:
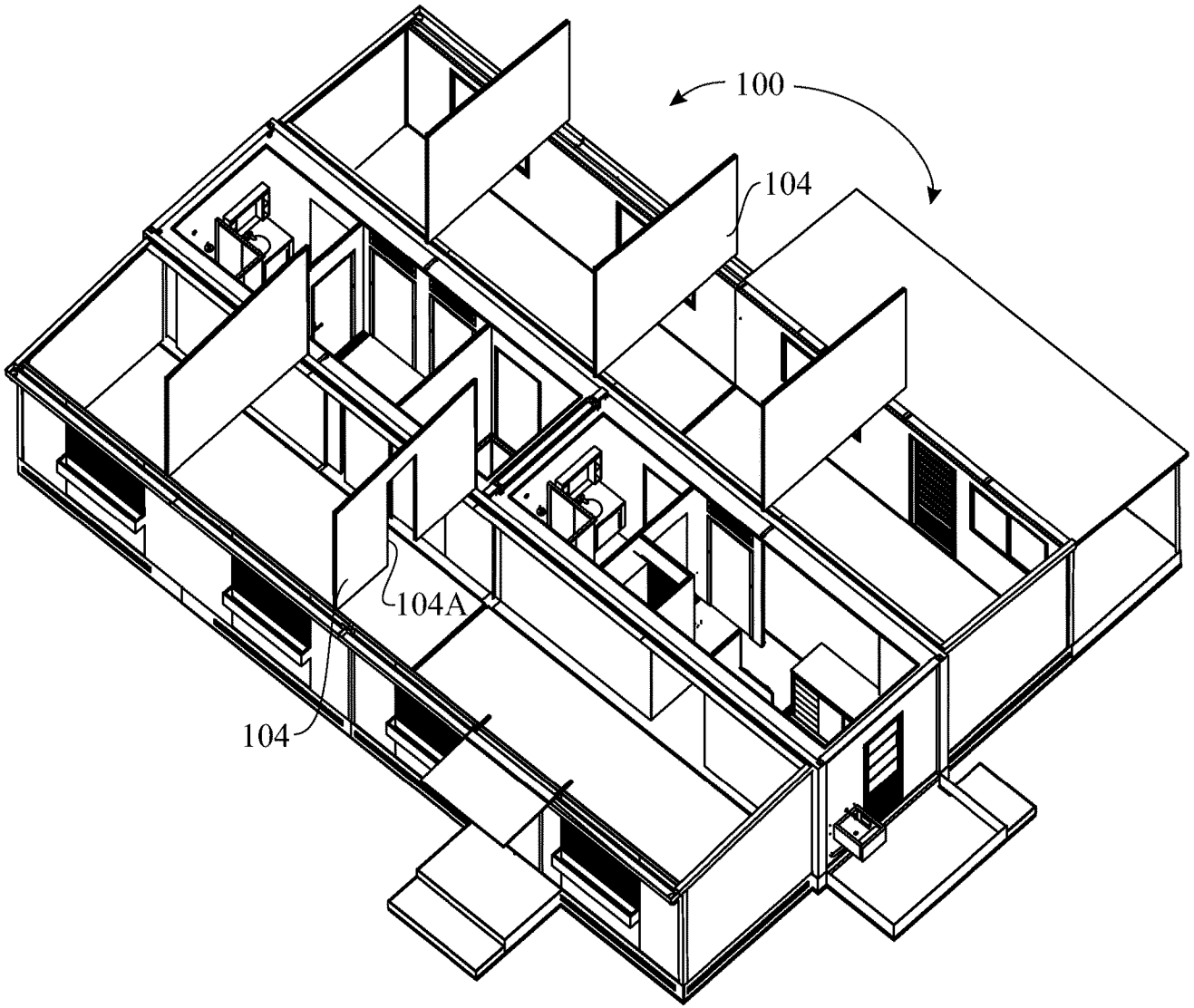
FIG. 51 presents an isometric aerial view of a completed house showing the interchangeable panels that are used therein to made possible different iterations of house interior so as to make the house fully customizable in this regard.
Figure 52:
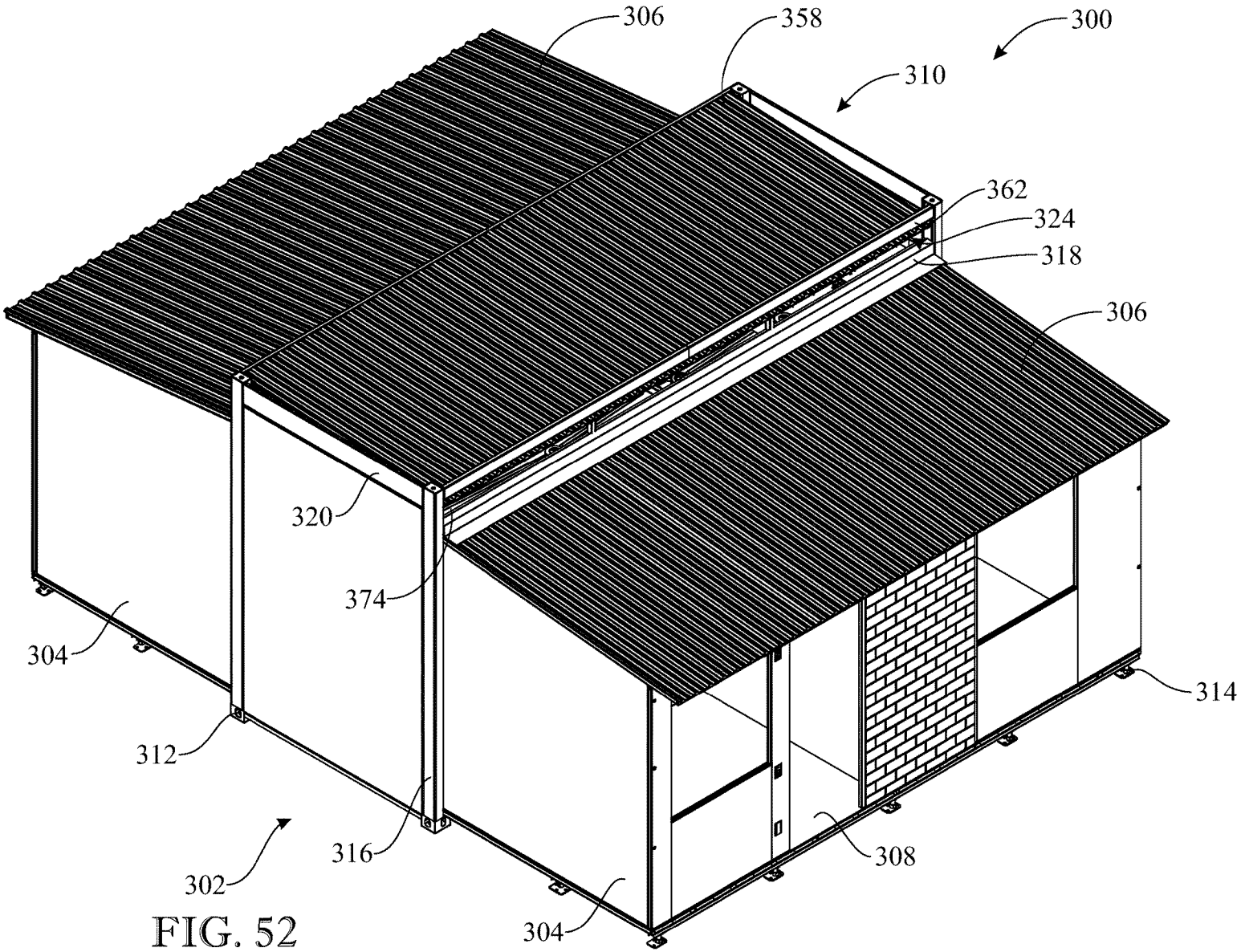
FIGS. 52 and 53 presents a top perspective view of alternative exemplary embodiment of a packaged container housing structure in accordance with aspects of the present invention.
Figure 53:
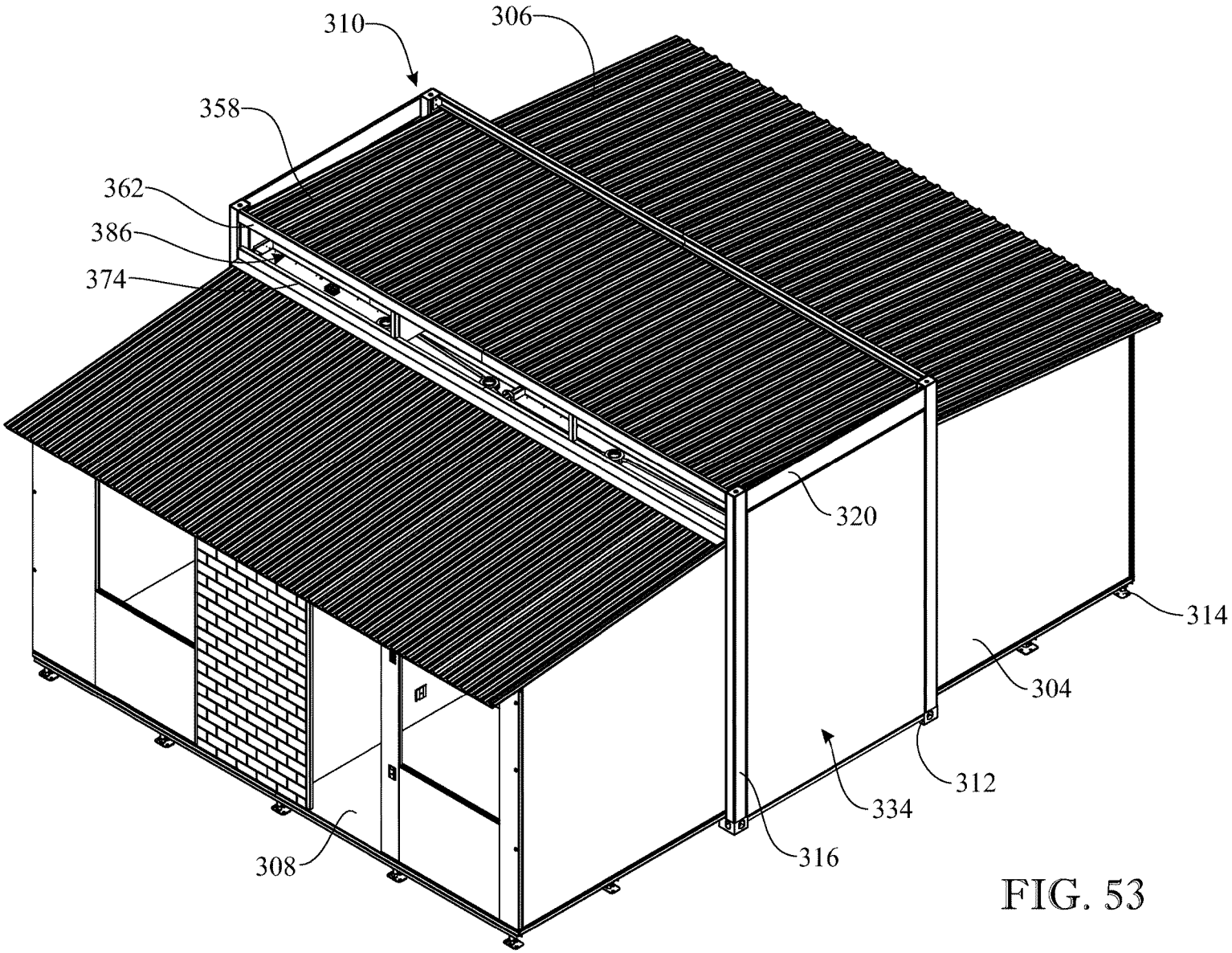

Each packaged container housing structure 100 in the double unit format has substantially the same components as described hereinbefore with respect to the single unit format; so there is no need to repeat the description of the makeup of the two packaged container housing structures 100 incorporated into the double unit format. As shown in FIG. 48, the wall panels 104 include interchangeable ones with doorways 104A and ones which are solid. FIGS. 48-50 illustrate slidable lock mechanisms 194, 196 attached to vent panels 198 and the interchangeable doorway panels 104 or solid wall panels 104 to secure them to the container box frame. FIG. 51 in an aerial view of a roofless completed house shows the interchangeable wall panels 104 therein. These wall panels 104 may be employed in the packaged container housing structure 100 for either the single or double unit format. Such wall panels 104 are interchangeable so as to provide different iterations of rooms in the completed house 188 constructed from the packaged housing structure 100 in both the single and double unit formats.

Referring now to FIGS. 52-57, there is illustrated an alternative exemplary embodiment of a packaged container housing structure, generally designated 300, in accordance with aspects of the present invention, wherein like features of the packaged container housing structure 300 and the packaged container housing structure 100 of FIGS. 1-51 are numbered the same except preceded by the numeral '3.'

The packaged container housing structure 300 includes almost all of the features of the housing 100. For instance, the packaged container housing 300 includes an elongated container box frame 302, a plurality of deployable panels including wall panels 304, ceiling panels 306 and floor panels 308 in the container box frame, a top roof 310 on the container box frame, and a plurality of coupling fittings 312. The packaged container housing 300 may also be transported by a truck on a flatbed of the truck to a foundation site. There a crane either mounted to the truck or as a standalone crane can be employed to assist in unloading and setting up of the packaged container housing structure 300 at the foundation site. Further details on how the housing structure can be transported and set up are described hereinabove with reference to the packaged housing structure 100. The packaged container housing structure 300 also includes a plurality of support feet 314 disposed in the container box frame 302. Selected ones of the support feet 314 from the plurality thereof are attachable to the bottom of the container box frame 302 to enable positioning it in a level orientation upon the mounting site.

With reference to FIGS. 52-55, the elongated container box frame 302 of the packaged container housing structure 300 generally includes a plurality of elongated corner members 316, a plurality of elongated side edge members 318 and a plurality of elongated end edge members 320. The elongated corner members 316 have one pair thereof disposed upright at a respective right and left front corners of the container box frame 302, and another pair thereof disposed upright at respective right and left rear corners of the container box frame 302. The elongated edge members 318 have one pair thereof disposed transversely between respective upper ends and respective lower ends of the right front and rear corners of the container box frame 302, and another pair thereof disposed transversely between respective upper ends and respective lower ends of left front and rear corners of the container box frame. The elongated side edge members 318 of both pairs extend parallel one another. The elongated end edge members 320 have one pair thereof disposed transversely between respective upper ends and respective lower ends of right and left front corners of the container box frame 302, and another pair thereof disposed transversely between respective upper ends and respective lower ends of right and left rear corners of the container box frame. The elongate end edge members 320 of both pairs extend parallel to one another. The elongated corner members 316 and the elongated side and end edge members 318, 320 are rigidly affixed together to form an interior space 322 in the container box frame 302 and an open top 324. Side edge members 318 are affixed approximate but below respective upper ends of the right and left, front and rear corners of the box frame. End edge members 320 are affixed at about upper ends of the right and left, front and rear corners of the box frame. Accordingly, a pair of opposite right and left open sides 328, 330, and a pair of opposite front and rear closed ends 332, 334 are provided. Both front and rear ends may include swingable doors respectively to provide access to the inside of the packaged container housing structure 300 from both ends.

Figures 54, 54A:
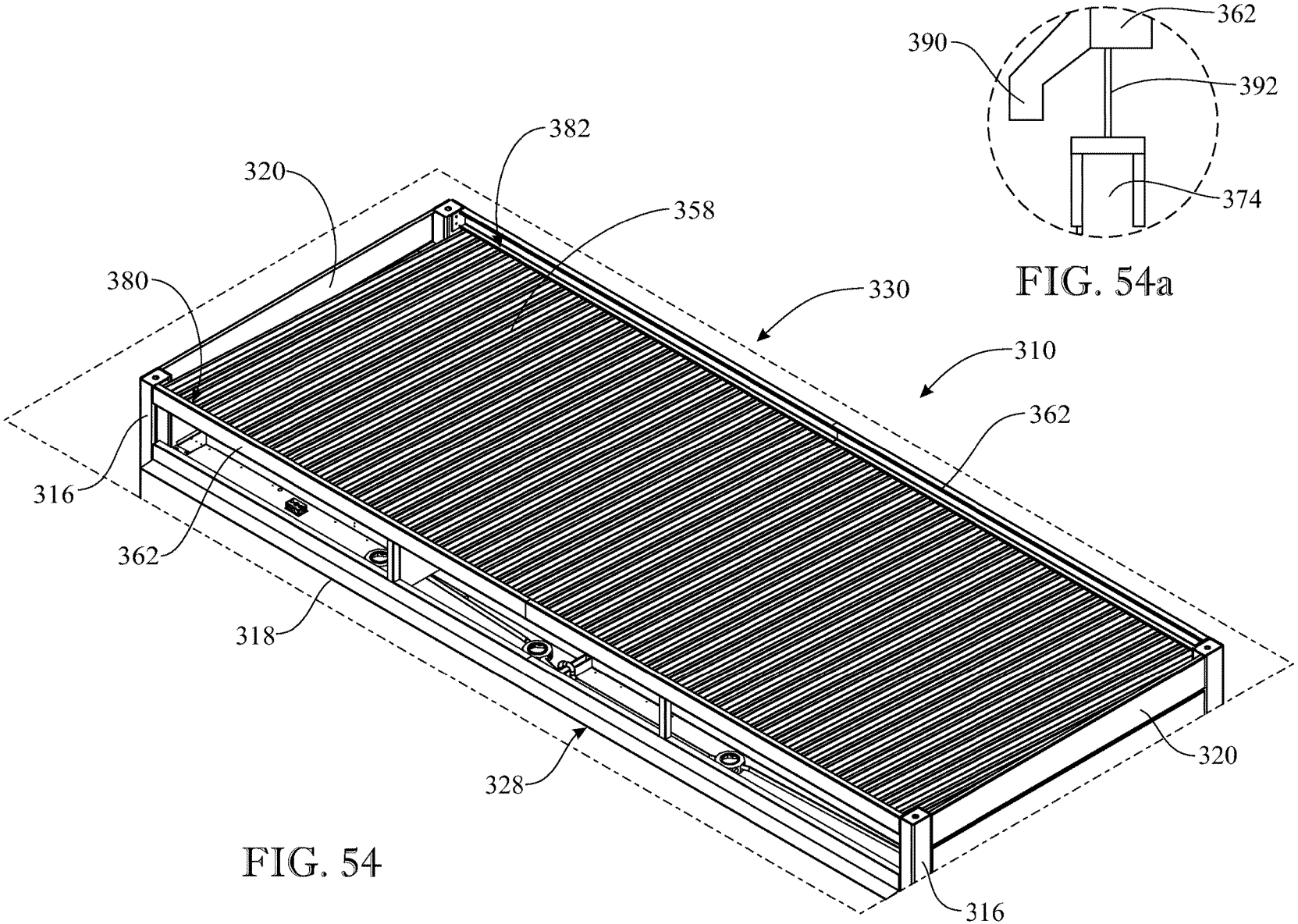
FIG. 54 presents a enlarged isometric view of the roof construction of the packaged container housing structure illustrated in FIGS. 52 and 53.
FIG. 54*a* presents an enlarged view of a guard that may be utilized to prevent the natural elements from entering the interior space of the housing structure through the air slot.
Figure 55:
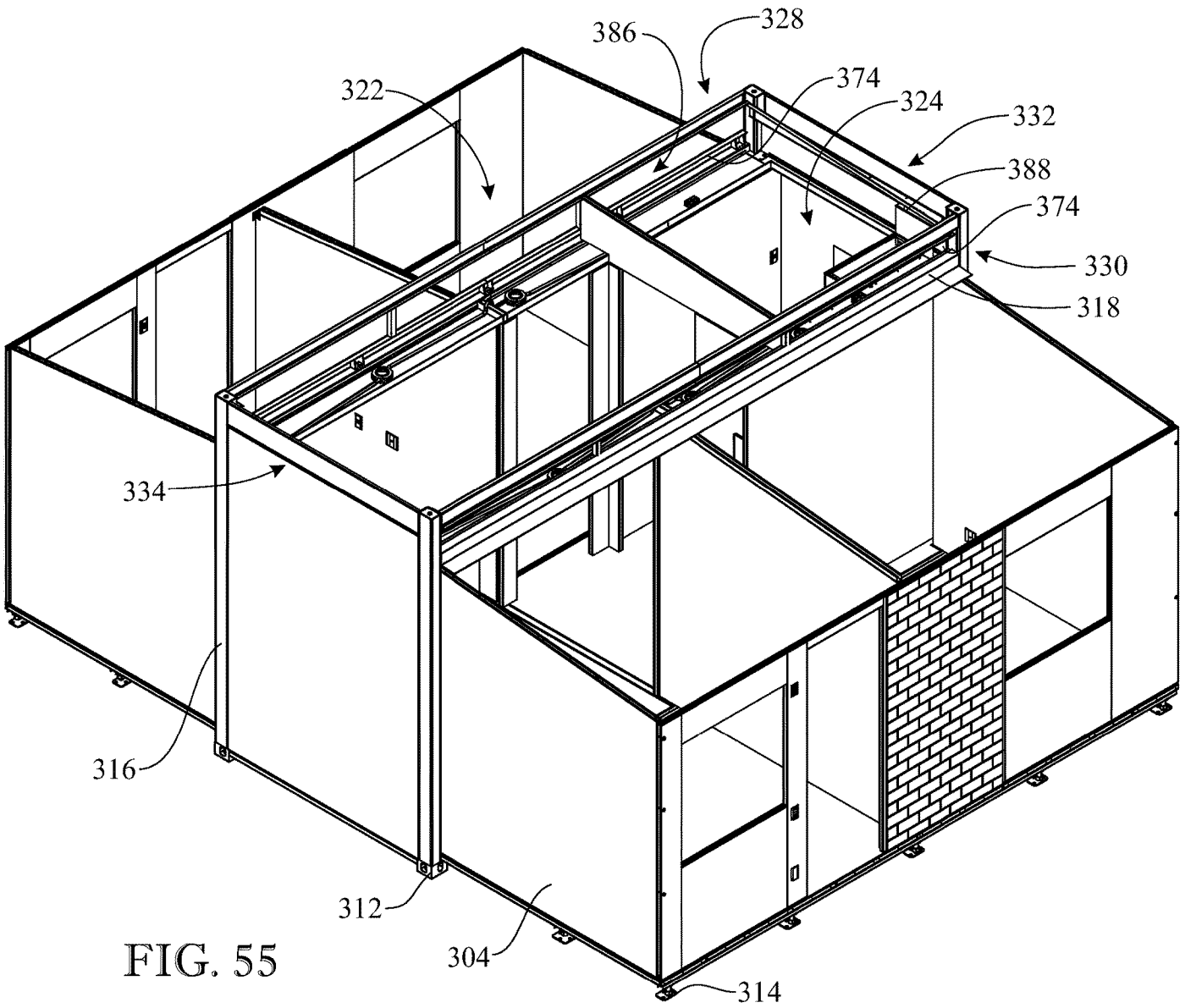
FIGS. 55 and 56 presents a top perspective view of the packaged container housing structure without exterior roof panels.
Figure 56:
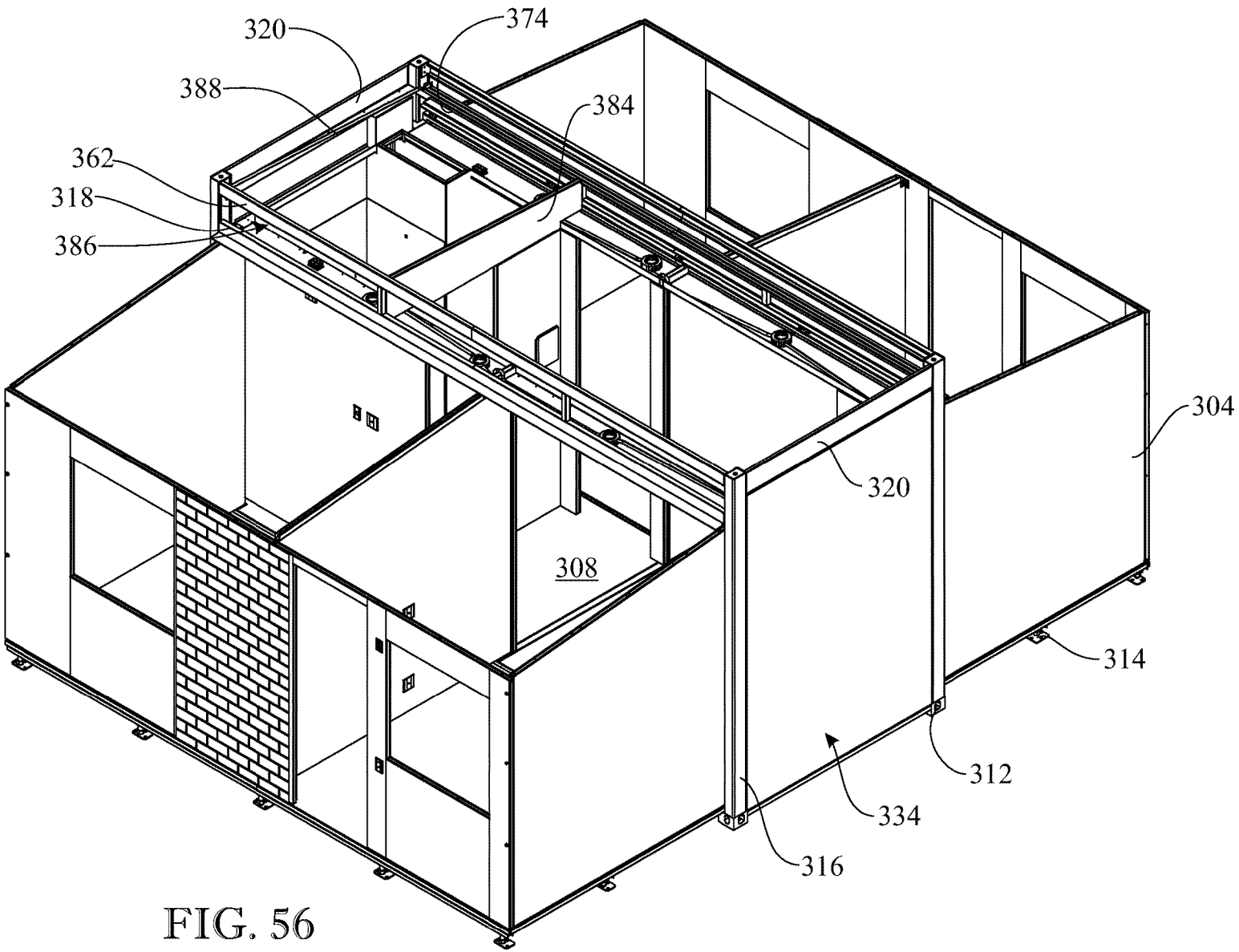

As shown in FIGS. 54-56, the top roof 310 of the packaged container housing structure 300 is mounted on the container box frame 302 preserving the opposite right and left open sides 328, 330 to give access to air flow between the top roof 310 and the open top 324 of the box frame into the interior space thereof. In one exemplary form, the top roof 310 may include a top cover 358 that has a pair of elongated side members 362 disposed above and in parallel with the interconnected side members 318. It is appreciated that the top cover 358 is generally provided to include a slope or pitch configuration with a side edge portion affixed to a top portion 380 of the elongated side member 362 on one respective side, and on the opposite side edge affixed to a bottom portion 382 of the opposite elongated side member 362 (FIG. 54). The end edges of the top cover 358 may be affixed to a pair of opposite support rails 388 that are adjacent to the end edge members 320. It is appreciated that the slope or pitch of the top cover 358 helps with proper drainage. The top roof 310 of the packaged container housing structure 300 may also include a cross-brace support member 384 disposed about the interior of the packaged container housing structure 300 to provide structural support for the top cover 358.

As is shown in FIGS. 55 and 56, the packaged container housing structure 300 includes an opposite pair of top windows 374 disposed about a pair of side openings formed by the open sides 328, 330 between the box frame 302 and the top roof 310. On one side of the pair of side open sides there is an air slot or opening 386 above one respective set of top windows 374, with no air gap opening on the other side (i.e., the side with no air gap only includes a set of top windows). In a preferred embodiment, the air gap opening 386 is provided on the side that the top cover 358 of the top roof 310 is affixed to the top portion 380 of the elongated side member 362, with the side that does not provide an air gap opening being the side that the side of the top cover 358 is affixed to the bottom portion 386 of the elongated member 362. This type of configuration allows a steady stream of air flow to enter the interior space of the housing structure, giving the interior space proper ventilation. The side that includes the air gap opening 386 may also include a rain guard 390 to prevent rain, snow, or any other form of precipitation from entering the interior space of the house (FIG. 54*a*). In another exemplary embodiment, but not to be understood as limiting, a mesh or netting 392 may be installed in the air gap opening 386 to prevent mosquitoes, birds, or any other form of animals from entering the interior space of the house. Furthermore, the present configuration of top windows 374 disposed about both sides of the box frame 302 allows sufficient lighting to enter the interior space of the house to light the interior space adequately.

Figure 57:
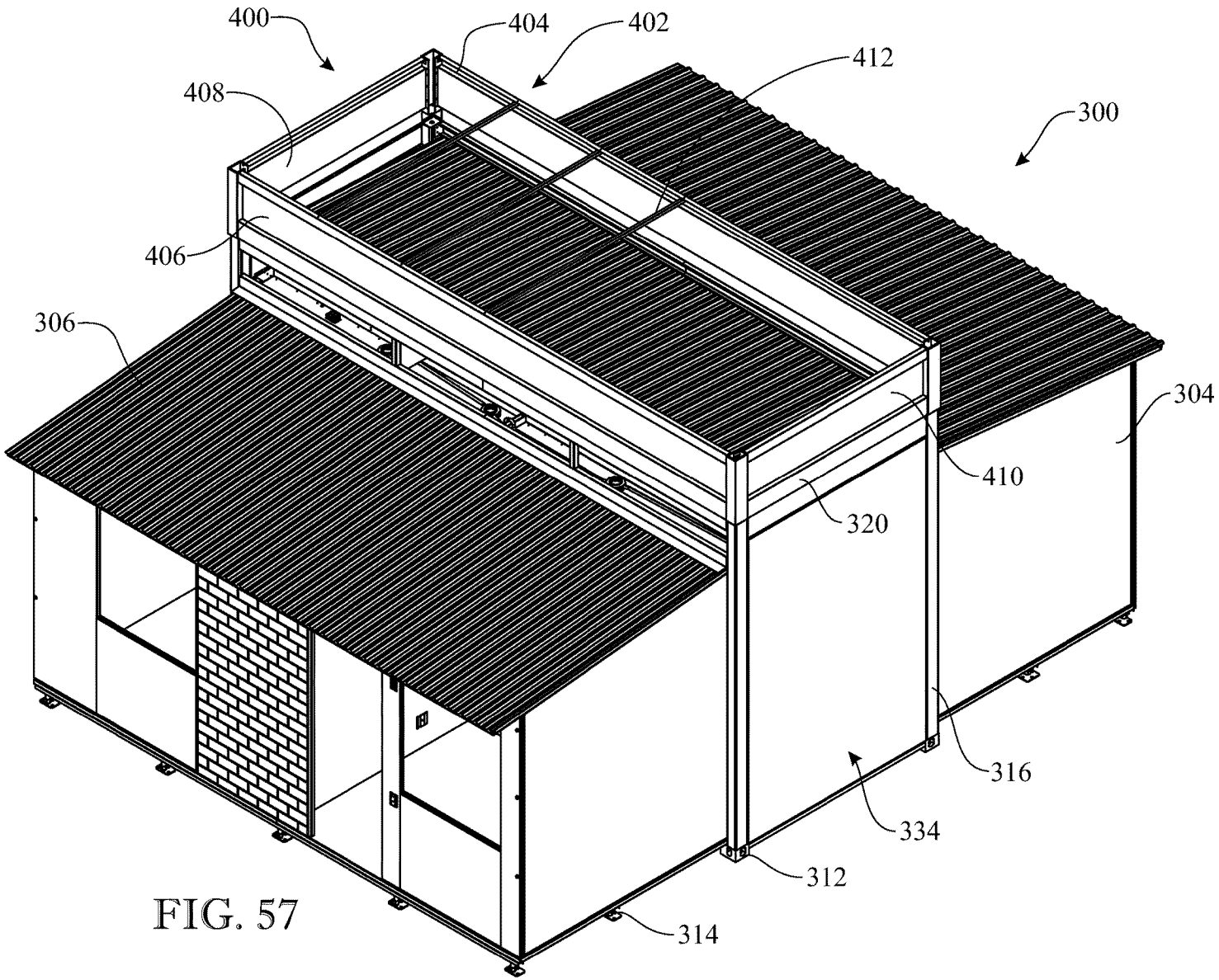

Turning now to FIG. 57, the packaged container housing structure 300 may also include a storage space 400 above the housing structure's top roof 310. The storage space 400 is generally provided by an enclosure 402 that comprises a pair of opposite right and left sides 404, 406, and a pair of opposite front and rear ends 408, 410 extending between and rigidly interconnecting the side members at their opposite ends to form the enclosure 402. It is appreciated that the shape of the enclosure matches the shape of the top roof 310. In this case, the shape of the enclosure is generally in the shape of a rectangle. However, it should be readily understood that alternative shapes and configurations may be employed without departing from intended scope of the invention.

With continued reference to FIG. 57, the enclosure 402 may include a plurality of cross-braces 412 spanning across the opposite right and left sides 404, 406 extending adjacent the pair of opposite front and rear ends 4008, 410 to provide structural support to the enclosure 402. In an exemplary form, the enclosure 402 may include a platform of planar configuration positioned between the top cover 358 of the top roof 310 and the bottom portion of the enclosure 402. The platform may be secured to the bottom end portions of the side members 404, 406 and end 408, 410 members respectively. The enclosure may be utilized to house, in one exemplary form only, an air-conditioning unit, a water heater, a generator, a water purification system, a supply tank for gas, solar panels, and/or the like.

In conclusion, the packaged housing structure 100 evolves from a shipping container to a completed house fully equipped to expand and appear as "new" home construction. It is intended to provide an affordable option to people in developing countries that presently live in poorly constructed homes. The interior of the house in either the single unit format or double unit format is fully customizable utilizing interchangeable interior wall and door panels. The position of the house raised above the foundation site 204 (such as composed of a concrete slab or any other suitable structure) by the support feet 114 provides significant ventilation, in the event an air-conditioning unit is not readily available, such that air can circulate from the bottom of the house and flow up through vents 125 in the interior flooring and out the top roof vents. This type of air flow or circulation allows the house to be maintained at a comfortable temperature without the need for a central air system. Even though the house originates from a shipping container frame, it can be fully wired, have proper plumbing, etc., the same as any newly constructed house. Potentially, the packaged housing structure 100, 300 can be off loaded and constructed (depending on its size) into a completed house anywhere between 5-10 hours.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A packaged container housing structure, comprising:

a container box frame of a rectangular configuration and a single unit format defining an interior space and having an open top, a closed bottom that includes at least one air vent, a pair of opposite right and left open sides and a pair of opposite open ends;

a plurality of deployable panels disposed in said interior space of said container box frame adjacent said opposite right and left open sides and said opposite open ends thereof;

a top roof mounted on said container box frame forming a first opening and a second opening disposed between said container box frame and said top roof extending laterally about said box frame, wherein said first opening is larger in size than said second opening;

a first set of top windows mounted along said first opening, and a second set of top windows mounted along said second opening; and an air slot extending longitudinally above said first set of top windows mounted along said first opening, wherein said air slot allowing air flow to enter said open top of said container box frame and into said interior space of said container box frame.

2. The packaged container housing structure of claim 1, wherein said top roof includes a rain guard that extends outwardly from said top roof to cover said air slot extending longitudinally above said first set of top windows to prevent precipitation from entering said interior space of said container box frame through said air slot.

3. The packaged container housing structure of claim 1, wherein said air slot includes a mesh.

4. The packaged container housing structure of claim 1, wherein said top roof comprises:

a top cover above and aligned with said open top of said container box frame and having right and left front corners and right and left rear corners aligned with upper ends of right and left front corners and right and left rear corners of said container box frame, said top cover having a pitch to provide drainage; and a plurality of coupling fittings removably attached to each one of said right and left front corners and said right and left rear corners of said top cover to enable lifting said packaged container housing structure to and from a foundation site.

5. The packaged container housing structure of claim 1, further comprising a plurality of support feet disposed in said interior space in said container box frame, selected ones of said support feet being attachable to selected ones of said deployable panels and to said container box frame under said closed bottom thereof at least adjacent to each one of said right and left front corners and said right and left rear corners of said closed bottom, said support feet being adjustable in length independent of one another so as to enable positioning said selected deployable panels and said container box frame in a level orientation upon a mounting site.

6. The packaged container housing structure of claim 5, wherein each of said plurality of support feet comprises:

an elongated tube;

a threaded stem affixed on and protruding from one end of said elongated tube so as to extend coaxially therewith;

an annular-shaped attachment disc enabling anchoring of said support foot to the mounting site; and a pair of annular threaded sections, one of said annular threaded sections being affixed on, and projecting from, said attachment disc, the other of said annular threaded sections being defined on an opposite end of said elongated tube from said threaded stem affixed at said one end of said elongated tube, said annular threaded sections being threadably engageable with one another such that said attachment disc extends laterally outwardly from said elongated tube being rotatable in opposite directions relative to said attachment disc so as to correspondingly retract and extend said elongated tube toward and away from said attachment disc to thereby adjust the length of said support foot and enable positioning said selected deployable panels and said container box frame in said level orientation upon the mounting site.

7. The packaged container housing structure of claim 1, further comprising another container box frame in addition to said one container box frame, said container box frames having complementary interengageable latches mounted at ones of said opposite ends of said container box frames placed adjacent to one another that become fastened together upon said container box frames being placed end-to-end at said adjacent one ends in a double unit format.

8. The packaged container housing structure of claim 1, wherein said plurality of deployable wall panels include wall panels with doorways and wall panels which are solid, said wall panels being interchangeable so as to provide different iterations of rooms in a completed house constructed from said packaged housing structure in both said single and double unit formats.

9. The packaged container of claim 1, further comprising an enclosure attachably removable to said top roof of said packaged container housing structure that provides a storage space above said top roof.

10. A packaged container housing structure, comprising:

a container box frame of a rectangular configuration and a single unit format, said container box frame comprising a plurality of elongated corner members having one pair thereof disposed upright at respective right and left front corners of said container box frame and another pair thereof disposed upright at respective right and left rear corners of said container box frame, said elongated corner members of said pairs thereof extending parallel to one another, a plurality of elongated side edge members having one pair thereof disposed transversely between respective upper ends and respective lower ends of said right front and rear corners of said container box frame and another pair thereof disposed transversely between respective upper ends and respective lower ends of said left front and rear corners of said container box frame, the elongated side edge members of said pairs thereof extending parallel to one another, a plurality of elongated end edge members having one pair thereof disposed transversely between said respective upper ends and respective lower ends of said right and left front corners of said container box frame and another pair thereof disposed transversely between said respective upper ends and respective lower ends of said right and left rear corners of said container box frame, said elongated end edge members of said pairs thereof extending parallel to one another, said elongated corner members and said elongated side and end edge members being rigidly affixed together to form an interior space in said container box frame and an open top, a closed bottom, a pair of opposite right and left open sides and a pair of opposite open ends, on said container box frame;

a plurality of deployable panels disposed in said interior space in said container box frame adjacent said opposite right and left open sides and said opposite open ends thereof, selected ones of said deployable panels being movable relative to respective ones of said pluralities of elongated corner members and side edge members at right and left sides of said container box frame for deploying and erecting one or more rooms at right and left sides of said container box frame;

a top roof mounted on said container box frame providing a pair of opposite right and left openings between said container box frame and said top roof, comprising a top cover above and aligned with said open top of said container box frame and having right and left front corners and right and left rear corners aligned with upper ends of right and left front corners and right and left rear corners of said container box frame, said top cover having a pitch to provide drainage;

a pair of top windows mounted along said pair of opposite right and left openings, wherein one opening of said right and left openings includes an air slot provided above said mounted top window, said air slot giving access to air flow to enter said open top of said container box frame into said interior space of said container box frame; and a plurality of coupling fittings removably attached to each one of said right and left front corners and said right and left rear corners of said top cover to enable lifting said packaged container housing structure to and from a foundation site.

11. The packaged container housing structure of claim 10, wherein one opening of said pair of opposite right and left openings is larger in size than another.

12. The packaged container housing structure of claim 10, wherein said top roof includes a rain guard that extends outwardly from said top roof to cover said air slot to prevent precipitation from entering said interior space of said container box frame through said air slot.

13. The packaged container housing structure of claim 10, wherein said air slot includes a mesh to prevent unwanted entry of insects.

14. The packaged container housing structure of claim 10, further comprising a plurality of support feet disposed in said interior space in said container box frame, selected ones of said support feet being attachable to selected ones of said deployable panels and said to container box frame under said closed bottom thereof at least adjacent to each one of said right and left front corners and said right and left rear corners of said closed bottom, said tubular feet being adjustable in length independent of one another so as to enable positioning said selected deployable panels and said container box frame in a level orientation upon a mounting site.

15. The packaged container housing structure of claim 14, wherein each of said plurality of support feet comprises:

an elongated tube;

a threaded stem affixed on and protruding from one end of said elongated tube so as to extend coaxially therewith;

an annular-shaped attachment disc enabling anchoring of said support foot to the mounting site; and a pair of annular threaded sections, one of said annular threaded sections being affixed on, and projecting from, said attachment disc, the other of said annular threaded sections being defined on an opposite end of said elongated tube from said threaded stem affixed at said one end of said elongated tube, said annular threaded sections being threadably engageable with one another such that said attachment disc extends laterally outwardly from said elongated tube being rotatable in opposite directions relative to said attachment disc so as to correspondingly retract and extend said elongated tube toward and away from said attachment disc to thereby adjust the length of said support foot and enable positioning said selected deployable panel and said container box frame in said level orientation upon the mounting site.

16. The packaged container housing structure of claim 10, further comprising another container box frame in addition to said one container box frame, said container box frames having complementary interengageable latches mounted at ones of said opposite ends of said container box frames placed adjacent to one another that become fastened together upon said container box frames being placed end-to-end at said adjacent one ends in a double unit format.

17. The packaged container housing structure of claim 16, wherein said plurality of deployable wall panels include wall panels with doorways and wall panels which are solid, said wall panels being interchangeable so as to provide different iterations of rooms in a completed house constructed from said packaged container housing structure in both said single and double unit formats.

18. The packaged container housing structure of claim 10, further comprising an enclosure attachable removable to said top roof of said packaged container housing structure that provides a storage space above said top roof that is able to store any one of an air-conditioning unit, a water heater, a generator, a water purification system, a gas tank, and a plurality of solar panels.

19. A packaged container housing construction method, comprising:

providing a container box frame of a rectangular configuration defining an interior space and an open top, a closed bottom having at least one air vent, a pair of opposite right and left open sides and a pair of opposite front and rear open ends;

providing a plurality of deployable panels in said interior space of the container box frame adjacent to said opposite right and left open sides and opposite front and rear open ends such that selected ones of said deployable panels are movable relative to respective ones of said opposite right and left open sides of the container box frame for deploying and erecting one or more rooms at right and left sides of said container box frame;

providing a top roof mountable on said container box frame, said roof top providing a pair of opposite right and left openings between said container box frame with pair of top windows mounted thereon, wherein one opening of said right and left openings includes an air slot provided above said mounted top window giving access to air flow to enter said open top of said container box frame into said interior space of said container box frame;

providing a plurality of support feet from said interior space in said container box frame, the support feet being adjustable in length independent of one another;

retrieving selected ones of said support feet from said interior space in the container box frame and attaching said selected support feet under said closed bottom of said container box frame at least adjacent to each one of right and left front corners and right and left rear corners of said closed bottom thereof;

adjusting said length of each of said support feet so as to enable positioning said container box frame in a level orientation upon a mounting site; and positioning said container box frame in said level orientation upon a foundation site.

* * * * *